US008800650B2

(12) United States Patent
Spray et al.

(10) Patent No.: US 8,800,650 B2
(45) Date of Patent: Aug. 12, 2014

(54) EXPANDABLE TUBULARS FOR USE IN GEOLOGIC STRUCTURES

(75) Inventors: Jeffery A. Spray, Houston, TX (US); Steven Svedeman, San Antonio, TX (US); David Walter, San Antonio, TX (US); Peter Mckeighan, San Antonio, TX (US); Shane Siebanaler, San Antonio, TX (US); Peter Dewhurst, Kingston, RI (US); Steven Hobson, Brookline, MA (US); Doug Foss, Brookline, MA (US); Holger Wirz, Brookline, MA (US); Aaron Sharpe, Brookline, MA (US); Michael Apostal, North Kingston, RI (US)

(73) Assignee: Dynamic Tubular Systems, Inc., Houston, TX (US)

( * ) Notice: Subject to any disclaimer, the term of this patent is extended or adjusted under 35 U.S.C. 154(b) by 781 days.

(21) Appl. No.: 12/162,374

(22) PCT Filed: Mar. 12, 2007

(86) PCT No.: PCT/US2007/006193

§ 371 (c)(1),
(2), (4) Date: Aug. 19, 2009

(87) PCT Pub. No.: WO2007/106429

PCT Pub. Date: Sep. 20, 2007

(65) Prior Publication Data

US 2010/0038076 A1 Feb. 18, 2010

Related U.S. Application Data

(60) Provisional application No. 60/781,047, filed on Mar. 10, 2006, provisional application No. 60/789,835, filed on Apr. 6, 2006, provisional application No. 60/793,024, filed on Apr. 18, 2006, provisional application No. 60/808,831, filed on May 25, 2006, provisional application No. 60/812,029, filed on Jun. 7, 2006, provisional application No. 60/832,530, filed on Jul. 20, 2006.

(51) Int. Cl.
*E21B 43/08* (2006.01)
*E21B 43/10* (2006.01)

(52) U.S. Cl.
USPC ..... 166/207; 166/214; 166/384

(58) Field of Classification Search
USPC ..... 166/207, 214, 384; 249/49, 178, 180, 249/183; 405/184.2
See application file for complete search history.

(56) References Cited

U.S. PATENT DOCUMENTS 1,300,393 A * 4/1919 Hodges ..... 249/49
1,380,182 A 5/1921 Bigelow (Continued)

FOREIGN PATENT DOCUMENTS

EP 0899420 A1 3/1999

OTHER PUBLICATIONS

Office Action in Canadian Patent Application No. 2646468, dated Feb. 23, 2010 (2 pages).

(Continued)

*Primary Examiner* — Kenneth L Thompson
*Assistant Examiner* — Robert E Fuller
(74) *Attorney, Agent, or Firm* — Osha Liang LLP

(57) ABSTRACT

An expandable tubular includes a plurality of leaves formed from sheet material that have curved surfaces. The leaves extend around a portion or fully around the diameter of the tubular structure. Some of the adjacent leaves of the tubular are coupled together. The tubular is compressed to a smaller diameter so that it can be inserted through previously deployed tubular assemblies. Once the tubular is properly positioned, it is deployed and coupled or not coupled to a previously deployed tubular assembly. The tubular is useful for all types of wells and boreholes.

31 Claims, 18 Drawing Sheets

(56) References Cited

U.S. PATENT DOCUMENTS

| | | | | |
|---|---|---|---|---|
| 1,880,218 | A | 10/1932 | Simmons | |
| 5,186,215 | A * | 2/1993 | Gilleland | 138/98 |
| 5,355,956 | A | 10/1994 | Restarick | |
| 5,901,789 | A | 5/1999 | Donnelly et al. | |
| 6,250,385 | B1 * | 6/2001 | Montaron | 166/207 |
| 6,315,040 | B1 * | 11/2001 | Donnelly | 166/207 |
| 6,412,565 | B1 * | 7/2002 | Castano-Mears | 166/381 |
| 6,516,506 | B2 * | 2/2003 | Donnelly et al. | 29/451 |
| 6,775,894 | B2 | 8/2004 | Hardin | |
| 7,143,825 | B2 * | 12/2006 | Pointing | 166/241.6 |
| 7,172,027 | B2 * | 2/2007 | Simpson et al. | 166/382 |
| 7,380,595 | B2 * | 6/2008 | Wetzel et al. | 166/227 |
| 2004/0065445 | A1 | 4/2004 | Abercrombie Simpson et al. | |
| 2007/0181296 | A1 * | 8/2007 | Hall et al. | 166/65.1 |

OTHER PUBLICATIONS

Gulf Cooperation Council Examination Report issued in Application No. GCC/P/2007/8088 dated Feb. 9, 2011, 4 pages.

Chinese Office Action issued in Application No. 200780016795.3 dated Sep. 28, 2011, 18 pages.

Chinese Office Action issued in Application No. 200780016795.3 dated Apr. 28, 2012 with English translation, 7 pages.

Chinese Office Action issued in Application No. 200780016795.3 dated Jan. 16, 2013 with English translation, 13 pages.

Office Action for Chinese Application No. 200780016795.3 dated Apr. 23, 2013, with English translation thereof (10 pages).

* cited by examiner

EXPANDABLE TUBULARS FOR USE IN GEOLOGIC STRUCTURES

CROSS-REFERENCE TO RELATED APPLICATIONS

The present invention claims priority to U.S. Patent Application for EXPANDABLE TUBULARS FOR USE IN PRODUCTION OF HYDROCARBONS, application Ser. No. 10/925,521 and PCT Patent Application for EXPANDABLE TUBULARS FOR USE IN PRODUCTION OF HYDROCARBONS Application No. PCT/US2004/027580, both filed Aug. 25, 2004, U.S. Patent Application for Expandable Split Pipes For Use In Geologic Structures, Application No. 60/781,047 filed Mar. 10, 2006, U.S. Patent Application for High Ratio, Elastic Region Tubular Expansion, Application No. 60/789,835 filed Apr. 6, 2006, U.S. Patent Application for Split Pipe Casing Application No. 60/793,024 filed Apr. 18, 2006, U.S. Patent Application for Expandable Tubulars For Use In Geologic Structures [Coil] Application No. 60/808,831 filed May 25, 2006, U.S. Patent Application for Expandable Tubulars For Use In The Production Of Hydrocarbons, Application No. 60/812,029 filed Jun. 7, 2006 and U.S. Patent Application for Archimedean Spiral For Expandable Tubulars, Application No. 60/832,530 filed Jul. 20, 2006. These Patent Applications are hereby incorporated by reference.

GOVERNMENT INTERESTS

This invention was made at least partially with Government support under Contract Nos. DE-FG26-05NT15491 and DE-FC26-05NT15483, both awarded by the U.S. Department of Energy. The U.S. Government has certain rights in this invention.

TECHNICAL FIELD

The present invention relates generally to expandable pipes for use in geologic structures, such as for use in operations related to the production of hydrocarbons, such as oil and gas, or oil field tubulars, and for use in similar wells and structures, such as exploratory boreholes and wells, water wells, injection wells, monitoring and remediation wells, tunnels and pipelines; methods for expanding oil field tubulars and other expandable tubulars; and methods for manufacturing expandable tubulars.

BACKGROUND OF THE INVENTION

Despite a century of technological advances, drilling and construction of oil and gas wells remains a slow, dangerous, and expensive process. The costs of some wells can exceed 100 million dollars. A significant contributor to these high costs is due to suspension of drilling in order to repair geologically-related problem sections in wells. These problems can include, but are not limited to, lost-circulation, borehole instability, and well-pressure control. However, these problems are still generally rectified only by costly and time-consuming casing and cementing operations. Such conventional stabilization and sealing processes are required at each problem-instance, often dictating installation of a series of several diametrically descending, or telescopic-casing strings. Generally, a casing string is installed from the surface to each problem zone and a 10,000 foot deep well often requires 20,000-30,000 feet of tubulars, because of overlapping sections.

As is well known in the art, disadvantages of telescoping practices are numerous. These disadvantages include, but are not limited to, excess excavation work, special equipment for over-size rock borings, and production of costly waste products. Beginning diameters in excess of 24 inches are usually required to allow a diameter of about 5 inches or less at the end of a final production string. Large-scale drilling operations can require drilling equipment hoist ratings as high as 2,000,000 pounds and may require several acres for the drill-site. Both requirements can be attributed to various casing needs and operations. Despite major expenditures and efforts, drilling might not reach the targeted resources. If the final telescope casing size (or production string) is too small to economically produce the hydrocarbon resource, the result is a failed well.

The energy industry, therefore, has pursued development of plastically-deformed expandable well-casings and single diameter well-casing systems (also known as "mono-diameter" or "monobore"), wherein one size casing is preferably used from the surface to the target zone, typically some 1-7 miles below. Single diameter concepts can replace former surface-to-problem-zone casing string installation, with discrete-zone placement of an expandable casing. For example, a median casing size of 9⅝ inch outside-diameter ("OD") in an un-expanded state can be passed through a casing in the expanded state, and then the un-expanded casing can then be expanded to function in a nominal 10 inch to 12 inch borehole by means of a cold-work, mechanical steel deformation process performed in-situ. The expanded casing assembly must, however, meet certain strength requirements and allow passage of subsequent 9⅝ inch outer diameter casing strings as drilling deepens and new problem zones are encountered.

The foregoing deforming process inherently requires use of relatively soft steels, which may not provide the desired mechanical properties required in the environments of oil and gas wells. It is believed that most potential users cannot utilize current expandables due to fundamentally unsolvable technical or economic issues.

For example, it is believed that conventional expandable tubulars do not provide a good seal, because they do not comply adequately with the irregular wall surfaces of wells. Expandable tubulars made of steel materials have a natural tendency to "spring back" from their altered states to their natural or original form. Spring back is also sometimes referred to as "recovery", "resilience", "elastic recovery," "elastic hysteresis," and/or "dynamic creep." Spring back exists in all stages of worked materials. For pre-ruptured tubes, different degrees of deformity throughout the thickness of the tube-arc can translate into spring back rates that vary according to the severity of arc resulting from the deformation. As a result, it is believed that conventional expandable tubulars can never properly comply or seal.

Furthermore, plastic deformation is achieved by forcing an expansion device, such as a pig or a mandrel to expand and permanently deform the tubular. The expansion device can be (1) forced downward through the tubular to deform it (2) pulled upward through the tubular, (3) rotated within the tubular, or (4) combinations thereof The expansion device can also have tapered wedges or rollers. However, it is also well known that high-levels of deformity can cause stress-cracking, a variety of metallurgical problems, and decreased mechanical properties.

A further disadvantage of presently known expandable tubulars is that as the tubular is deformed radially, such outward radial expansion causes the overall length of the tubular to be shortened by some 1% to 3% or more. Such shrinkage along the longitudinal axis of the tubular member is undesirable. An inability to supply extra material to the shrinkage can impede radial expansion. For example, if the pre-expanded casing becomes "stuck" or otherwise placed into tension longitudinally, the need to service the shrinkage cannot be met and the deforming material becomes prematurely strained. This is also a major source of difficulty when expanding threaded connections.

SUMMARY OF THE INVENTION

The present invention is directed towards expandable tubular structures that can be used to provide support for drilled holes for use in oil and gas extraction. The inventive tubular is compressed for installation within a borehole. In the compressed state, the inventive tubular can pass through the inner diameter of other tubulars that have been deployed within the borehole. Once the tubular has been properly positioned, it is deployed with or without being coupled to adjacent tubulars.

The expandable tubular structures include a plurality of curved leaves that are made of high-strength sheet metal or other materials. The curvature of each leaf extends around some of the circumference or around the entire circumference of the inventive tubular structure. A leaf that wraps around the diameter multiple times may resemble a watch spring in cross section. The leaves overlap each other to form a multi-layered expandable tubular structure where each portion of the circumference includes one or more leaf layers. The leaves can be configured to overlap in a spiral or iris cross section pattern. Alternatively, the leaves may occupy a specific layer within the tubular assembly forming a concentric circle cross section.

Some of the leaves are secured to each other by welding, soldering, brazing, mechanical fasteners, surface features, adhesives and any other coupling mechanisms. The attachment points can be one edge of a leaf to a more central section of an adjacent leaf. In order to allow for radial expansion and contraction, some of the leaves surfaces or edges are not coupled to an adjacent leaf. The uncoupled leaves allow some of the adjacent leaves to slide against each other which facilitates the diameter of the inventive tubular to expand or contract. In the preferred embodiment, the leaves are made of steel with good elasticity characteristics. During compression, the diameter decreases and the leaves are bent elastically inward. The tubular is held in the compressed state with energy stored in each of the leaves. When the tubular is deployed, the restraints are released and the elastic leaf material will recover to their original shape or expand against the inner diameter of the borehole.

In an embodiment, bands or other fasteners may be secured around the tubular to hold it in the compressed diameter after the tubular is compressed to the required diameter. The functions of these bands may also become integrated within the tube in order to minimize the use of borehole volume and the number of parts requiring manufacture and assembly. These fasteners may be released once the tubular structure is properly positioned. The release mechanism can be thermal, electrical, or mechanical. For example, if the compression bands include a sacrificial low temperature link, heat can be applied to melt the link which causes the band to break and allows the tubular to expand. The bands may include an electrical release mechanism which may be coupled with wires to a signal source that releases the mechanism. The release mechanism may have a radio receiver for wireless actuation or wires may be run to the release mechanism. The bands may have a tensile strength slightly higher than the inherent expansion force of the tubular, so that when an expansion force occurs through the inner diameter of the tubular, the compression bands are broken.

If the tubular does not fully expand to the desired diameter such as the inner diameter of the borehole, an expansion plug can be forced through the inner diameter of the tubular which causes the tubular to further expand. The expansion plug can be a tapered cylindrical device that is attached to a rod or other device that causes the plug to be drawn through the tubular. The expansion plug may require no attachment to a rod and be hydraulically forced through the tubular. Full expansion may also be obtained by use of only hydraulic force, where no plug is required. In this embodiment, the tube's naturally expanded condition and locking mechanisms hold the tubular in the expanded state after the expansion plug has been used. The expansion locking mechanism can have many forms. In one embodiment, the contact surfaces of the leaves are treated to form an abrasive surface, such as micro-textured surfaces, that prevent sliding and cause the tubular to be locked in an expanded state after it has been deployed. The surface treatment can be an abrasive pattern of protrusions and indentations formed in the metal surface or an additional layer of abrasive material that is applied to the layers.

In some embodiments, a temporary lubricant is used to allow sliding movement of the leaves. The lubricant can then be removed to prevent sliding of the leaves. For example, a hard wax can be used as a temporary lubricant that is applied to the sliding abrasive surfaces during assembly of the tubular structure. The wax allows the surfaces of the leaves to slide against each other for compression and expansion of the tubular. When the tubular is deployed in the desired position and the user wishes to lock the tubular in place, heat is used to melt the wax which flows away from the leaves. The removal of the wax causes the abrasive surfaces to contact each other. The abrasive surfaces do not allow for relative movement when they are pressed against each other.

In another embodiment, the leaves have ratchet mechanisms that use tabs to engage slots and teeth formed in adjacent leaves. The tabs may include elongated arm pieces that are attached to the leaf but bent out of the planes of the leaf. The tabs engage slots in the adjacent leaves that may be similar in size so that the tab can slide within the leaf The tab and slot may have teeth that are angled so that they allow ratcheted movement in only an expansion direction. The ratchet mechanism can be configured so that the teeth of the tab and slot only engage after the casing has been expanded to a minimum expansion diameter. Because the tabs and slots couple the leaves of the casing, they effectively integrate the entire thickness of the casing into a unitary assembly.

Another method for locking the tubular in the expanded state is by using an adhesive to secure the leaves of the tubular. In this embodiment, a liquid is applied to the tubular and is able to flow between the closely spaced leaves and the inner diameter of the bore hole. Mechanisms are used to keep the liquid in place while the liquid hardens. Once hardened, the tubular is permanently expanded. The liquids can include adhesives, metals, polymers, cement, or other type of material that can be applied in a liquid and then harden into a solid. If an adhesive is used, it may harden with exposure to oxygen, a catalyst hardener, UV light, evaporation of liquids or other adhesive phase transformation means. If a metal is used, the metal is caused to be a liquid state in order to allow the tubular structure to expand. As the metal cools it hardens and bonds the leaves to each other. It may be possible to reverse this process by heating the metal to re-liquefy it and then make adjustments to the tubular. If polymers are used, they may remain liquid until they are chemically bonded to each other.

In another embodiment, deformable jackets are used to cover the inner diameter and the outer diameter of the tubular structure. The jackets provide sealing mechanisms that prevents fluids from leaking through the leaves. In an embodiment, the inner jacket includes a locking mechanism that prevents the tubular from compression after it has been expanded. Other details of the inventive tubular structure are disclosed in the detailed description.

DETAILED DESCRIPTION OF THE INVENTION

Figure 1:
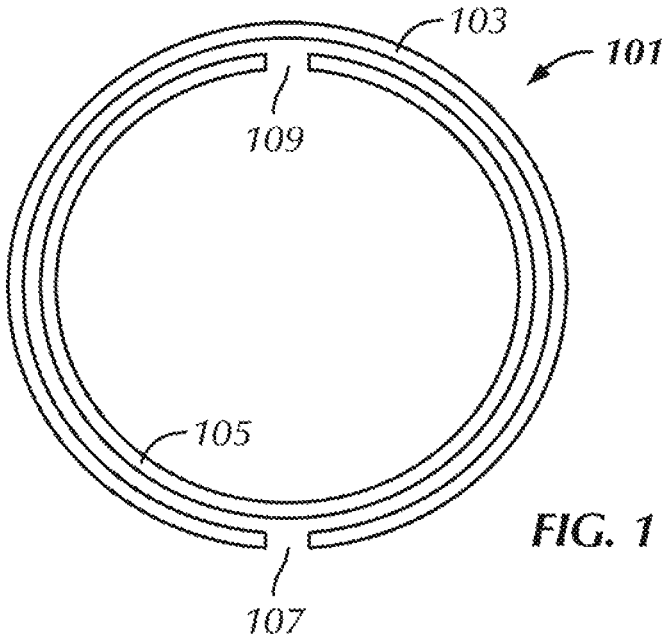
FIG. 1 is a cross section view of a two leaf and two layer embodiment of the expandable tubular in the compressed state.

The present invention is directed towards tubular structures that are expandable in diameter. The inventive tubular structures may be compressed and placed into a borehole in the ground or any other structure. In the compressed state, the tubular is able to fit within the inner diameter of a deployed tubular and provide a suitable circulating annulus. Thus, the compressed tubular is placed into a borehole through other deployed tubulars. Once the tubular structure is properly positioned, which may or may not include attachments to adjacent deployed tubulars, it is expanded in diameter until its outer diameter is resisted by the rock borehole. The expanded casing may penetrate the walls of the borehole.

In an embodiment, the inventive expandable tubular may comprise a plurality of expandable springs that are sheets of strong elastic material that are formed into a generally cylindrical shape from at least one sheet of material and have at least two free ends that extend along the circumferential edge and along the length or height of the cylindrical shape. The expandable springs will hereinafter be referred to as "split sleeves." Multiple split sleeves are assembled into a single well casing or tubular by stabilizing at least one side of the "split".

The inventive split sleeves can utilize opposing, elastic-processes to reliably expand a cylindrical structure that is used as a high-strength pipe. The split sleeves are constructed from compressible cells and other types of energized members, which are formed into a tubular with a naturally oversized outer diameter. The device is temporarily compressed during manufacture and held in the reduced diametric condition by removable bonds and integral wrappings. Once placed into the well, the temporary bonds are removed by electric, mechanical and chemical compression means. The split sleeves are then allowed to assume their natural uncompressed state result is a strain-energized assembly having natural dimensions larger than its nominal sizing requirements.

The technological concept facilitates expansion reliability by performing most of this work during fabrication. Where needed, high amounts of conventional hydraulic and/or mechanical forces are used to compress the tubular's outer diameter. Once compressed, the tubular is held in the smaller diameter and the energy used to reduce the outer diameter the tubular is stored in the compressed tubular. When the tubular is released, the outward expansion energy is released and the outer and inner diameters expand. By augmenting the device's natural bias, tremendous amounts of downhole work can be utilized to make very robust expandable tubulars, which also provide high-pressure formation sealing capability as an integral benefit.

Since residual strain-energy is exerted against the formation, there is no 'spring-back' effect with the new method.

This provides foundation for high-pressure annular sealing. The tubular's structure is adjustable during expansion making the device highly compliant to irregular wellbore surfaces. In a preferred approach, the efficient use of compound expansion forces are actually used to locally reshape geology, according to the tubular's optimal fit. Contrary to other approaches seeking to comply with the well environment, the new system does not substantially sacrifice strength properties as compliance is obtained. High-pressure sealing is one approach to provide integrated solutions and reduce standard well construction costs.

These spatial references relate to the general shape of a cylinder having a circumference, a diameter and a length (as laid on the ground) or height (as lowered into a well). The height and length of the sleeve or casing can also be referred to as the longitudinal direction. The expandable sleeves or tubulars or casings of the present invention can be radially compressed to form a cylindrical shape with a smaller outer diameter prior to use in wells.

In an embodiment, the casing design is constructed from high-deflection members that have a large elastic range. This type of tubular design uses multiple layers of high strength relatively thin material and provides many desirable mechanical capabilities. For example, the expansion capability of this type configuration can be in excess of 200%. This high expansion percentage capability allows for broad applications of the technology ranging from relatively simple bore hole clads to through-tubing products and heavy industrial piping applications. Generally, an expansion percentage of 135% is required for an expandable device to be integrated into the drilling operation, allowing for adequate supply of both wall-thickness and circulating annulus. The technology is suitable for a wide range of pipe diameters, ranging from less than 3 inches to greater than 28 inches.

Numerous elastic members can be arranged to form a device with considerable thickness and mechanical properties. A further important aspect of the technology is that it can be constructed from very high yield strength materials. Mechanical performance increases directly with both the quality of and quantity of material supplied. By way of example new expectations for large-diameter well design, a bi-center bit program for 16 inch diameter casing can be provided casing with a 1.5 inch or greater wall-thickness, 250-ksi or higher material construction, 135% or greater expansion capability, and with no loss of standard inner diameter. Similarly, a two inch or greater thickness expandable can be implemented into conventional 16 inch casing programs. Towards more typical sizes, a 9⅝ inch casing using high-yield materials and one inch or greater wall thickness is also in the reasonable range of the inventive technology.

Construction of the new expandable from elastic-region components provides feasibility for device integration into the actual drilling operations. This is the primary principle towards delivery of the expandable on a real time basis. Since the new tubular needs only certain regions of elastic function in order to properly become opened, drilling stresses do not automatically destroy the material's expansive integrity. Additionally, the types of robust casing specifications capable of the new method can be viewed also as bottom hole assembly specifications.

In another embodiment, the expandable tubulars or casings can include a plurality of stacked smaller split ring segments, for example a ring with a cut or a gap along the circumferential edge, to form the general shape of a cylinder. Similar to the embodiment having a continuous layer, the individual ring segments can be radially compressed to form a compressed tubular. Furthermore, the individual ring segments can be situated so that orientation of the cut areas or gaps is controlled as desired.

The term "tubular" or "casing," as used herein, means a structure having a substantially cylindrical shape and is useful in geological structures. Non-limiting examples covering both open-hole and cased hole applications; covering delivery into the subsurface by conventional successive pipe string assemblies, integral as a sleeve about a pipe assembly, by wireline, coil-tubing, through-tubing, integral as whole sections of the drilling, testing or production assembly, freely dropped, pumped-in, one-trip, and no-trip delivery; covering conventional downhole product diameters, generally between 2.375 and 28 inches, re-entry diameters, generally less than 5 inches, microhole diameters generally less than 4.5 inches, and large-diameter tubulars and products, generally larger than 16 inches; covering well telescoping well construction types, nested construction, monodiameter with overlap sections, monodiameter without overlap sections, discrete section construction, discrete placement; covering sealing by flexible layers such as elastomers, integral sealing such as pliable arcuate steel elements about the outer diameter, conjunctive with conventional sealants such as cements contained integral or subsequently delivered through ports; covering adhering the device by friction against geology or existing tubular, integrating with geology or existing tubular, penetrating geology or existing tubular, shaping local geology or existing tubular, include conventional terms—basepipes, casing, casing extensions, cladding, drilling sleeves, couplings or connections, drilling with casing, drive casing, hangers, heaters, instruments, integral drilling assembly tools, integral perforation charges, selectively perforated integral, isolation sleeves, fishing tools, liners, packers, patches, porous lost-circulation patches, screens, shoes, tools, and tubing. The tubulars or casings of the present invention can be used in geologic structures, such as wells in the extraction of hydrocarbons.

The term "burst pressure" or "collapse pressure," as used herein, means that the casing can ultimately withstand certain amounts of internal or external pressure that exerts a radial or hoop force without becoming damaged. It is preferred that a leak path is not initiated at the specified burst or collapse pressure.

The casings described herein are capable of radial expansion from a compressed radial state, and, therefore, have at least a compressed state and an expanded state. It is preferable to have an outer diameter in the expanded state that is larger that the operating diameter of the well bore. It is more preferred that the outer diameter of the casing in its uncompressed state is greater than the nominal operating diameter of the well bore. It is also preferred that at least part of the radial expansion is elastic. The elastic portion of the radial expansion can be all or any part of the total expansion.

Any remaining expansion can also be obtained by any physical methods, processes or apparatus used to expand the diameter of a tubular structure. There are various mechanisms that can be used to hold the tubular structure in the expanded state. For example, internal pressure can be applied to further expand the casing to its final expanded diameter by increasing fluid pressure or by utilizing an expansion apparatus, such as a plug or mandrel. The casing can be held in this expanded state, by various mechanisms: ratchet features, textured surfaces, micro-textured surfaces, friction, bonding, and the like. In these embodiments, the casing expands either through stored energy or by any other expansion system and a mechanism holds the casing in the expanded state.

The reduction in outer diameter allows the casing in the compressed state to pass through the inner diameter of an identical casing in the expanded state. Various mechanisms can be used to hold the assembly in a compressed state until the casing is lowered to the position where it will be installed. Non-limiting examples include: bonding edges, bonding surfaces, windings, sheathing, and combinations thereof. When the mechanism is released, the split pipe casing can expand elastically to or towards its original unloaded diameter. An example of a compression system is discussed below with reference to FIG. 26.

The tubulars or casings, described herein, can be made of any suitable material. Non-limiting examples include: metal alloys, non-metallics, composites, plastics, shape memory materials and any combinations thereof. It is preferred to use a material that has significant yield and elastic properties, such as carbon steel or resin-fiber composites.

In an embodiment, the sliding friction between layers is minimized by placing a lubricating material between the adjacent layers. The lubricating layer can include: wax, graphite, a low friction polymer or other lubricant that allows the layers to easily slide against each other during expansion and/or compression. In yet another embodiment, liquefied bonding materials may act as a lubricant between adjacent layers of the casing and may then bond the adjacent layers when cured.

The tubulars or casings, described herein, can be used as a single section (or joint) or in a casing string (or assemblage of casing joints). The tubulars or casings, described herein, can also be used as a separate string of tubing or casing or as any part of a drilling assembly (or assemblage of numerous types of specialized drilling tubulars and tools). The tubulars of the present invention can be used in conjunction with any conventional casing to form a lengthy pipe string. Alternatively, the tubulars or casings described herein can be used to stabilize only discrete problem areas of a well.

Examples of shape memory materials include nickel titanium alloys such as Nitinol. These materials may be thermally actuated, thus, they may be compressed and cooled below a transition temperature. The shape memory material will remain the compressed stated until heated above the transition temperature. When casing is property positioned, it is heated so that the compressed portion assumes the normal expanded state. Because such materials are currently very expensive, it may be more cost effective to use them only in the areas of that tubular structure that undergo high deformation while other less expensive materials are used in other areas.

The strength requirements of the inventive tubular application are dependent on the operating conditions and characteristics of a well. Accordingly, these strength requirements are not meant to be a limitation on the general invention. Rather, these strength requirements are preferences and are generally well above the physical properties of current expandables.

The casing preferably should meet several strength characteristics in order to meet demands expected in oilfield environments. The tubular preferably has a burst or collapse pressure rating comparable to or in excess of conventional and expandable API or ISO specified tubulars. The tubular also preferably has axial load strength ratings comparable to or in excess of conventional and expandable API or ISO tubulars.

The second set of requirements relates to changes in longitudinal length during expansion. It is preferred to limit a decrease in axial length to less than about 3%, more preferably to less than about 1%, and most preferably 0% (e.g., no change in axial length). In some applications, such as complying with geologic subsidence, it is ideal to also increase the axial length during radial expansion. For example, if a 30-foot section of compressed casing is put in the borehole, it is preferable that the segment be at least about 30 feet long after radial expansion is complete.

The following sections describe the governing physics and embodiments for the inventive expandable split pipe casing. In an embodiment, the split pipe must achieve an expanded outer diameter of four inches without external energy, such as internal pressure being applied. In order for the assembly to be deployed into a well bore, the compressed assembly must be able to fit through an expanded segment of the same design. Specifically, the compressed outer diameter of the casing must be smaller than the expanded inner diameter of the casing. A radial gap of at least 0.125 inches between the outer diameter of the casing in the compressed state and the inner diameter in the expanded state is desirable. This allows various fluids to be pumped through the annulus and reduces the chances of the casings becoming stuck during deployment. In an embodiment, the casings may be about 30 feet long.

In an embodiment, the compression and subsequent expansion of the split pipe is limited to deformation that is at least partly elastic. Such a design approach is a departure from a system that relies solely on plastic deformation for radial expansion. During expansion of the split pipe, the axial length of a segment of the pipe is not reduced, so a 30 foot long segment should remain 30 feet in length in both the compressed and expanded states. In addition to the dimensional requirements, the split pipe design also has physical strength requirements in order to be suitable for use in the oilfield environments. The split pipe must be able to withstand 6,000 psi of burst or collapse pressure without becoming damaged, plastically deforming or initiating a leak path. The design must be able to support an axial load of about 25,000 lbs plus the weight of a 3,000 foot long casing. A preferable ultimate axial design load goal of microhole tubulars is to support 100,000 lbs or more without failure.

If the adhesive between the layers is not set, each layer of the casing must be able to take the design axial load. If each layer has the same thickness, then the inner layer would have the smallest cross sectional area and the lowest load-carrying capability. An outer diameter is typically a known design characteristic of the tubular that is defined by the borehole diameter. By setting the outer diameter corresponding to the borehole size, $D_{outer}$, the required area can be determined based upon the axial design strength. With the area solved, the inner diameter and wall thickness can be solved based upon the formula, $\text{Area}=\pi/4\ (D_{outer}^2-D_{inner}^2)$. The required pipe weight plus 25,000 lbs must be less than the yield strength multiplied by the cross sectional area of the tubular multiplied by a safety factor. Because a relatively thin wall thickness can support the required axial loads, many geometries and material options can provide the required strength.

In its most basic form, a split pipe expandable casing can be conceptualized as a series of concentric cylindrical metal bodies with circumferential gaps. In some embodiments, a mechanical bond between the metal bodies is required. Various split tube geometries and configurations can be used as expandable split pipe casings.

Figure 33:
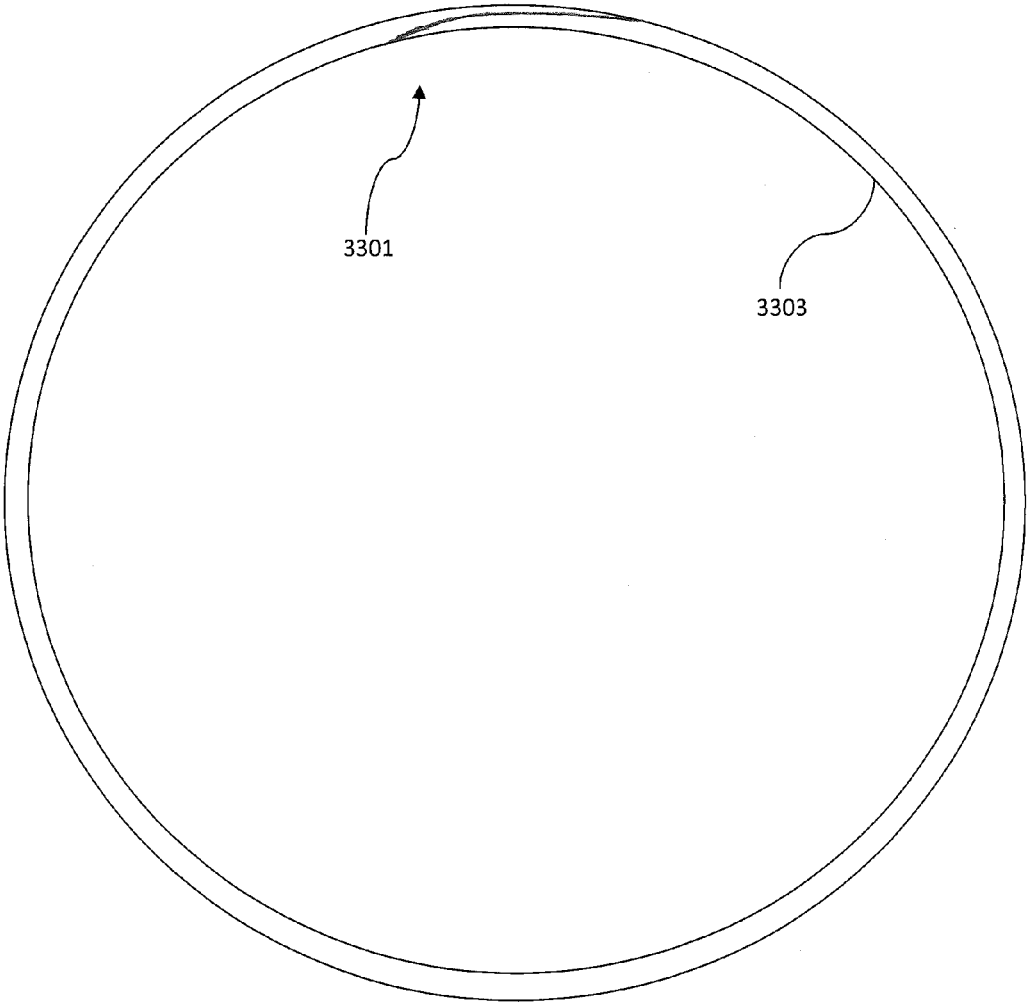
FIG. 33 is a cross section view of a one leaf and a one layer embodiment of the expandable tubular having a variable thickness in the expanded state.

The following provides specific configurations of the split pipe casing. Each configuration described below can be used independently or in combination. For example, a composite split pipe casing can include an inner portion and an outer portion. When more than one layer is utilized, each layer can have the same thickness or a different thickness per layer and each layer can be made of the same material or different materials. Furthermore, each layer can have a thickness that varies. Varying thicknesses in a particular layer may be utilized to obtain desired properties, e.g., enhance expansion rates or enhance strain-energy. For example, with reference to FIG. 33, an embodiment of an expandable tubular 3301 is shown having a single layer 3303, in which the single layer 3303 has a variable thickness. Particularly, as shown, the expandable tubular 3301 may have a variable thickness such that the thickness of the single layer 3303 at an end thereof is smaller in thickness as compared to the thickness of the single layer 3303 at other areas, such as the thickness in the center of the single layer 3303.

The split pipe concept embodies a series of concentric thin-walled pipes with a circumferential gap cut along the length of each member. Applied moments are used to change the outer diameter of the assembly by reducing the gap of each layer. This reduction in diameter allows a casing in the compressed state to pass through the inner diameter of an identical casing in the expanded state. A mechanism is used to hold the assembly in a compressed state until the casing is lowered to the position where it will be installed. When the mechanism is released, the split pipe expands elastically to its original unloaded diameter.

Figure 2:
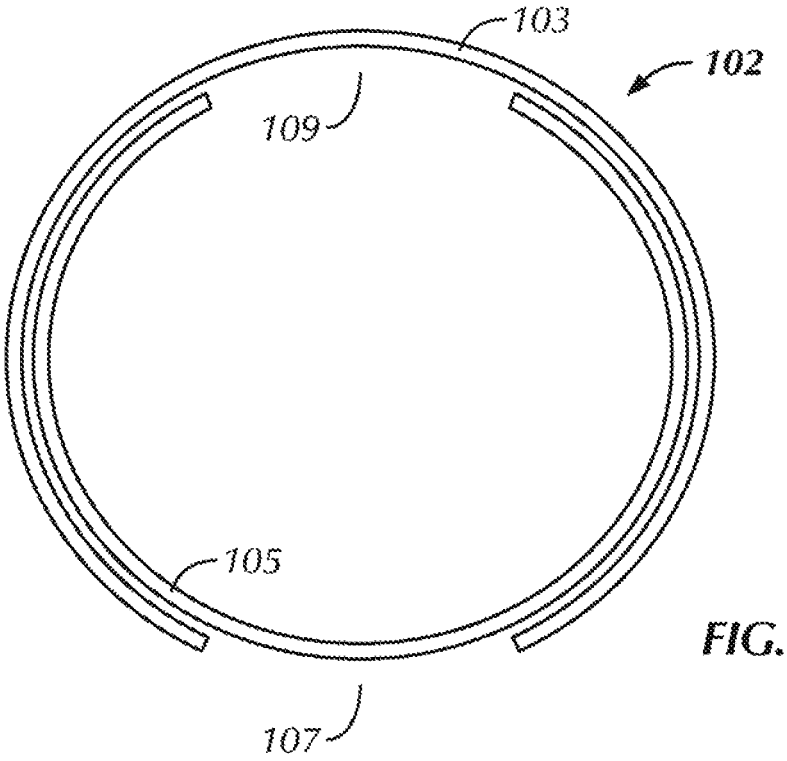
FIG. 2 is a cross section view of a two leaf and two layer embodiment of the expandable tubular in the expanded state.

FIG. 1 shows a simple representation of the cross section of the split pipe 101 in the compressed state and FIG. 2 shows the split pipe tubular 102 in the expanded state. The concept requires at least two layers, an outer layer 103 and an inner layer 105 to create full isolation between the production annulus and the oilfield formation. As the bore hole is formed, the casings 101 are installed in the bore holes starting generally at the upper portion. As the bore hole is deepened, additional casings 101 are inserted through the inner diameters of the expanded casings 102 and after being properly positioned, the casing 101 is expanded. In the preferred embodiment, the expanded casing 102 expands to contact the bore hole. As discussed, a restraining mechanism may be released so that the casing can expand. In an embodiment, the adjacent casings are coupled together and form a seal.

The split pipe design takes into consideration the manufacturing, compression, and subsequent deployment of the casing. Structural analysis of the designs in both compressed and expanded states is required as described above. With reference to FIGS. 1 and 2, in an embodiment, the split pipe casing 101 includes at least two concentrically curved layers, outer layer 103 and inner layer 105. The outer layer 103 has a split section 107 and the inner layer 105 has a similar split section 109. The outer layer 103 and the inner layer 105 are configured with the split sections 107, 109 positioned on opposite sides of the tubular, so they do not overlap. The size of the split sections 107, 109 can vary substantially between the compressed and expanded states.

Figure 3:
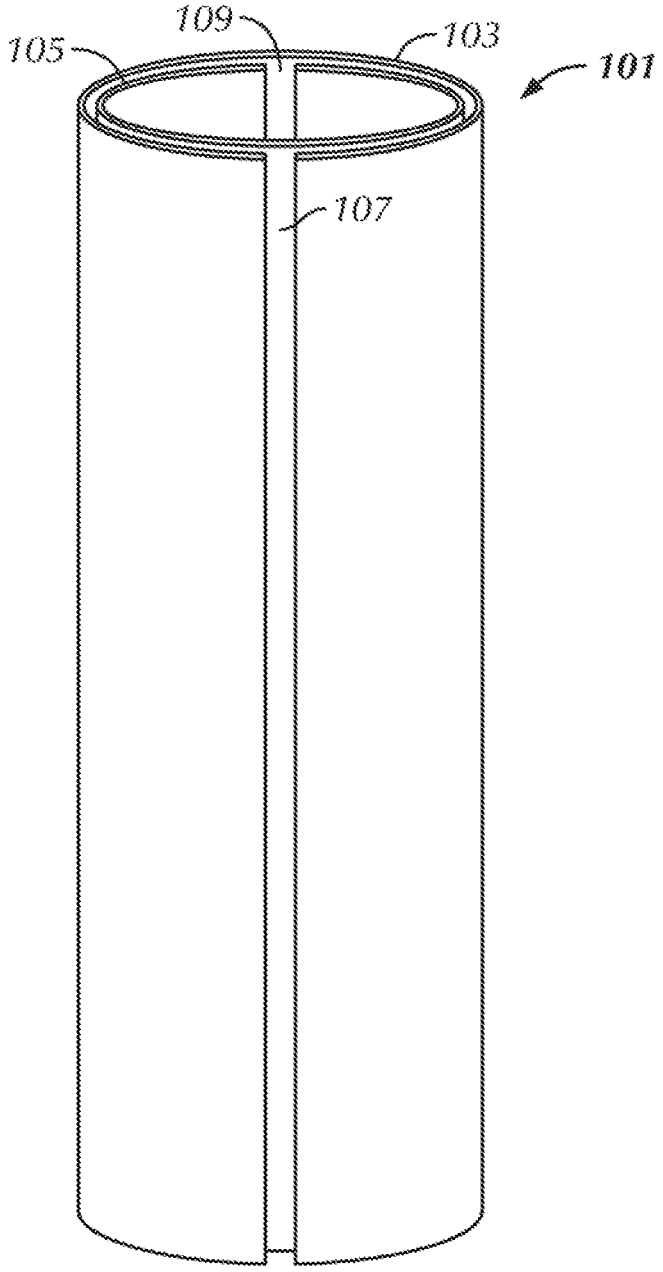
FIG. 3 is a side view of the two leaf and two layer embodiment of the expandable tubular in the compressed state.

FIG. 3 illustrates the entire two layered split pipe casing 101 in the compressed state. The split section 107 runs down the entire length of the outer layer 103 of the casing 101 and the split section 109 runs down the length of the inner diameter of the casing 101. The length of the casing 101 can be any length, however in the preferred embodiment, the length of the casings 101 can be about 30 feet in length. The ends of the casings 101 can be coupled together with couplings (not shown) that are attached to the ends of the casings 101. It is preferable to orient the split sections 107, 109 away from each other, as illustrated in FIGS. 1-3, in order to provide the highest amount of joinable surface area as well as to provide the longest potential leak path. This long leak path reduces the risk of leakage during use. In an embodiment, an adhesive or other bonding method is used to permanently join the two layers only after expansion. The edges of the inner layer 105 and the outer layer 103 that define thee split sections 107, 109 can be rounded or tapered to reduce the step change between the layers which will mitigate potential issues of local stress. Because the sections of the split pipe where the expanded split sections 107, 109 are located are only supported, by a single layer, each layer must be designed with a sufficient material strength and thickness to withstand the burst and collapse loading applied to the casing.

Figure 4:
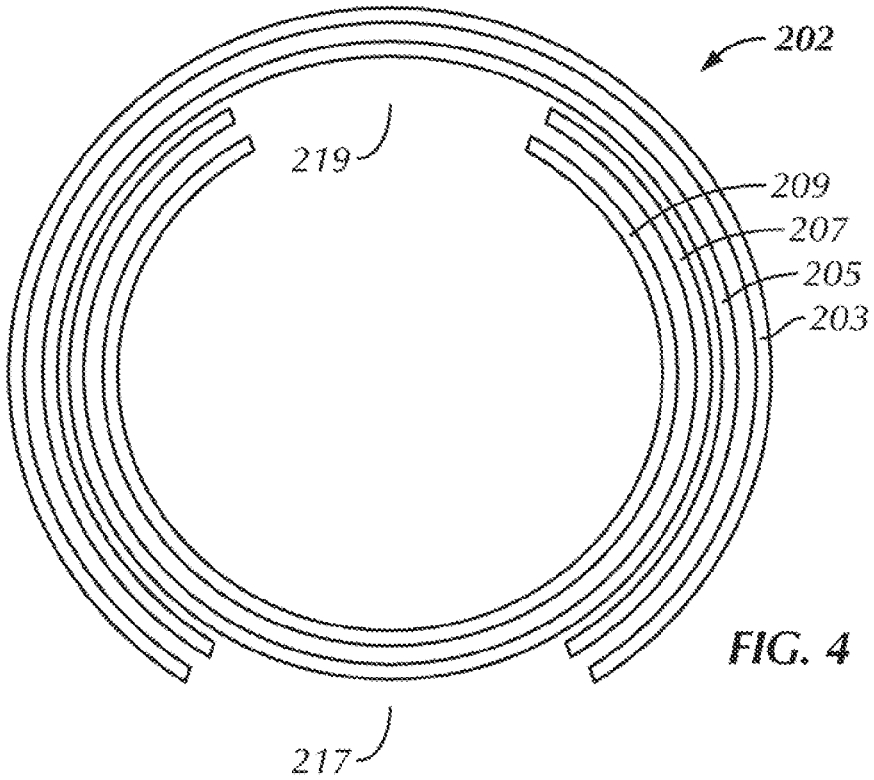
FIG. 4 is a cross section view of a four leaf and four layer embodiment of the expandable tubular.

In another embodiment, the split pipe casing includes more than two layers of material. It is believed that such a configuration can increase the wall thickness at critical regions during any applied stress. One possible configuration is a four-layer design illustrated in FIG. 4. In this embodiment, the four-layer split pipe design 202 has the following physical characteristics: material yield stress 100 ksi, outermost layer 203 thickness=0.065 inch, middle outer layer 205 thickness=0.060 inch, middle inner layer 207 thickness=0.052 inch and inner layer 209 thickness=0.052 inch. In an embodiment, the axial force limitation is 51,000 lbs and the bust pressure limitation is 6,250 psi. Because the thinnest sections of the casing are two layers thick, the strength of each layer must be one-half the total design burst and collapse pressure. The split pipe casing is not limited to four layers. However, increasing the number of layers can reduce the allowable compressed outer diameter of the split pipe of a given thickness. In order for the outermost layer to undergo its necessary expansion, a reduced wall thickness can be employed.

Figure 5:
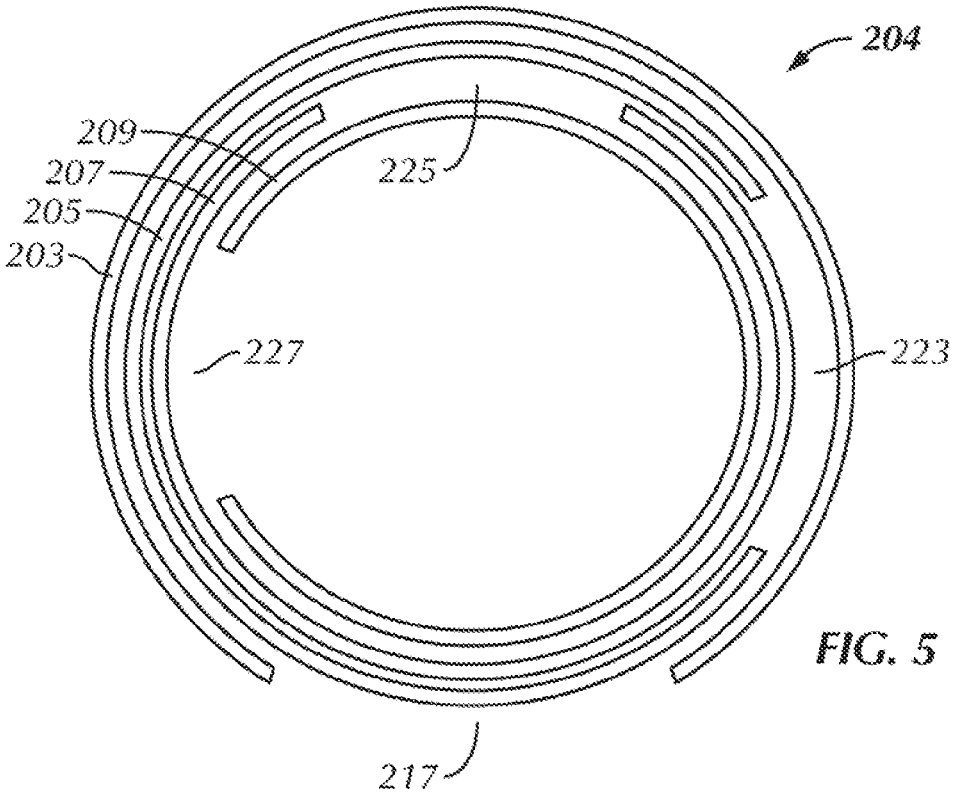
FIG. 5 is a cross section view of a four leaf and four layer embodiment of the expandable tubular.

Although the split pipe casing is illustrated with the split sections 217 of the outer most layer 203 and the middle outer layer 205 aligned and the split sections 219 of the middle inner layer 207 and the inner layer 209 aligned, it may be preferable to have all gaps out of alignment with each other to minimize any thin wall sections of the casing. An alternative embodiment of a four-layer split pipe casing 204 is illustrated in FIG. 5. In this design, each split section is oriented 90 degrees from the split section in the adjacent layer or layers. Like FIG. 4, the casing has an outer layer 203, a middle outer layer 205, a middle inner layer 207 and an inner layer 209. The split section 221 of the outer layer 203 is at the bottom of the casing 204. The split section 223 in the middle outer layer is on the right side of the casing 204, the split section 225 in the middle inner layer is at the top and the split section 227 in the inner layer 209 is on the left side of casing 204. With this offset split section design, all areas of the casing are reinforced with at least three layers. Thus, the design strength of each layer can be one-third of the total design burst and collapse loading applied to the casing. In an embodiment, an adhesive or other bonding method is used to permanently join the adjacent layers after expansion. The adhesive may also fill in the gaps in each of the layers reducing the risk of leaks in this region of the casing.

Figure 6:
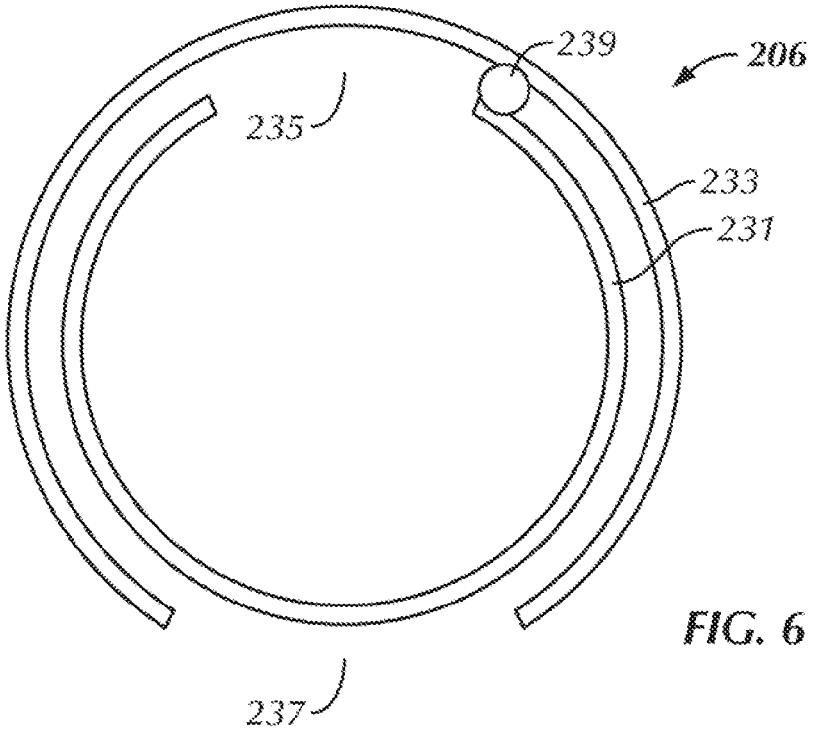
FIG. 6 is a cross section view of a two leaf and two layer embodiment of the expandable tubular in the expanded state with the layers coupled.

In other embodiments of the inventive casing, the layers are coupled together to prevent relative rotation between the layers. With reference to FIG. 6, a portion of the inner layer 231 can be fixedly attached to an adjacent outer layer 233 at an attachment point 239. The attachment point 239 can be a plurality of connection points or a single elongated seam that runs the length of the casing 206. The attachment point 239 maintains the separation of the split section 235 in the inner layer 231 from the split section 237 in the outer layer 233 throughout the movement of the casing 206 from the compressed state to the expanded state. In this embodiment, one edge of an inner layer 231 is attached to the inner surface of the outer layer 233 to maintain a separation of the split sections 235, 237. The attachment 239 can be a weld, a mechanical fastener, an adhesive, solder, braze elastic element or any other coupling structure can be used. It is preferred to form the attachment 239 at a single point around the circumference between the adjacent layers so that each layer of the casing 206 is movable between compressed and expanded positions. Although some of the figures show a space between the layers, it is preferred not to have a space between the layers and it is preferred to have the inner layer 231 flush against the outer layer 233. This configuration ensures that the gaps 231 will always be opposite to each other from the compressed state to the expanded state.

Figure 7:
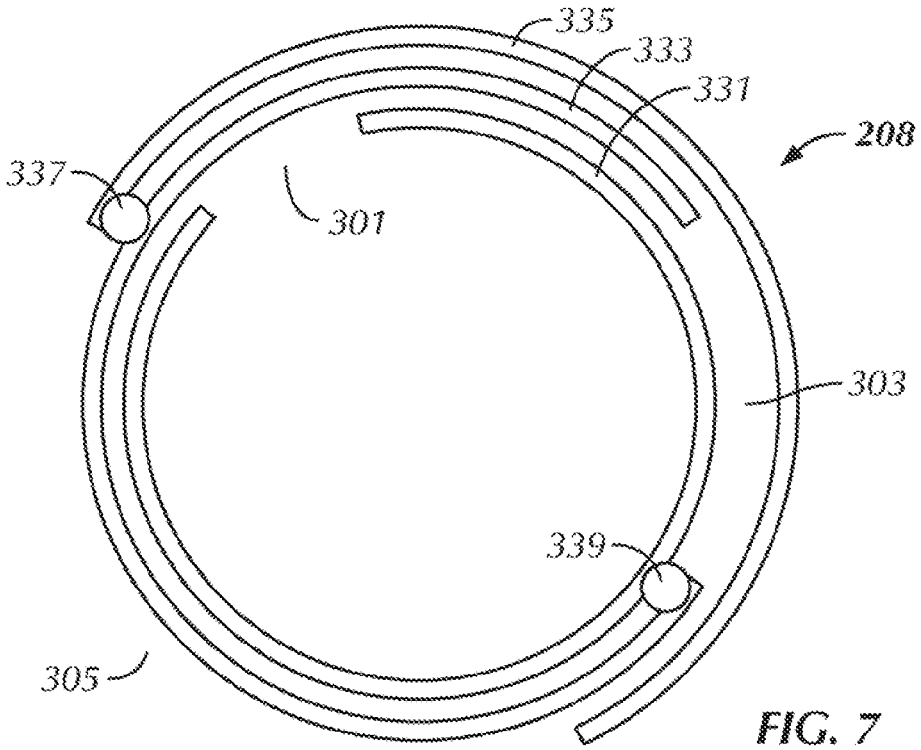
FIG. 7 is a cross section view of a three leaf and three layer embodiment of the expandable tubular in the expanded state with the layers coupled.
Figure 8:
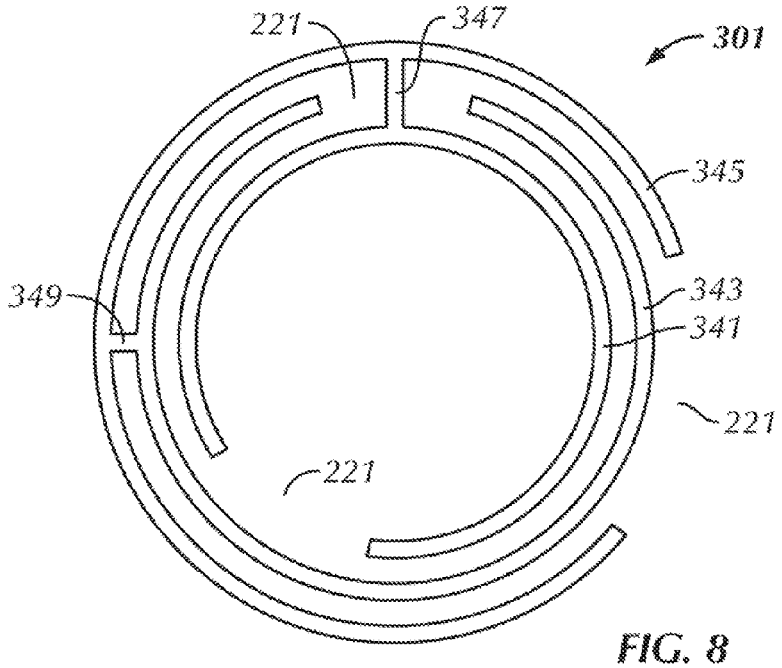
FIG. 8 is a cross section view of a three leaf and three layer embodiment of the expandable tubular in the expanded state with the layers coupled.

In another embodiment, a split pipe casing can have an odd number of layers (e.g., a three layered split pipe), as illustrated in FIGS. 7 and 8. In the embodiment illustrated in FIG. 7, the casing 208 has an outer surface of the inner layer 331 that is fixedly attached at a first attachment point 339 to an inner circumferential edge of the middle layer 333. The outer layer 335 is fixedly attached at a second attachment point 337 to an outer surface of the middle layer 333. The layers 331, 333, 335 are fixedly attached so that the orientations of the split sections 301, 303, 305 do not overlap each other. Potential leak paths are eliminated in this manner.

It is preferable to have split sections that are similar in angular size or width so that the number of layers forming the wall thickness is uniform throughout the circumference of the casing. This uniformity of layers helps to keep the wall strength of the casing uniform around the casing circumference. Although it is preferable to have leaves that are similar in width, it is also possible to have leaves that are not uniform in width. With reference to FIG. 7, the casing 208 includes a split section 301 in the inner layer 331 that is smaller than the split section 303 in the middle layer 333. The split section 305 in the outer layer 335 is substantially larger than the other split sections 301, 303. Although, the split section 305 is fairly large, there are no overlaps in any of the split sections 301, 303, 305. Thus, all sections of the casing have at least two layers.

Although it is preferable to have adjacent layers coupled to each other it is not necessary. In the embodiment illustrated in FIG. 8, the inner layer 341 and the middle layer 343 are coupled to the outer layer 345 but the inner layer 341 and the middle layer 343 are not directly coupled. The inner layer 341 fixedly attached at a first connection 347 to the inner surface of the outer layer 345. The outer surface of the inner most layer 341 is fixedly attached at a second connection 349 so that its split section 221 is opposite the split section 221 of the middle layer 343 in the expanded position. The outer surface of the middle layer 343 is fixedly attached so that its gap 221 is opposite the split section 221 of the outer layer 345 in the expanded position. Because the inner layer 341 is connected to the outer layer 345, the connection 347 passes through the split section 221 in the middle layer 343 and may be an elongated fastener.

Alternatively, the split pipe can have an even number of layers that are not coupled to the adjacent layers. For example, in a split pipe system, a four layered split pipe may be configured with the first inside layer connected to the third layer, and the second layer connected to the fourth outer layer and the first layer connected to the fourth layer. Again, the connections between the layers may pass through the split sections in the layers. Because of this extended length, the connection may be elongated connection members rather than direct connections such as welds.

Figure 9:
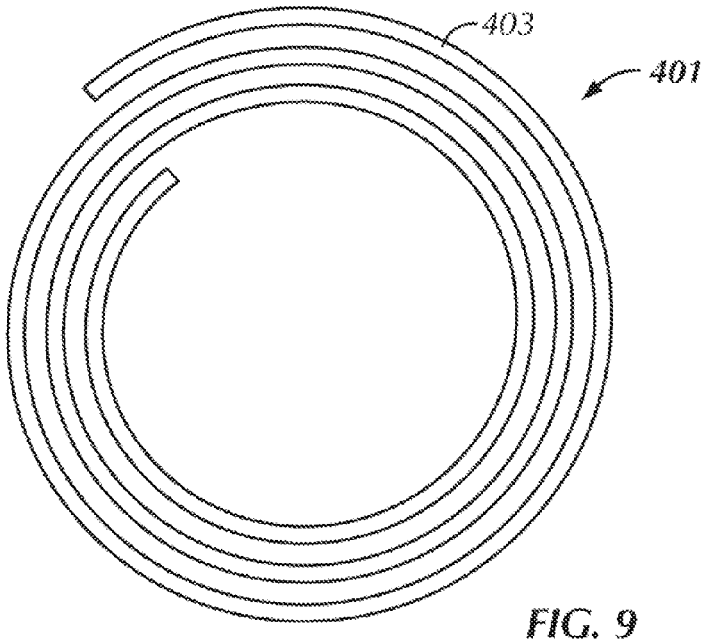
FIG. 9 is a cross section view of a single leaf embodiment having four layers.
Figure 10:
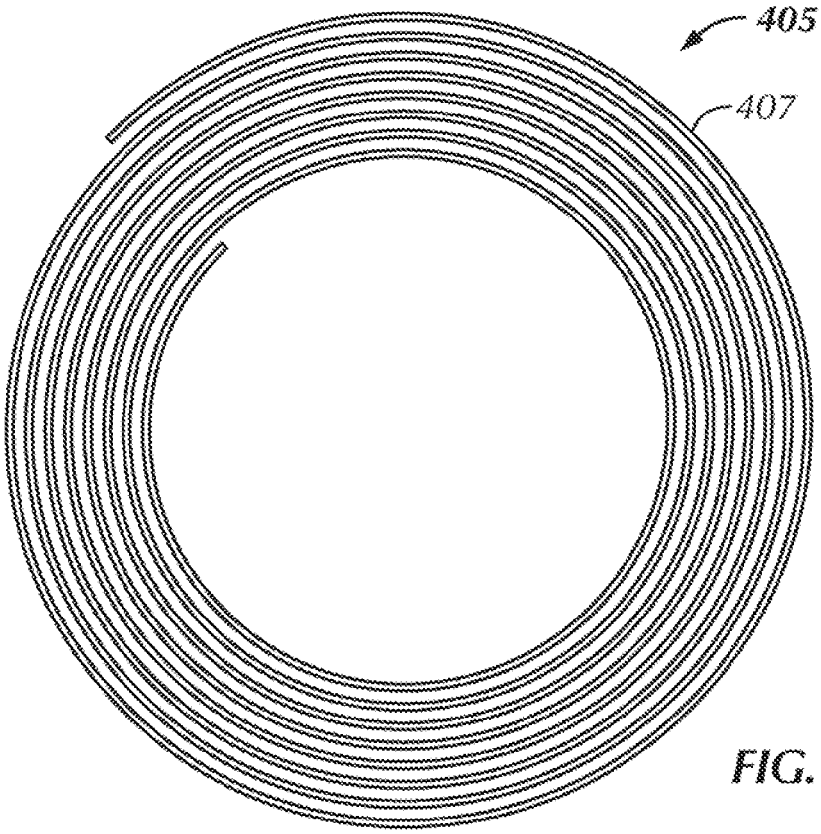
FIG. 10 is a cross section view of a single leaf embodiment having five layers.

In another embodiment with reference to FIGS. 9 and 10, the inventive casing includes a single continuous sheet 403 of material wrapped to provide a cross section similar to a clock spring or constant spring. In order to provide the required strength, the casing should be made of a flexible high strength material and have the required wall thickness. This is accomplished by providing either many layers of a thin material or fewer layers of a thicker material. The cross section of the casing 401 can also consist of three layers of a thick material 403 as shown in FIG. 9. In contrast, the casing 405 has eight layers of a thinner material 407 as shown in FIG. 10. The thickness of the material can be constant throughout the cross section as shown in FIGS. 9 and 10 or it can be varied. For example, the material can be thinner towards the inside of the cross section to allow easier bending of the portion in the compressed state. Alternatively, the material can be thicker toward the center of the cross section.

The wrap configurations shown in FIGS. 9 and 10 have the advantages of lower bond strength requirements, a longer leak path and fewer manufacturing steps. Since the thickness of each layer is relatively small, the edges at the innermost and outermost layers will not produce a large notch where the wrap ends Such a uniform radius is more optimal for setting packers, for example. Additionally, stress concentrations are mitigated for this design because of the slight notch and the distribution of stresses over many structural layers.

Figure 11:
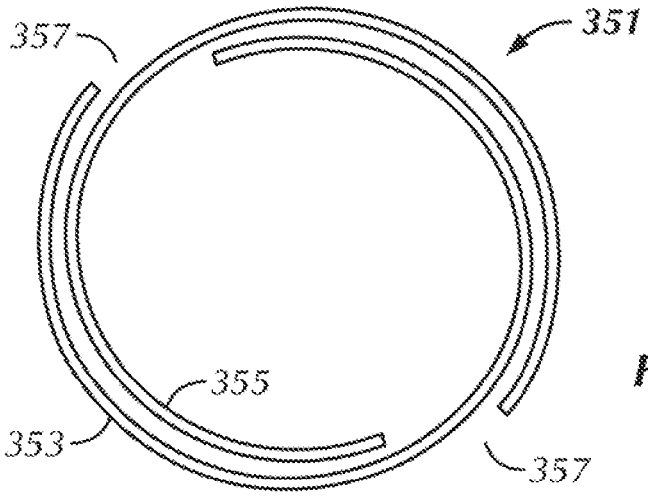
FIG. 11 is a cross section view of a two leaf embodiment in an interleaved configuration in the compressed state.
Figure 12:
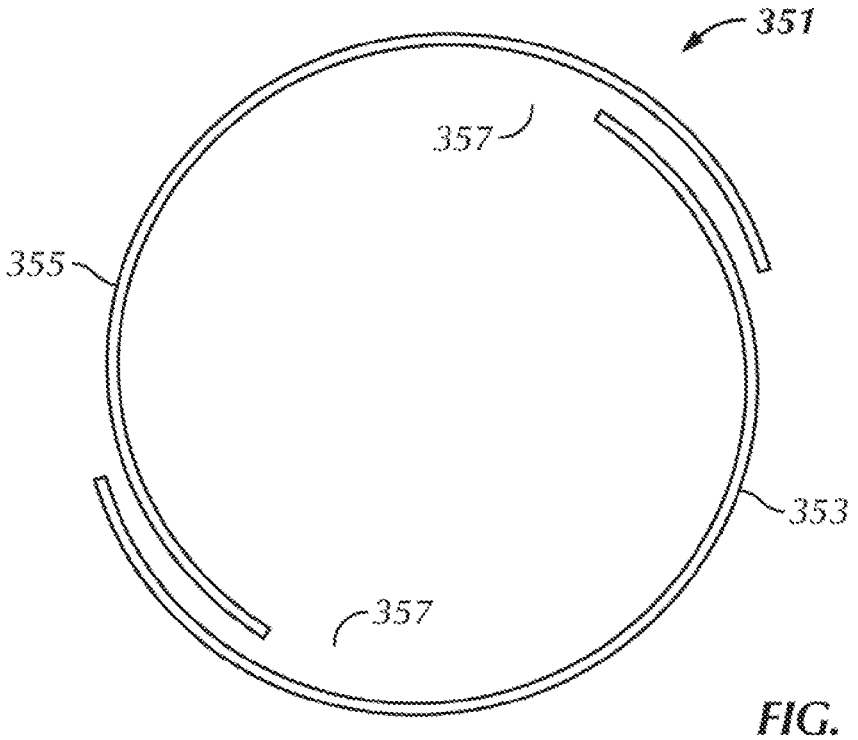
FIG. 12 is a cross section view of a two leaf embodiment in an interleaved configuration in the expanded state.

In another embodiment, the split pipe casing includes at least two interleaving curved layers with circumferential openings. The interleaved configuration uses multiple leaves to form a spiral pattern with each leaf passing through the split sections of the other leaves. With reference to FIGS. 11 and 12, an interleaved casing 341 having two leaves 353, 355 is shown in the compressed and expanded states respectively. Each of the leaves 353, 355 of material has two circumferential edges and a split section 357. In the interleaved configuration, the adjacent layers 353, 355 pass between the split section 357. In the compressed state, the distance between the split sections 357 are narrow and in the expanded state the split sections 357 are much wider. In this embodiment, the multiple leaves 353, 355 can be identical and arranged symmetrically around the casing 351 diameter. It is preferable to orient the gaps 221 positioned away from each other, in order to provide the highest amount of joinable surface area as well as to provide the longest potential leak path. Interleaving the leaves 353, 355 more evenly transfers loads throughout the casing 351.

The interleaved pipe can have two or more layers. The two layered interleave pipe can include one edge of an inner layer that is fixedly attached to the inner surface of the outer layer to maintain relative orientation to each other between the compressed state to the expanded state. The attachment can be a weld, a mechanical fastener, an adhesive, solder, braze, elastic element or any other form or any other attachment mechanism can be used. It is preferred to form the attachment so that at least one circumferential edge in each layer is movable between a compressed position and an expanded position. Manufacturing considerations are also improved in the embodiment since each of the leaf members 303, 305 are identical and only one size is required.

If the two rings 303, 305 in FIGS. 11 and 12 are to be assembled, for securing operations or assembly with other layers, then some deformation with residual stress formation will be necessary. The surfaces of one leaf 353 matches the surfaces of another leaf 355. With additional leaf layers this mismatch leads to the need for sequential fixturing of the assemblies for securing operations or insertion into outer leaves during manufacturing.

To use this interlocking concept in precisely fitting assemblies, the individual layers are preferably spiral in form. Conceptually, the simplest way to achieve this spiral matching is to use the equation, $R=R_0(1-k\theta)$ where $R_o$=outer radius, R=radius at angular position $\theta$ and k is a positive constant.

The pitch or slope of the leaves for interleaved casings is the proportional to the number of leaves and the diameter of the casing. For a single leaf casing, each rotational layer rests upon itself, so the pitch is equal to the thickness of the leaf layer. As the layer expands spirally outward the radius of each layer increases by the thickness of one layer per rotation. In contrast, if two layers are used in the interleaved casing, the pitch of the spiral is doubled the thickness of the leaves to accommodate the space required for two leaves as shown in FIG. 11. The two leaves are identical and both turn through 315 degrees. If we wish to increase the wall thickness then two strategies are possible. The first is to keep the same number of leaves and simply increase their angular span. The second option is to increase the number of leaves which will also increase the pitch of the leaves. As more leaves are added, the change in radius of each layer will also increase.

Figure 14:
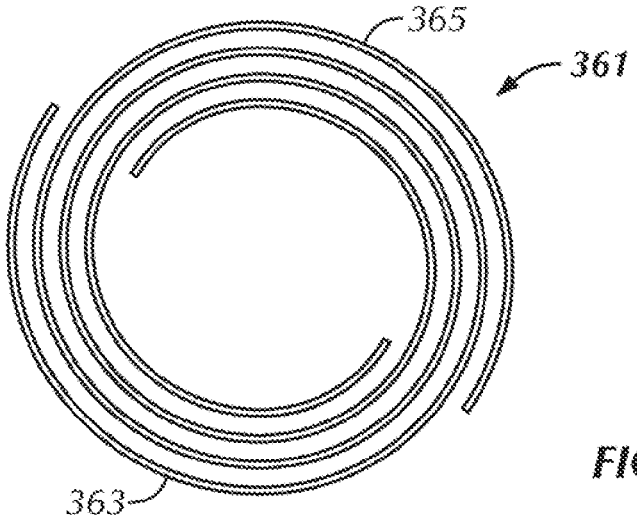
FIG. 14 is a cross section view of a two leaf embodiment forming four layers.
Figure 13:
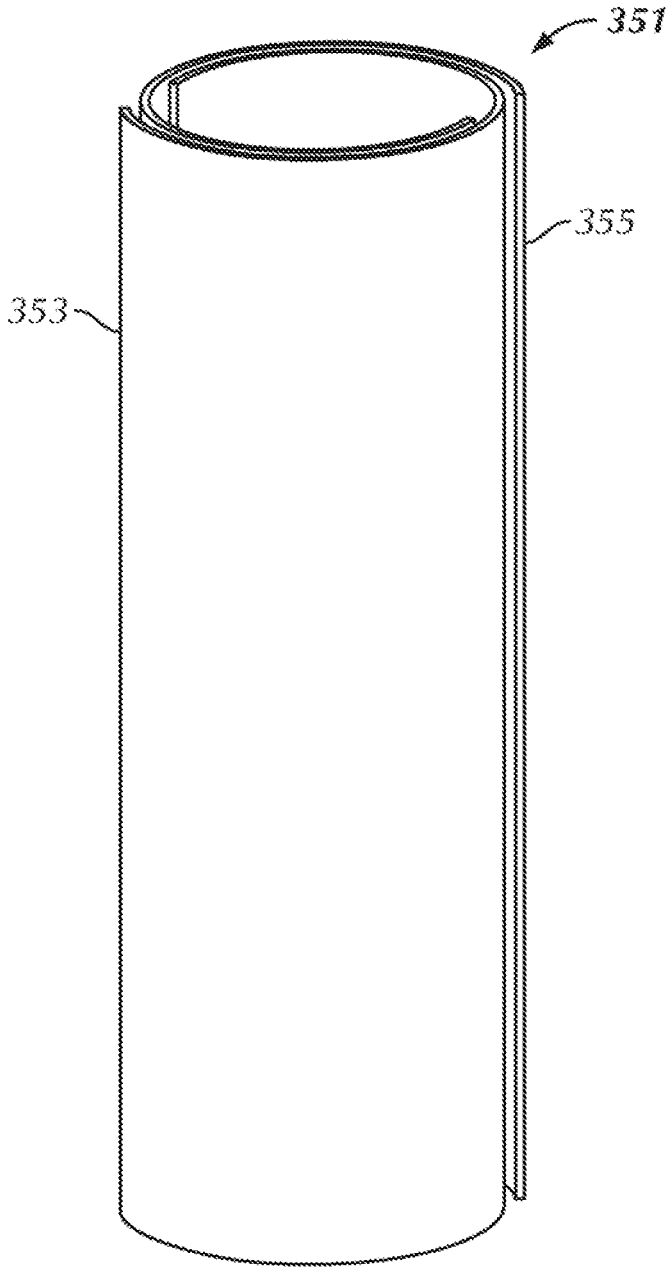
FIG. 13 is a side view of the two leaf embodiment in an interleaved configuration in the compressed state.

Although the leaves 303, 305 shown in FIGS. 11 and 12 each form a single layer so that the wall thickness is one or two layers thick, it is also possible to have expanded leaves that extend further around the diameter to further increase the wall thickness. With reference to FIG. 14 a similar interleaved casing assembly 361 is shown with two leaves 363, 365 with the angular span increased to 720 degrees. Both leaves 363, 365 spiral outward in a clockwise direction and complete two rotations. The two spiral leaves 363, 365 start and end at opposite sides of the casing. As illustrated, the leaf 363 starts at the upper left side of the inner surface and ends at the upper left side of the outer surface, while the leaf 365 starts at the lower right inner surface and ends at the lower right outer surface.

Figure 15:
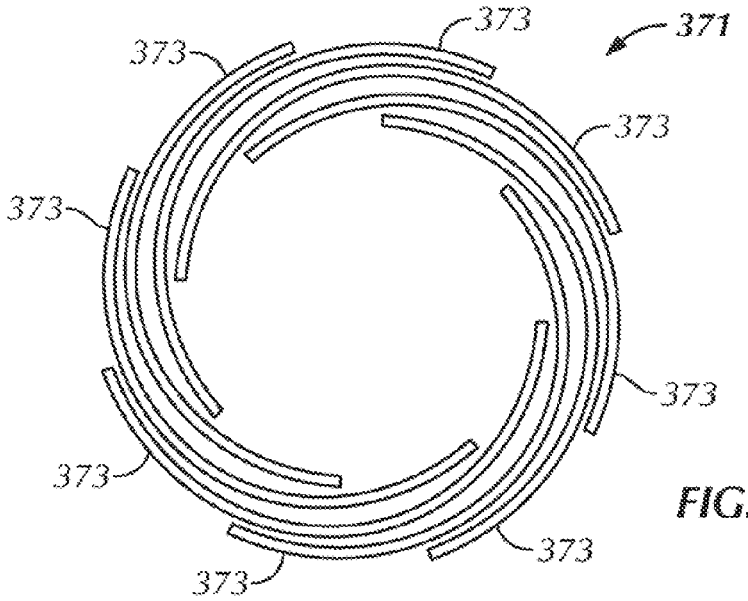
FIG. 15 is a cross section view of an eight leaf embodiment in an interleaved configuration.

Another method for increasing the wall thickness is to fix the angular span of the spiral elements and design the layout to accommodate an increased number of mating leaves. FIG. 15 shows a casing 371 that has a layout of 8 spiral leaves 373. Each leaf 373 spans about 180 degrees and overlaps the adjacent leaf by 45 degrees. Casings that have multiple identical leaves have the benefit of being simple to manufacture. Because the leaves are identical, they can be made from continuous strip by axial rolling between spiral profiles. The leaves are contoured to give the required spiral shape after spring back from roll-forming and are cut to the required length. In this process, other required axial features such as grooves or thinner sections for detents or seals can be produced through incorporation of appropriate features on the roll surfaces.

If the thickness of the layers is constant value t, then for n leaves equi-spaced we require the spiral to move radially inwards by amount t in 360/n degrees of revolution. Equivalently the pitch of the layout spiral should be nt per revolution. Changed to appropriate radian measure, constant k in Eq.(1) should be set to $k=nt/(2\pi)$.

In an embodiment, an 8-leaf design with outer diameter 4.5 inches and eight 1/16-inch thick leaves has an outer shell and locking concept. During radial compression of the assembly, the inner portions of the leaves will be subjected to higher strain values than the outer portions, by virtue of the fact that the radius of curvature of the leaves decreases from the outside to the inside. Thus, the inner sections of the leaves would reach yield while the outer portions retain the ability for further elastic straining.

In order to increase the total radial compression amount it is therefore necessary to decrease the thickness of the leaves progressively from outside to inside. This could be achieved by forming the spirals from tapered strip, which simply decreases the thickness linearly from one edge to the other. However, this would have the disadvantage of producing spiral forms which no longer mate and seal perfectly. The alternative is to adopt the more elegant approach of designing the leaves along spiral forms. The Leaves of the spirals converge closer together as they curve inwards towards the center.

In an embodiment, a single spiral leaf with initial thickness of 0.1" may rotate through two revolutions. This has a geometrically fixed shape that changes only in scale with expansion. For example, the first revolution is identical to the second revolution but is simply scaled in the ratio of 5.9 to 6. The equation defining the spiral is $R=R_0e^{-k\theta}$, where k is a positive constant for an inward curving spiral, and θ is the polar angle, the angular position around the spiral. The leaf thickness at any point can be obtained by taking the difference of the radii values from angular positions on each side of the required thickness. For the spiral, the value of k is 0.002674. This can readily be obtained from the equation for the required thickness at position zero. Namely, substituting $R_0=6$, and taking the difference in radii at angles 0 and 2π to be 0.1 inches gives the required k value. The final leaf thickness can then be obtained in this case to be (0.097) inches.

In the case where 8 leaves of spirals form the tubular, each spiral with initial thickness of 0.1" must move inwards by 0.1 inches over a 45 degree arc from its beginning in order to accommodate the adjacent leaf. The equation to be solved for k in this case is $0.1=6\ (1-e^{-(\pi/4)k})$ which gives k equal to 0.0214. Note that this single number and the outer radius defines the entire layout. The inner thickness of the leaves in this case is given by $6\ (e^{-k\pi}-e^{-k(\pi+\pi/4)})=0.0935$ inches.

A precision assembled interleave design can be obtained by following appropriate families of spiral casings. The appropriate analytical design parameters can readily be obtained from the outer diameter, the required number of leaves, and the required leaf thickness (outer leaf thickness for the spiral). For a spiral layout, the leaf taper varies with number of leaves in the assembly and with the outer leaf thickness. This offers the potential of determining configurations which may give only small variations in bending stresses during radial compression of the assembly. The leaves of the casing can be manufactured by sequential axial rolling operations with high efficiency. The thickness of the leaves can be reduced during the rolling passes to give uniform reduction or desired taper, and so provide a beneficial large amount of work hardening.

The leaves of the inventive casing do not need to be symmetrical in angular length around the casing. In an embodiment, there are short length leaf sections of the structure and other leaf sections that are much longer and nearly surround the tubular structure. Because the short leaf sections only occupy a small portion of the tubular, they maybe attached to the longer leaf sections with a bonding method such as an adhesive or a spot weld. The welds prevent relative movement between the leaf sections. Another means for preventing relative movement is through features formed in the leaves such as indentation or depressions that allow adjacent leaves to engage each other.

In an embodiment, the casing consists of 12 spiral shaped leaves, fabricated from 1035 Steel with 0.029" thickness, which are arranged in a spiral geometry. Each leaf spans a total angle of 180 degrees in the relaxed state (4.300 inches) which corresponds to an arc length of 6.443 inches on the outside surface. The prototype is shown in the expanded state with an outside diameter of 4.3 inches and a total wall thickness of 0.203 inches which corresponds to seven leaves. The casing will be able to collapse to an outside diameter of 3.210 inches. During the expansion from the collapsed state there will be about three inches of relative motion between the two leaves forming the free sliding plane. The working diameter of an expanded casing is 4.0 inches −4.25 inches resulting in an inner diameter of 3.510 inches −3.760 inches. These dimensions include an elastomer sleeve around the outside of the casing for sealing purposes of approximately 0.025 inch thickness. The physical dimensions are summarized in Table 1.

TABLE 1

| Casing Assembly | Dimensions |
|---|---|
| Leaf Thickness | 0.029 inch |
| Elastomer Thickness | 0.025 inch |
| Outer Diameter Expanded State | 3.950 inches |
| Inner Diameter Expanded State | 3.510 inches |
| Wall Thickness Expanded state | 0.174 inch |
| Outer Diameter Compressed State | 3.210 inches |
| Inner Diameter Compressed State | 2.467 inches |

In other embodiments, the inventive tubular can have a much larger diameter. In an embodiment, the inventive expandable casing is a spiral tubular configured as a ten-leaf casing characterized by an outer diameter of 10.50" and minimum inner diameter of 9.0325" in its stress-free as manufactured condition. An effective outer diameter of 10.27" and the effective inner diameter of 9.27" yield an effective structural thickness of 0.50" for the casing. The casing can be manufactured from 4140 steel. The physical dimensions for an embodiment of a larger tubular are summarized in Table 2.

TABLE 2

| Casing Feature | Characteristic |
|---|---|
| Diameter | 9.625 inch nominal |
| Length | 30 ft typical |
| Number Of Leaf Elements Per Assembly | 10 each |
| Element Weight | 188 lbs nominal |
| Alloy | 4140 or 4130 Cold-rolled steel (CRS) |
| Thickness | 0.130 inch |
| Properties | 100 to 120 ksi |
| Surface Condition | Custom Textured, as received, as rolled |

In an embodiment, the manufacturing process scheme is as follows: casing Elements are formed from coil CRS, precision roll formed to asymmetric shapes and cut to length; casing assembly is made by laser seam welding elements into a tubular structure. Induction heating systems are integrated for pre and post heat treatment if necessary. Preheating of weld spots can reduce thermal stress, minimize weld hardening, reduce porosity, reduce hydrogen cracking and improve the microstructure. Post heat treatment can similarly relax thermal stresses that may result in cracked welds. The casing assembly is compressed and secured to maintain the compressed condition. Safety bands are also installed to provide additional protection during storage and transport of the casing. The end connectors are added by welding.

It is important to note in this section that 4130 is a suitable and recommended material alternative as long as the require yield strengths can be achieved. The lower carbon 4130 will be significantly less susceptible to cracking thus reducing the current risk associated with welding 4140. The manufacturing cost is unaffected by this change with the potential of higher welding speeds possible with reduced or eliminated pre heating requirements.

In the preferred embodiment, the leaf elements used in the assembly are fabricated using traditional roll-forming technology. Forming parts from coil fed raw materials is useful for making similarly shaped parts in high volume. The process typically achieves high throughput predictable conversion cost.

The surface condition of the leaf elements can vary depending upon the application. A significant effort may be required to determine the proper combination of texturing methods for the rolling mill producer or in-house roll forming operation for a given required geometry. However, if the surface condition can be integral to roll forming, this is likely the least expensive method of achieving a particular surface texture or finish. In an embodiment, the leaf parts are formed from material that has been rolled through textured mill rolls to form surface features on the leaf parts. The surface finish can also be controlled with additional secondary surface processing which results in mechanical texturing such as: embossing, plating, lamination, etching, laser machining, and other surface finishing options. Thus, the stamped leaf pieces can be delivered in a range of potential surface textures.

The leaf parts are cleaned prior to assembly operations. The process for assembling the inventive casings can include soldering, brazing, welding or any other type of industrial strength fastening mechanisms.

It is important to use a joining alloy with no zinc if the solder or braze could come in contact with salts resulting in galvanic corrosion. The leaves would preferably be pre-coated with braze filler or solder during manufacture and prior to assembly. Suitable solders resist corrosion and help to form leak-tight joints. Solders commonly have tunable liquidus temperatures and are generally less than 700 degrees F. Voids would be created in the solder that would weaken the bond.

In other embodiments, the layers of the casing are fastened together by brazing. Since, solder is a soft metal, a solder joint is not as strong as brazed joint. Ideally, the distance between layers are such the brazing material does not have to fill a large space between layers. The brazing performed with a brazing torch or furnace, flux, and a brazing alloy. In an embodiment, Black Flux (Silver Brazing Flux) is used which is a water base paste consisting of potassium salts of boron and fluorine. It is recommended for use with torch, induction, furnace, resistance, and other heating methods. A suitable brazing alloy is Silvaloy B72NV Brazing Alloy: Composition is 50-80% (by weight) silver, 10-50% copper and 0.5-8.0% nickel. It comes in the form of metallic wire, rod or strip.

In yet another embodiment, the layers can be welded together. Laser welding processing has the benefits of being robust, high-speed, and adapted to an axial weld seamer. Weld joints required for the inventive casing design can be produced with laser or plasma welding. Plasma welding equipment is easily integrated with seamers and provides wider weld joint geometries than laser welding.

In an embodiment, the leaves are preheated prior to welding to allow the parts to slowly air cool. In an embodiment, the welding system includes a linear seam welding fixture, a laser welding head, and an induction pre-heating head.

The welder can seam weld one leaf to the top or the bottom of the previously placed leaf. Each leaf is off-set around the casing diameter by some amount which is located and supported by external tooling so that the casing configuration is formed. One seam weld along the casing length joins the new leaf element to the prior leaf element until ten leaf elements are assembled.

The casing assembly will be compressed and restrained prior to shipment. The machine that will perform the compression will apply a physical force to the leaves of the casing to reduce the diameter. The compression percentage and force will depend upon the designed ratio, leaf surface conditions, and other factors. A compression station will compress the interleaved casing configuration to a predetermined diameter. The station can consist of a large hydraulic clamshell assembly to apply the necessary compression. The internal surface of the assembly will be lined with high strength roller ball assemblies to allow the casing to move within the fixture during compression. The compression fixture will have access "slots" to allow the restraining bands to be applied. Additional safety bands can be installed to ensure stability during storage and shipment. The final assembly is inspected, moved to a spraying station for protective treatment, and placed into storage.

In an alternative embodiment, the expandable tubular or casing can be formed from a plurality of split ring or short height split tube elements, which are staggered longitudinally in order to comply with coiling processes used in coil tubing operations. The circumferential orientation of the individual short ring elements can be controlled so that the all the gaps can be in a dynamic orientation, so that coiled and uncoiled states can be realized. It is preferable to utilize an axial orientation structure (e.g., circumferential limiters) to assist in keeping the individual ring elements in the desired orientations. The plurality of split ring elements can be kept in the compressed state by utilizing a sleeve, and then expanded by removing internal pressure and or dissolving or softening the sleeve.

In still another embodiment, the expandable tubular or casing can be formed from a plurality of split ring elements, which are radially and longitudinally compressible. Furthermore, the circumferential orientation of the individual ring elements can be controlled so that the all the gaps can be in the same orientation, or different orientations. Non-limiting examples of useful ring elements include split ring elements in the form of lock washers or snap rings, each of indefinite height. The shape of the individual ring can be controlled to provide various benefits. For example, a ring can be shaped in helical orientation so that the axial length can increase upon expansion. It is preferable to utilize an axial orientation structure (e.g., a spine, where the split rings are attached to the spine, similar in manner to the anatomical attachment of ribs) to assist in keeping the individual ring elements in the desired orientation. The plurality of split ring elements can be kept in the compressed state by utilizing a sleeve, and then expanded by removing the sleeve, e.g. dissolving or softening the sleeve. Alternatively, the ring elements can be kept in the compressed state utilizing multiple leaves.

In the preferred embodiment, the leaf elements are capable of high-deflection. This type of tubular design provides mechanical capabilities that allow the tubular to expand in excess of 200%. This high-rate capability allows for broad applications of the technology ranging from relatively simple clads to through-tubing products. Generally, an expansion ratio of 135% is required for an expandable device to be integrated into the drilling operation, allowing for adequate supply of both wall-thickness and circulating annulus. The technology's diametric capabilities may range from less than a 3 inch diameter to greater than a 28 inch diameter.

Construction of new expandable casings from elastic-region components provides devices that are integrated into actual drilling operations. This is the primary principle needed towards potential real-time delivery of expandable casings in order to save substantial well construction cost. Since the inventive tubulars need only certain regions of elastic function to properly open, drilling stresses do not automatically destroy the material's expansive integrity. This may allow the casings to be removed from boreholes and reused in other holes. Additionally, the types of robust casings specifications capable of the new method can be viewed as bottom hole assembly specifications. The present invention has the simultaneous benefits of engineering bottom hole assembly, drill-with-casing and expandable casings.

The tubular may have temporary welds or any other temporary bonding method and may also be placed in or around the expandable sleeve, such as an elastomer. When the ring element is properly placed in the borehole geological structure, the temporary welds or temporary bonds are broken. The temporary bonds can be broken with internal pressure or with another type of force that exceeds the tensile strength of the bond. This allows the ring elements to expand towards their uncompressed diameter. The expandable sleeve that surrounds the ring elements can act as a formation-compliant seal.

In another embodiment, a single continuous sheet of material is formed into a tubular shape that is compressible. The resulting tubular has a continuous gap along the axial length of the tubular. The tubular can be maintained in the compressed state by various methods, processes, or apparatus. For example, a sleeve can be utilized to keep the tubular in the compressed state, and the sleeve can be removed, loosened or destroyed to allow expansion of the tubular. Alternatively, the tubular can be kept in the compressed state using a temporary bond such as a temporary weld or a restraining band. Upon release of the sleeve or the temporary bond, the tubular can expand. Like the expandable rings, the temporary bond for the single continuous layer split tube can be broken with internal pressure or with a force that exceeds the tensile strength of the bond. This allows the single layer split tube to expand to its uncompressed diameter and also causes the elastic sleeve to expand. The expandable sleeve that surrounds the split tube acts as a formation-compliant seal.

In an embodiment, the casing includes a release mechanism that enables the restraining welds or bands to be broken remotely. The casing or restraining bands include a "pocket" that can accept a pyrotechnic or explosive "button". Such a button would not be inserted in the pocket until the assembly was ready to be moved into the hole. Once the casing is properly positioned, the button is remotely fired with a wired or wireless detonator. When fired the explosion of the button causes the weld or band to release or fracture. The casing can then expand to the inner surface of the bore hole. The use of this approach allows the manufacturing and transportation of the casings to be done more simply with regards to the use of explosives.

Although manufacturing processes have been described, the inventive tubulars or casings of the present invention can be manufactured by various processes. The casings can be manufactured at the well site or, alternatively, the casings are prefabricated prior to delivery. The manufacturing process generally includes the following steps: forming the leaf members; forming details into each leaf, such as ratchets or stops; forming the casing assembly; compressing the casing; securing the casing in the compressed state; insertion into the geologic site; and deployment of the casing.

The layers of the casing can be produced by any suitable manufacturing process. Non-limiting examples of useful manufacturing techniques include rolling, casting, extruding, shaping, stamping, molding, cutting, forging, and combinations thereof. Metallics, such as alloyed metals, high-alloy metals, and non-metallics, such as ceramic or advanced composite materials can be used.

After the layer of the casing is obtained, certain features or details can then be added. For example, ratchets can be cut or machined into the layer, using methods similar to those used to apply knurling surfaces into thin-walled tubes. Ratchets or other textured surfaces or micro-textured surfaces bonding can also be etched or obtained by using lasers or particle altering processes. Other useful features include irregular, or discontinuous expansion limiting stops (e.g., along longitudinal edges), which can be formed by bending, curling or stamping. These limiters only engage at the largest expanded diameter or point of flattest arc in order to not catch prematurely or otherwise impede the expansion process.

The layer or layers of the casing can then be compressed using any suitable apparatus, method, or process. The compressing step will generally require the application of torque. One useful method is to include the compressing step as the last step of part of an extrusion process. Alternatively, the layer or layers of the casing can be drawn through reduction dies.

Once compressed, the casings of the present invention can be secured in the compressed state by a restrictive apparatus or structure. In this step a securing device or method is generally utilized. In one embodiment, the casing can be wrapped with a sleeve, coil or band, which can later be cut or destroyed to initiate expansion. Non-limiting examples include the following: applying temporary welds or solder to the edges or any appropriate area; ensheathing or breaking a material wrapped around the outer diameter of the tubular (e.g., strips made of magnesium or other active metal or pyrophoric material); utilizing a band of material around the outer diameter that can be cut, burned or melted; clamp interlocks at the edges that are releasable or can be later destroyed; filling partially interlocking edges with a destructible material (e.g., Mg); and combinations of these methods. The use of Mg as one general but non-limiting pyrophoric material is described in further detail below.

After the compression step, the casings or tubulars of the present invention can then be utilized in the well. However, where a composite casing that combines two or more of the casings described above, the composite casing can be assembled by utilizing any suitable apparatus, method or process. In one example, a casing can be inserted into the inner diameter of another casing, which are both in the compressed state. This embodiment assumes that the casings were compressed with predetermined inner diameters and outer diameters. An alternative is to utilize freeze-shrink or sweat tube insertions. Still another example includes progressively adding compressible tubes inside-out before the compressing the casings and then compressing the composite casing. The compressed casing can then be held in the compressed state as described above by weld seam, tack weld, winding, sheathing, or any other compression mechanism. It is also contemplated that guides can be utilized to help align the position of each casing relative to the other casing in a composite casing.

The separate layers of the casings described herein can be held together prior to installation and expansion by various apparatus and processes. In one embodiment, complementing longitudinal curvature or complementing band protrusions (i.e., around the circumference) can be added to the layers. In another embodiment, small guides can be added at the ends of the casing. For example, a "L" shaped or "U" shaped guide can be added via bonding or welding. In a variation of this embodiment, the ends of the casing can be crimped over to stop undesirable longitudinal movement of individual layers.

In still another embodiment, a "pop-out" feature can be utilized to lock individual layers of the casing. This "pop-out" feature is a concave portion, viewing the casing from the outside surface. This feature is similar to squeezing a container to temporarily introduce concave areas to the casing in its compressed state by utilizing any suitable apparatus, method or process. It is preferred that the "pop-out" feature is introduced to provide elastic deformation of the casing. The "pop-out" feature can be introduced at one or more areas along the circumferential edge of the casing. As expansion is occurring, these convex portions will first return to the normal shape along the circumferential surface of the casing. Alternatively, use of auxiliary expansion forces will cause the return to their normal shape. In still another embodiment, a deployment device can include guides to keep the layers together and hold the casing during deployment. These guides can be extendable.

The tubulars or casings described herein can be activated from the compressed state to the expanded state by utilizing any suitable apparatus, method or process. Activation generally includes removing, destroying, disintegrating, burning, softening, or severing the securing device or method to allow the inherent elastic energy in the compressed casing to provide expansion. This can be done by mechanical or chemical methods. For example, the temporary securing device can be chemically destroyed. Alternatively, electrical resistance can be used to ignite a pyrophoric element which previously also provided mechanical strength to the device while compressed. The electrical energy or other energy such as source material can be supplied downhole by wireline or through the drilling assembly. Alternatively or in conjunction with the above methods, the securing device can be mechanically destroyed, cut or removed by using pressure, for example from internal pressure applied by a pump or a tapered mandrel that is forced through the casing.

Once the tubulars or casings of the present invention are positioned and expanded, various apparatus, method or process can be used to maintain the casing in the expanded state. The casing can be generally maintained in the expanded state utilizing bonded and non-bonded methods. The bonded methods generally include forming a physical, chemical, metallurgical or electrical bond between the layers after the casing has reached the desired expanded state. Non-limiting examples of useful bonds include adhesives, electrical-magnetic bonds, welding, brazing, soldering, and any combination thereof.

In one example, an adhesive is utilized between the layers or at certain strategic areas between the layers. It is preferred to utilize an adhesive that is robust at typical operating pressures and temperatures in wells. Non-limiting examples of useful thermoset adhesives include polyamides and epoxies with aromatic amine. An example of a suitable polyamide is PMR-15 which is a high temperature addition-airing polyimide. Polyamides have lower amounts of organic solvents, thereby making the adhesive chemically stable in a downhole environment. Polyamides have the further benefits of high thermal stability and low coefficient of thermal expansion.

In another embodiment, the adhesive can be a single composition or a two-part composition that becomes an activated adhesive when the two portions of the composition come into contact from the compressed state to the expanded state. Non-limiting examples of useful two-part reactive adhesives include cyano acrylates and methyl methacrylates. It is preferred to initiate setting of the adhesive at the time of or after the casing has reached the expanded state. The adhesives may be cured with other types of radiation such as heat or light such as ultra violet or visible wavelength light. In another embodiment, the adhesive or a catalyst for the adhesive can be encapsulated. For example, a catalyst can be microencapsulated in pockets that are capable of being released under certain conditions, e.g., at a certain temperature, pressure, or movement of the layers during expansion.

There is a method for determining the shear stress between individual split pipe layers. The shear stress is dependent upon the applied burst or collapse pressure and the amount of contact area between each layer. The adhesive may be subjected a range of shear stresses which are generally hoop stress when a burst pressure of 6,000 psi is applied to the casing. Bond shear analyses do not account for a reduction in shear area that result from circumferential gaps in the split pipe, but do was assumed that the number of layers bonded equal the number of layers that actually induce the shear load on the adhesive.

The adhesive between each layer of the split pipe casing keeps the layers from moving relative to each other. The adhesive also acts to close off leak paths between the layers. A split pipe adhesive must be able to take shear loading present during burst or collapse pressure applied to the casing. Additionally, the adhesive must not deteriorate in downhole environments.

A critical point in the selection of an adhesive is the initiation of the adhesive setting. If the adhesive sets prematurely, the casing may not be able to expand to its designed final diameter when necessary. The proper sealing of the adhesive will prevent the unset adhesive from setting coming in contact with substances such as drilling fluid, which may prevent the adhesive from setting and/or may weaken the bond. One method of isolating the adhesive from contaminants is to wrap the inner and outer surfaces of the assembly with a flexible elastic sleeve. This sealing sleeve layer is strong enough not to tear if it slides against the bore hole walls during deployment. It must also be flexible enough not to impede expansion of the split pipe.

Another adhesive delivery method is through encapsulation of a catalyst in pockets that melt at a designed temperature. Once melted, the catalyst is released and would be exposed to the adhesive which initializes the curing and hardening. Alternatively, the capsules containing the catalyst break when the split pipe is moved into the expanded position. Yet another approach is to use an adhesive with two reactants that set when they come into contact. A barrier between the reactants is breached when the casing is properly positioned and expanded so that the reactants come into direct contact and hardens.

The adhesives used in the split pipe design must be able to withstand an induced shear stress and be inert in high temperature working environments. A type of material that meets these requirements for the expected load range of the expandable casings is polyamides. These adhesives do not have many organic solvents making the glue chemically stable in borehole environments. A high thermal stability and a low coefficient of thermal expansion make this class of adhesives ideal for split pipe applications. In alternative embodiments, other binding mechanisms may be used. For example, friction welding or other bonding or non-bonding mechanisms can be used alone or in combination with the described adhesives.

The non-bonded methods generally provide a physical barrier to prevent return to the compressed state. Non-limiting examples of non-bonded methods include ratchets, knurling, local mechanical deformation, a penetration device, and combinations thereof. In one embodiment, the opposing surfaces of all or any portion of the layers in a casing can be scored to essentially produce a ratchet between layers. This effect can also be obtained by some types of knurling or micro-features formed by laser processing on the surfaces.

In still another embodiment, pump pressure alone can be used to assist expansion of the casing. Alternatively, pressure such as fluid pressure from a pump or mechanical pressure from a modified mandrel can be used to deform the casing in strategic areas to form a "pop-out" feature or to gall metals or other materials to effect these types of bonds. This would mechanically cause a convex portion in the casing, viewing the casing from the outside. In another example, a penetration device such as spikes, nails, screws or staples can be used to help adhere the casing to the walls of the well. It is preferred to use a penetration element that is self-sealing.

Allowable emphasis on the use of elastic structures and high wall-thickness provide opportunities to incorporate optimized elements from many different connection types. Because so much engagement material is available, the connections are designed completely non-upset. Connecting tube segments uses familiar elements from threaded, quick-couple, and high-pressure sealing designs.

Connection integrity is further improved due to the elimination of the previous, contradictory shrinkage issues, as the new technology provides for complete control over Bauschinger effects to longitudinal behavior. Control over the unpredictable longitudinal 'feeding' problem also provides opportunities to advance expandable system development since the reliance on forming complex, connecting overlaps downhole for separate casing assemblies is also simplified by the inventive expandable tubulars.

The individual casing sections described herein can be connected to form part or all of a casing string or drill string or other assembly utilizing any appropriate apparatus, method or process. "Coupling" normally refers to thread cut to a tube and a separate threaded collar is used; "connection" is normally used for drilling assemblies, where the threads and sealing shoulders are integral, either upset, protruding radially internally or externally or non-upset. One advantage of the invention is that either connecting type can be used and is preferably the non-collared, flush-type. A major benefit of the inventive flush wall expandable casing is that less expansion ratio is required for the tubular to be run through itself and expanded while using a non-upset, or flush type connection. The second major benefit is that sealing functions against the well bore are simplified since no gaps are caused as they are when a protruding collar is present.

The functional objectives are to connect and seal. The connection accepts tensile, buckling, torsion, and bending stresses simultaneously. Conventionally, sealing comes from mechanical energy applied to drilling tool joints which mate shoulder surfaces. The same mating forces apply to the inventive technology. Sealing capability is supplemented by adding compliant elastomeric or ductile metals or similar materials. Integration of compliant or pliable sealing materials throughout the connection engagement areas include use of ductile, deformable, flowable and/or resilient materials such as copper, lead, elastomers or plastics. The compliant or pliable materials can be supplied as o-rings and o-ring recesses or supplied as whole strips to create longer leak paths or as whole end sections for the purposes of providing general sealing integrity. Multiple approaches can be utilized to effect a redundant sealing system. Drilling operational objectives are to connect, seal, and simultaneously accommodate cyclic and multiple drilling stresses. Preferably, all capabilities have the ability to couple and uncouple an indefinite number of times.

To bring individual joint sections together for the purposes of connecting, many approaches are contemplated in the invention. For example, a simple threaded coupling can be connected by applying a torque to rotate one threaded connector into a mating threaded fitting. In some cases the coupling may simply require an axial force to lock the coupling together. In this case the application of compressive forces to the adjacent casings causes the coupling to engage. If the coupling uses a saw-tooth or ratchet mechanisms, the adjacent casings are similarly pushed together to bind the coupling. The couplings may include an overlapped portion that must be compressed once the adjacent casings are properly positioned. In this embodiment, either an inward radial compression is applied to the outer member or an outward radial force is applied to the inner diameter at the overlapped portion of the coupling. Various other coupling mechanisms are suitable for the inventive casings and the coupling actuation can be through any non-limiting combination of force and movement including: longitudinal resistance, torque, and/or radial compression.

Since the compressed position of the tubular is acting essentially as a regular tube, any number of conventional thread types can be applied to the ends. However, given the numerous simultaneous stresses occurring downhole, the relationships among complementing members while opening between connected tubes will not always be exactly aligned during and after expansion. Therefore, limited amounts of final, actual connection engagement must be assumed.

In another embodiment, a laminated or sandwiched method can simplify advanced deployment issues using fewer device sub-systems. This method combines securing the casing in the compressed state, activating the expansion of the casing, sealing the device against drilling fluids, and permanently setting in the expanded state. This method utilizes pyrophoric and/or exothermic-type materials, which are laminated between stiff, but thermally flowable layers of materials. Alternating layers of engineered, low-temperature soldering-brazing and pyrophoric materials can be coated onto to all surfaces of the casing. Furthermore, this method also helps to strengthen by sheathing and effectively thickening or stiffening individual layers of the split-tube casing.

Non-limiting examples of reversibly flowable materials include: low temperature metals, such as solders or brazes and, non-metallics, such as plastics, composites, and reinforced elastomers. These materials are preferably bondable to the casing layers. It is preferred that the materials are flowable in the 500 F-800 F range.

The flowable materials can be activated or triggered using an electrical resistance system, which is delivered via wire line or other means. Details of the embodiment, presented according to deployment sequence, are specified below. A three-shell split-tube arrangement is used for simple illustration. In this embodiment, a spring member means a layer of a casing. In an embodiment, the inventive expandable tubular has nine separate layers and three leaves or springs that are described from the inner layer to the outer layer below.

1. Two-ply hard/soft plastic or elastomer is the innermost layer
2. Mg sheet or coating on inner spring inner diameter surface
3. Spring #1 (also discussed as a wrap spring)
4. Sandwiched solder/Mg/solder over spring #1
5. Spring #2
6. Sandwiched solder/Mg/solder over spring #2
7. Steel spring member #3
8. Mg sheet, winding, tube or coating over spring #3
9. Hard elastomer, plastic or composite material as the external-formation seal is the outermost layer Other potential layers or components include a fabric or membrane that can be integrated in the gap areas to capture specific pyrophoric exhaust/contaminants, if pyrophorics or exothermics require a significant amount of $O_2$, this can be laminated in solid form. The spring members can have integral on both sides a visible or microstructure ratcheting system.

There are several methods to keep a single-split tube casing in the compressed position. Depending on the force required, some of these methods include: inserting the spring assembly into a Mg tube or similar tube to confine it, sheathing the casing by wrapping helically with Mg strips or windings, welding the spring casing edges with a like pyrophoric or by molding integral. Other possible methods include forming the casing edges, hooking or snapping the spring edges to themselves & providing Mg thread or temporarily welding or soldering ratchet surfaces together or alternatively push them apart on the opposite surfaces. Yet another method would be to encase the entire external surface of the device in plastic, elastomer, steel-matrix, thin metal plate or similar layers.

Pyrophoric material can be ignited by a spark mechanism that includes an electric resistance element that is coupled by wires to a switch and a local or remote voltage source. A voltage may only be applied when the spark is required. If the voltage source is local, the switch may be wirelessly actuated. If the switch and voltage source are remote, wires may be coupled to the resistance element and a user may manually actuate the switch. An alternative or augmentative heat generation approach is to locally apply friction as it occurs during radial energy transfer brought by pump pressure or mandrel tooling.

Disintegration of the securing material allows the spring members to release towards their natural, open, oversized form. The force/friction relationship among the spring members can be arranged so that the device can fully expand on its own under reasonable conditions. Hydraulic pressure applied through the inner diameter can be used to assist the expansion. In other embodiments, other physical expansion apparatuses can also be used.

As pyrophoric generated heat liquefies the low-temperature alloy, the fluidized metal can also produce lubricity between the sliding spring surfaces. Pyrophoric gases are generated, further reducing friction by creating gaseous voids in the metal liquidus or by providing a lowered-friction gas-layer between the liquids and the sliding surfaces.

It is preferred to maintain a seal against well fluids (e.g., drilling mud) during mobilization of the springs. Such a seal provides a cleaner bonding environment to assure the integrity of any re-hardening materials to form as encapsulating and mass augmenting 'sub-tubes' in the alternative approach towards maintaining the final expanded diameter integrity, described below.

The bonding environment sealing system is redundant in nature, consisting of sealing layers externally, internally, as well as seals integral to the interior spring members. The seals, especially those along the interior, are one-way in nature, to allow efficient sliding by the springs and expulsive movement of pyrophoric exhausts or other internal contaminants.

The general reliance for seals can be transcended by providing essentially a continuous spring system. Instead of having distinct leading edges, those areas would transition into a thin and flexible section, to segue into the next spring-edge in an impermeable manner. This transition material may yield or plasticize without affecting other self-expansion properties. The transition material may even be a further specialized type of malleable low-temp metal. An elastomeric transition material also fulfills this concept well.

Regardless of the approach, it is preferred to seal the outer diameter, inner diameter and ends of the casing. The heated elastomeric or similar material can be stretched along with the expansion and can maintain its integrity and sealing ability throughout the expansion process. In particular, the leaf spring #3 can slide underneath the relatively fluidized layers of the external seal and the seal can fall into any gap, which widens as a split-tube expands. Since the area of contact between the external rubber and spring #3 is hotter than it is about the outermost diameter, there can be more reliable liquidus and therefore reduced friction at the spring-rubber interface.

Sealing the widening longitudinal gap about the inner diameter can start with a similar 'sliding event', where the metallic spring member or members moves underneath a temporarily fluidized layer of seal material. Since hydrostatic pressure in the inner diameter is greater than that of the interstices of the device, the fluidized seal material is forced-out radially, filling the ever-widening gap. There is a propensity for the same fluid, which is assisting radial displacement of the mobilized seal material to actually penetrate the seal integrity. Thus, the stiffness of the seal itself can then be two-phase.

A plying approach to forming the interior seal can produce the necessary 'dual-phasing' of seal stiffness. These are noted, inside-out, as seal layers A & B, respectively. With pyrophoric heat applied locally, the material of the layer adjacent to the spring and adjacent to Seal Layer-B can fluidize more quickly relative to the innermost layer radially Seal Layer-A, which is cooled by drilling mud. The concept is that as hydrostatic pressure is exerted against the stiffer Layer-A, it is caused to expand radially. The expansion force at Layer-A is transferred to Layer-B. Because Layer-B is relatively fluidized, it can ultimately only flow into the widening gap area thereby increasing empty volume or attempt to escape longitudinally.

The remnants of Layer-A can be absorbed into individual ratchet recesses. This is to say that the material is driven into the recesses, roots, scores, grooves, or other indentation formed on the surfaces of the spring members. As the seal material hardens, and having penetrated the score depths, the Layer-A material assists also in propping the spring member open, by effectively stiffening the ratchet roots and surfaces throughout.

The scores or ratchets allow also for greater expansion and compression rates of individual members by providing extensive stress relief sections, or otherwise corrugating the spring geometry. The approach still emulates many benefits of high-wall thickness and increases bond-shear-properties related to higher surface area, thereby reducing load requirements for bonding materials.

Well bore fluids will invade any possible openings, including those also at the ends of the device. One alternative sealing method is to work the expansive events on a near-bottom-up type basis, by, for example, locating the device actuation point 5 feet to 10 feet from bottom on a 100 foot setting. This is to say, to activate the 90-feet deep section of the tubular first. Providing complementary lower-pressure directions to the expansion longitudinally also assists expelling potential pyrophoric exhaust issues, where these gases can be controllably removed. End area fluid invasion will not tend occur when the device internal fluid bias is adequately positive, incompressible against well fluid hydrostatic or when the bond material solidus has adequate properties to resist invasion at the ends. Integrating transverse end features to external sealing sleeves provides redundancy against potential fluid invasion.

Gases can be produced from pyrophoric events. The produced gases can be managed by allowing them to escape or by containing them. It is preferred to utilize a method for releasing the gases.

Since the direction of the net forces causing expansion is inside-out, this is also the normal direction of fluid flows between layers inside of the casing. A substantive radial compression occurs by deflection of the gap area which assists with this transport. Movement of the liquefied material pushes or otherwise carries the gas outward along with the overall system movement. The second general direction of fluid movement is up-hole, carried by the displaced drilling mud in the annulus, which then carries the waste materials towards atmosphere.

Exhaust gases may already be present at the outer diameter from activation of outer sealing layers. The presence of this and additional gas found internally is thought to provide two benefits and one detriment. A benefit is augmenting the thermal state of the seal material. This might be required to maintain the pliancy of the external sealing layers as the displaced drilling mud may tend to cool the material prematurely. A second benefit is that the gaseous discharge may provide a friction reducing layer or other facilitation to help control the spring component movement relative to the seal layer. In general, integrating numerous small, one-way ports is the most sensible manner to release gases to the external seal in order to evenly provide heat and reduce friction. The potential detrimental effects center on causing voids in the seal material itself by over-misceiving with contaminants. Alternatively, this effect can be ignored or even altered and used beneficially as a means of greatly expanding or energizing the external materials by injecting sealants or naturally producing various swelling or foaming techniques.

In one embodiment, relatively solid rubber is utilized at the end area at all times. Longitudinally, the final condition for the casing can consist of cooled hard rubber, a partially misceived transition zone, and then the majority length of soldered mid-body. This end configuration also leads to a precursor form of a rubberized seal for later construction of Single-diameter, minimal overlap type abutment joints. The current estimate is that the effects of misceived material, or even minor gaps are not are harmful to the casing set. The internal rubber cap may be of minimal thickness or it may be several inches thick longitudinally. Until actual release of the gases, gas pressure would be exerted against a heated, semi-liquid rubber end cap section.

The rubber gas cap preferably absorbs both its own internal heat and gas pressure generation when no hydrostatic is exerted against it externally, and the same heat/pressure with excess hydrostatic. All phases of the rubber layer rise and fall, according to this varied pressure demand. Both cases are satisfied by providing adequate longitudinal length of rubber within the rigid steel-walls of the spring members. Encasing long lengths of such soft-state-rubber activities within deep steel channels provides a high degree of latitude with regards to compliance with varying external pressure requirements. Beveling the longitudinal edges of the stiff springs to invite and then constrict flow may extend this pressure compliance. When in an open-end, empty-hole scenario, the hanger/landing delivery device described below would stop potential protrusion or loss of internal materials.

A carrying system for the tubulars and casings of the present invention can provide many functions including: transporting the casing by wire line or pipe assembly; auxiliary protection and sealing the end sections during expansion; providing a displaced fluid flow-path or a reverse-circulation sub-system; supplying abutment sealing material; and maintaining relative positions of members longitudinally.

In one embodiment, the casings are inserted into the boreholes with a hanger-delivery system that includes two main pieces, a top connected to a bottom. The hanger-delivery system can further include a connecting tube between the top and the bottom. Since mud pump pressure in the inner diameter can be used as an expansion force, the top and bottom pieces are preferably opposing convex shapes which accept pressure exerted towards each end. The connection to the wire line or pipe assembly can be at the top, middle or bottom of the hanging-delivery system. Electrical actuation hardware can also be run through the hanging device.

These top arid bottom pieces can combine the inner diameter pump pressure seating and device hanging functions simultaneously. There can be dual sealing components, an inner diameter management seal and an end/abutment seal. The inner diameter seal can be generally conical in overall shape and can be made by longitudinally undulating elastomer material. A cut-away view would appear as opposing 'S' shapes, joined at the center-bottom-collet, around the pipe. The bottom piece can connect to the bottom thread and also act as a guide shoe during placement.

The connecting drill pipe or tubing can run through the center of the inner diameter seals. The inner diameter seals grip and seal the interior side of the casing. The inner diameter seals can be connected to the center pipe by a collet. Between the connecting pipe and collet is additional seal hardware, similar to what would be used in hydraulic systems. There are also initiating shear pins in the collet, which are released when pre-defined amounts of pressure are applied inside of the center pipe.

The seal-expansion concept is that as pump pressure is applied, the flexible seal-cones push away longitudinally. The material found previously along the longitudinal axis of the system feeds the radial growth of the seal. The longitudinal movement in the undulated-'S' scheme also forces the seal to grow radially as the material becomes compressed longitudinally. A pleated inner diameter seal is thought to be able to provide the same functions of longitudinal feed for radial growth, as an alternative. Additional sealing capability is produced by integrating straight, concave lips, or cups to the inner diameter material, which is in contact with the casing's inner diameter.

At the top edge of the S-shape is the actual permanent seal for the end area of the casing. This seal can be temporarily carried on the main hanger-seal. This seal preferably also incorporates a rubber 'skirt' which drapes down, about the outer diameter of the casing. This is a form of additional support and positioning assurance for the end-seal. The skirt also provides additional sealing for the casing and additional pliancy externally. Additional pliancy is advantageous, should the abutment area become either out-of-gauge or constricted. The out-of-gauge concept is clear. The constricted concept is also novel, in that flows in constricted annulus can still be forced by and around the relatively soft materials. This is contrasted with trying to pump past solid steel pipe in a constricted scenario. It is preferred that the skirt actually pulled the end-seal outward as radial expansion occurred.

The end-seal itself should be a wrap configuration or other form complementary to the arrangement at the ends of the casing spring members. The seal is preferably plastically deformed, so as to naturally tend to not creep towards the inner diameter and become a potential obstruction internally. The inner diameter seals may incorporate steel bands, so as to provide both abilities of inversion of the undulating layers and positive force radially to assist with plastic deformation of the end-seal. The positive expansive force would be brought by the accumulation of solid rings.

This is connected to the hanging apparatus on a temporary basis. With a secondary end-seal in-place, there is reinforcement to mitigate any deficiencies inherent in the primary, molded rubber seals, as discussed in the 'End-seal' Section. With proper pressure applied to the end-seal, the hanging system both protects and allows middle-out expansion or end-down or end-up expansion. The auxiliary end protection later becomes additional abutment seal.

The process of displacing fluid, which moves past the abutment area, requires special care so as to not wash away the local geology, the ends of the device, the external seal of the device or otherwise destabilize the area in general. The basic scheme is to simply flow returns back into the main well inner diameter. This flow would occur over top of the upper-hanging tool. In a lengthy casing string, any 'middle-out' type actuation requirement spelled out in the 'End-Sealing' section must be timed so as to produce an overall flush in the annulus and not trap fluids behind the expanded casing. Any auxiliary expansion operation needs to be similarly coordinated. One alternative scheme is to reverse-circulate out the overall displaced flow from below the abutment area.

Since there is potentially so much fluid to displace in a long casing string, the bulk of flows ideally should occur several feet below the abutment area to prevent erosion of critical end-area components. At a minimum, tapering the exit area and doubling the elastomeric layers as described in item 1 provides relief from turbulence, provides sacrificial material against erosion, and provides flexibility for subsequent annular sealing purposes. An alternative approach seeks to protect both the end-area geology and the device ends by making a 'scoop' integral to the hanger, end and external surfaces and locating it several feet away from the abutment area. However, the scoop is preferably retrieved before the expansion is full.

The end-seal system also preferably reconciles any longitudinal adjustment needed upon final set of the abutment installation. Once expansion is commenced, options of longitudinally adjusting the abutment area are lost since the casing deliberately becomes immobile against the formation elsewhere. Any axial adjustment is proposed to be handled three dimensionally. The concept is that the skirt component described earlier can pull the end-seal past flush with the outer diameter, or cause it to 'lip-over' temporarily. At that point, there would be excess sealing rubber material to fill either longitudinal or radial gaps, as needed. The longitudinal adjustment is actually taking place as an additional annular seal, thereby stopping the need for a literally connected abutment. The monodiameter seal is adjustable in all directions, but would never tend to invade the inner diameter.

As the expanding end-seal ring at the abutment area becomes fully expanded, it must somehow be separated from the hanging system. This is first proposed to occur by self-shearing of thin sections of the temporary carrying section. These sections would stretch and thin progressively along with the radial expansion. A redundancy to this shear-separation can occur by tension, sit-down or other force.

A minor low-pressure effect is expected as the gap volume is enlarged between the spring edges during expansion. One view is that this could mildly inhibit a natural opening movement of the spring, either by vacuum or by allowing structural abnormalities to occur transversely across the gaps. A counter view is that any local thermal expansion generated by the liquefied metals or gas generation by pyrophoric activity could overcome any effects of low-pressure and possibly provide further expansive energy to occur tangentially. Additionally, with appropriately beveled or rounded geometry formed at the spring edges, any deflection occurring radially across the gap should cause the spring edges to assist the expansion in a tangential direction. Still another view is that this or subsequently negative pressure area can serve as a central point to draw gaseous contaminants or other materials.

In all cases, pyrophoric gas generation, or exhaust, is of concern as it infers chemical and void-related infiltration and contamination to the permanent bonding system. The exhausting scenario is discussed above. At least a partial treatment towards some secondary capture internally is discussed here.

It is preferred to eliminate all possible contaminants from the bonding environments. Although it should be clear that the generally outward push on these gases may be sufficient to eliminate the contaminants, the addition of a secondary contaminant management system is preferred. Incorporation of an appropriate fabric or membrane piece in the gap area would serve well to catch definable particulate types. Filter cake-like build-up of solder on the absorptive fabric stops prospective invasion from well fluids by creating essentially a solid area, which would otherwise be void inside the casing.

The inventive casing is safeguarded against 'over-inflation' by limiting the natural diameter of Spring #3. If the largest possible diameter of spring #3 is set for example, at 4" outer diameter casing is set even at 4" or slightly over 4", it will then provide resistance against excessive growth by its internal layers. A system of 'catches' can also be incorporated as a means of controlling relative spring positions and to prevent over-expansion.

The two primary functions of the expandable casing are maintenance of its internal diameter and compliance of the outer surfaces with geological formations for sealing and flexible support externally. In an embodiment, the inner and outer diameters are opposite structures, geometries, and operations. The inner diameter benefits highly according to the perfection of its roundness. The outer diameter is deliberately only generally round in order to contact and support the completely irregular shapes which comprise a drilled hole or any other open geologic conduit.

Of the various tubular geometries, a wrap configuration most closely resembles regular pipe. The wrap is then also the approach with the best potential for obtaining a pipe form approaching perfect roundness. This near-perfect roundness can be obtained internally within a protected and accommodating environment. The differences between burst and collapse values for perfect tubes and those with even 1% eccentricity are orders-of-magnitude. The benefit caused by forming round tubes in terms of higher-performance capabilities, required bond-shear values, device reliability, reduced weight, reduced manufacturing costs, and other benefits are very significant.

Externally, however, jagged rock surfaces and eccentricity downhole, in combination with numerous bending, hydraulic and other stresses are in conflict with the round, perfect conditions necessary for the concentric-wrap embodiment or conventional expandables to reliably expand. To effect a radially biased seal against such an environment is highly beneficial, not only to control the movement of formation fluids, but also to provide assistance to flexible-support rock mechanics theory.

These varying technical demands indicate the need for a composite type expandable embodiment, where the internal through bore part is true and round and the middle and outer parts variable, thereby both allowing and supporting the preferred through bore roundness. The concept provides external protective shells to the thinner, more perfect inner diameter.

In one embodiment, a proposed hybrid casing includes a wrapped casing in the inner-most section and, moving outwardly, a metallic split-tube casing alternating with softer and/or flowable materials. The relatively stiff inner-wrap will displace the more flexible split-tubes, any gaps between layers, and any softened materials present during expansion. This is particularly the case if high pump pressure and/or a mechanical mandrel are applied to assist the expansion. Use of, for example, rubber layers between metallic members provides an excellent dampening quality against all types of pre-expansion stresses including drilling dynamics stress mitigation. The rubber can be flowable either by temperature or pressure. Compression or flow of elastomeric-type materials is a sensible approach to satisfy eccentric adjustment, sealing, and strength needs of the device.

A further advantage to the eccentric approach is that the greatest probability of expansion is provided, even in obstructed conditions downhole. Even if the borehole is technically under-gauge, expansion of the relatively small-diameter, robust inner-section could still be completed. Regardless if other sections of the tubular are not fully expanded, the inner-piece may also open eccentric to the remaining parts. Should the inner section even protrude beyond its protective layers, the necessary burst and collapse properties can be attained. These properties are attainable since they are being forced into a confined condition as the device is integrated into a geological or filter-cake interface. The concept is to obtain strength by supporting short-span, arcuate shells with fixed ends.

Such protrusion, when combined with high pump pressure and high mandrel forces occurring radially, also presents a first proper step of concentrated, high-force and thin-tube exertion towards actual deformation of formation rock and penetration of the rock materials. This further extends the range of useable borehole diameter and even further increases potential expansion reliability. This type of rock-penetration is also unique in that it is a pointed and tangentially variable penetration, as contrasted with the simple, wholly concentric approaches sought by plasticized-tube expansion processes currently.

The simple approach of providing rubber to the device is to do so in the form of alternating layers. One alternative approach to supplying rubber is to do so by sandwiching the rubber between perforated metallic layers. Pressure and/or temperature then displace the rubber material to where it is needed. Alternatively, coating with or supplying layers of relatively soft flowable metals such as lead or copper can provide the same functions and benefits. Furthermore, the remaining relatively flexible external layers present a means to allow annular flow during displacement of fluids through obstructions or even plugged sections of borehole annulus.

Once expanded, the tubular or casing preferably does not recompress prior to any permanent bond set-up and preferably remains in the expanded state during all types of operations performed in wells. Integrity of the expanded-state of the device can be provided by various approaches that can be used alone or in combination. The approaches include: ratchets, ratchets with flexible elements, bonds, transverse tangential support, creation of sub-system tubes and intra-notch, root or cell stiffening.

Ratcheting System—The one-way ratcheting or texture mechanisms can take multiple forms, ranging from simple ratchets formed integral in the springs, to micro-structures similarly integral. To allow sliding of the tubular's spring layers, the pointing direction of the ratchets must be opposing at certain partial arc lengths about the spring surfaces, generally shown in quadrants. Such a quadrant is nominally defined to begin/stop at the apex of the spring member. This apex area is not necessarily located centrally. Ratchet dimensions are proportional to spring thickness and the ratcheting effects to friction, spring performance, and overall device properties which can be optimized by surface condition, detailed geometry, placement, frequency, elastic featuring, and pattern.

The ratchet architecture does not consist of simple, straight rows. Rather, it is placed discontinuously and/or at slight angles to the longitudinal axis of the spring. This acts both as failsafe delivery and receipt of razor-like pawl elements of the ratchet system. The intent is to form a failsafe geometry, where regardless of damage to small features, misalignment or any imperfection in the system, some pawl-notch connection is always made in order to provide the back-stopping function. This needs to be true in all circumstances, even if the back-stopping function must happen randomly. The ratchet system functions for diametrically varied states of expansion.

The anti-collapse geometry may resemble architectural fan patterns, fish-scale patterns or other linearly discontinuous systems. Other forms, such as wave-patterns with tips, preferably hardened or even constructed of razor sharp tungsten or tool-steel may be preferred. By the galling or gouging effect created by razor-type edges, secondary bonds may are formed at the point of the ratchet notch. So as to enable subsequent expansion of an under-gauge inner diameter, the tip-gouge-bond capability should be obtainable only at to-drift contact points of the ratchet system.

Bonds—Shear and load transfer values are maximized by bonding the entire area between round-spring surfaces. Adhering only portions of the surface area also produces substantive integrity for the device. Bonding criticality is not exclusive to the leading-edges, Effective bond surface area increases according to increased ratchet surface area and the required bonding values can be reduced by increasing such surface area. Further increases to bond quality are assumed to be obtained by the effect of deep penetration by razor-like kerfs into the ratchet pawls. This penetration extends into the ratchet roots and into the main spring body. The effect is as if a spike is drilled, or a deep galling effected, which takes the bonding architecture to 3D relationships, not merely 2D planes.

Transverse/tangential Support—Since split-tube spring leading edges absorb most stresses of the lapped bonding arrangements, it is important to reinforce the edge areas in any way possible. One such manner of support is to rigidly bridge the gap or moveable end area by flowing and solidifying solder and similar materials. As strength augmentation to bonding criticality, a novel approach substitutes some pure bonding value normally occurring peripherally, for strategically located material solidus. The concept is simply that solder-material flows into the gaps and then solidifies. The solidified gap area then resists the compressive loads from collapse stresses. In the burst case, hardened material located in the gap area becomes part of a new solid tube, which surrounds the spring. The enveloping, auxiliary tube then absorbs burst stresses. The spring is essentially encased in a low-temperature metal sleeve, which is also integrated with the surficial recesses of the sleeve. Ultimate bond quality shear values are reduced by rigidly supporting the separation of the spring edges against collapse, burst, and other stresses.

Auxiliary tubes—Since braze-solder material is located throughout the circumference of the spring members, the material sheaths and bonds to the spring members. The effect is also to add mass to the spring members in a manner only possible at the initiation of expansion. The augmented tubes are thin layers, which also penetrate the notch recesses of integral ratchets and have the added longitudinal segment through the gap area. Enshrouding or otherwise adding mass is strength enhancement against all stresses.

Intracellular stiffening—The reversible solder or other flowable material is used to assist with the securing of the device compressed state by temporarily bonding of ratchet recesses once in the minimum diametric position. This is tantamount to deepening the restraining of member fibers against uncontrolled expansive movement. The converse is then also true at expansion. As ratchet notches are widened by opening the spring members, the notch can receive solid or solidifying metal to make its open position secured. This is further support towards maintaining the expanded state of the device.

Figure 16:
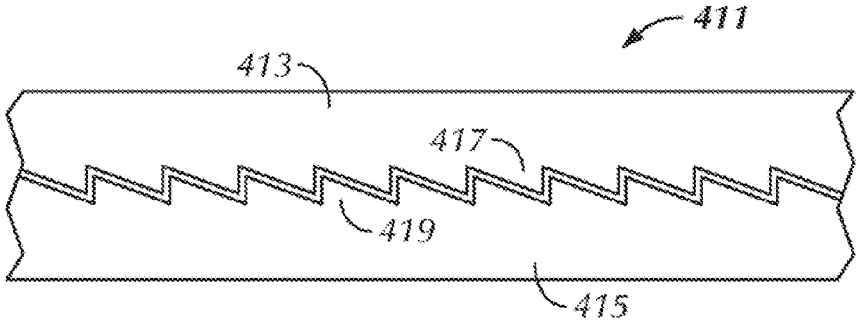
FIG. 16 is a cross section view of a ratchet mechanism that prevents the adjacent layers from compressing.

With reference to FIGS. 16-23 illustrate different ratchet systems and components. With reference to FIG. 16 a side view of a simple surface finish ratchet system 411 is illustrated. In this embodiment, the inner surface of the outer leaf 413 is textured with angled teeth 417 and the outer surface of the inner leaf 415 is textured with corresponding angled teeth 419. The teeth 417 allow the outer leaf 413 to move left and the inner leaf 415 to move towards the right. This one way movement allows the casing 411 to expand but not contract. In an embodiment, the two sets of teeth 417, 419 can be formed on opposite sides of the same sheet of material of a casing having only a single layer. The teeth are angled to allow the expansion but prevent the tubular from collapsing. As discussed, the tubular can be expanded by internal pressure, an expansion mandrel or any other type of expansion device such as an inflatable expansion mechanism.

Figure 17:
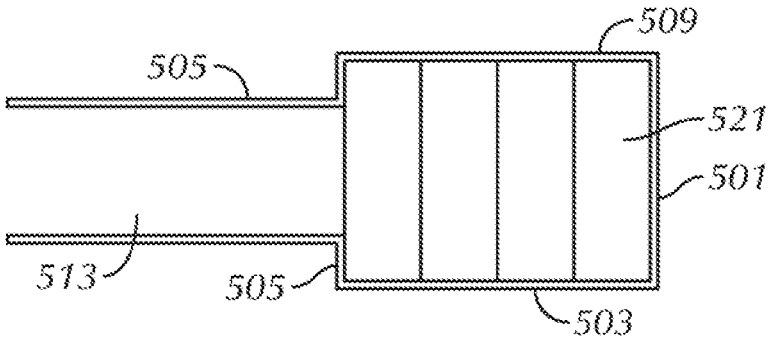
FIG. 17 is a view of a ratchet tab that holds the tubular in the expanded position.
Figure 18:
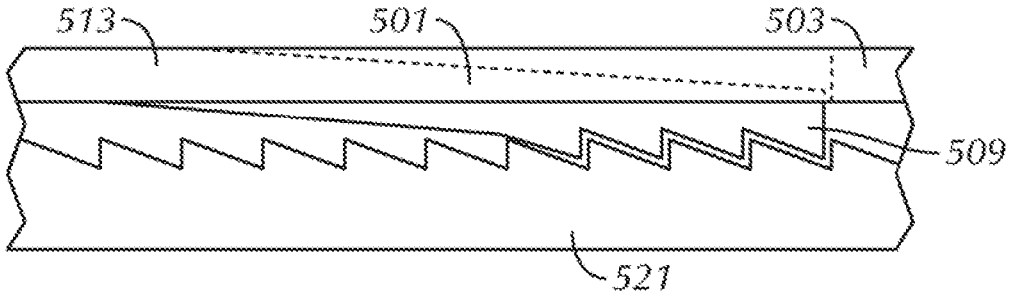
FIG. 18 is a side view of the ratchet tab with the in contact with a ratchet surface formed in the adjacent leaf.
Figure 19:
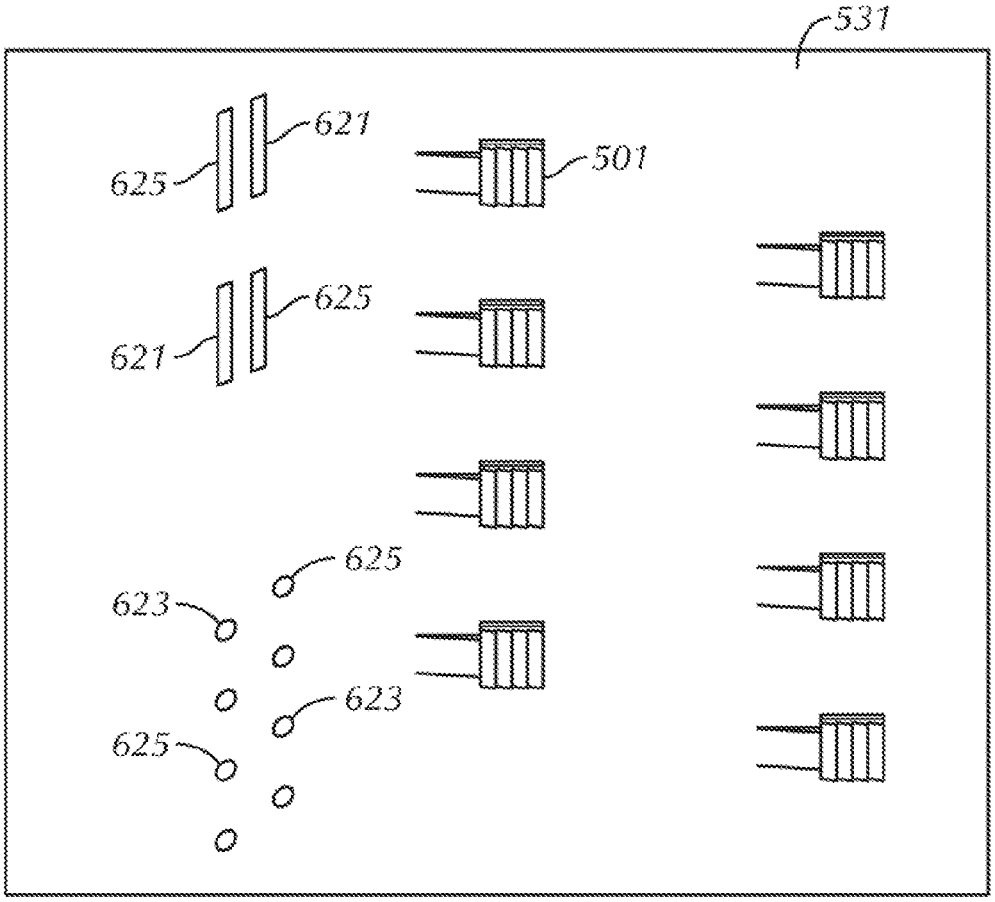
FIG. 19 is a view of a portion of a leaf having a plurality of ratchet tabs.

With reference to FIGS. 17-19, another ratchet system is illustrated. FIG. 17 shows a tab 501 that is formed on at least one layer 503 of the inventive casing. In an embodiment, the tab 501 is formed by cutting slots 505 in the layer 503 and bending an elongated section 513 so that the tab 501 is away from the layer 503. The tab 501 has a contact surface 509 that has angled teeth. FIG. 18 shows the elongated section 513 bent out of the plane of the layer 503. The contact surface 509 engages the teeth that are formed in the outer surface of the adjacent inner layer 521. This configuration allows the locking mechanism to operate even if the layers 503, 521 are not in direct contact. If the adjacent layers 503, 521 are pressed together, the elongated section 513 will be pressed into the outer layer 503 and the locking expansion mechanism will still be fully functional. In order to provide a sufficient expansion locking force, a plurality of locking tabs 501 may be used with the tubular casing. FIG. 19 illustrates a layer of a tubular casing 531 having a plurality of locking tabs 501. The tabs 501 would engage teeth formed in the outer diameter of an inner layer of the casing that may only exist on a portion of the outer surface with the remainder of the surface being smooth. For example, the teeth may only engage the tabs while the casing is being expanded such as a minimum expansion position. The teeth may not engage the tab when the casing is compressed or at any point prior to the minimum expansion position. Although the tab 501 has been described as being bent inward to contact an inner layer, it is also possible to configure the tab 501 to be bent outward to contact the inner surface of an outer layer and function in the manner described above.

Figure 20:
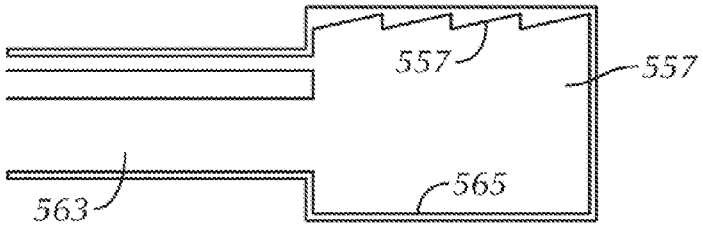
FIG. 20 is a view of the ratchet tab that holds the tubular in the expanded position.
Figure 21:
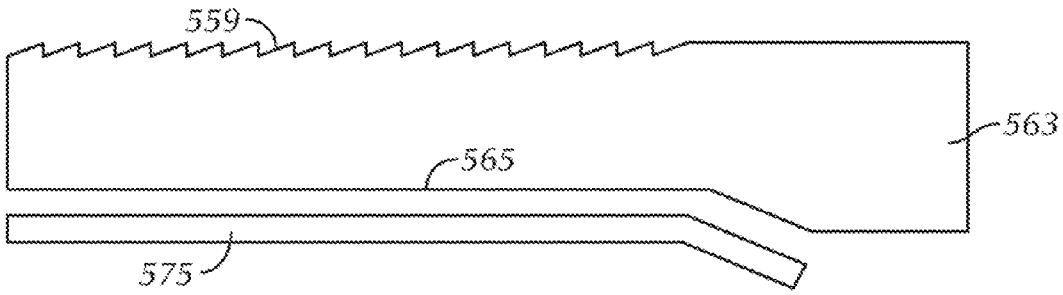
FIG. 21 is a view of a ratchet slot that engage the ratchet tab.
Figure 22:
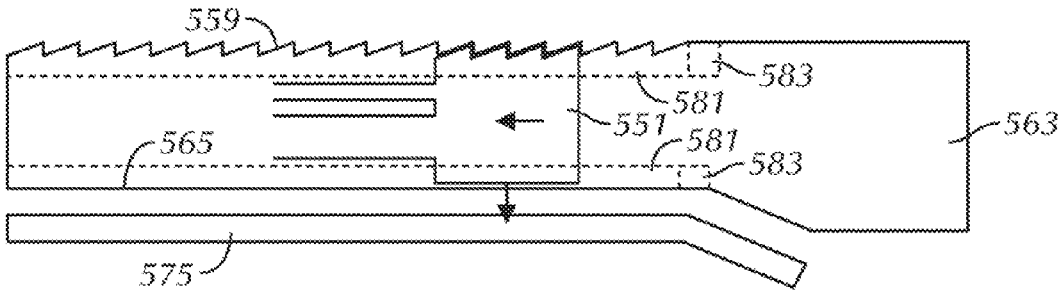
FIG. 22 is a view of the ratchet tab in the ratchet slot.

FIGS. 20-22 illustrate yet another ratchet mechanism. In this embodiment, the tab 551 has teeth 557 formed in on a sliding edge engage teeth 559 formed on an edge of a slot 563. FIG. 20 illustrates a tab 551 which is formed in one or more of the layers of the casing. In general, a plurality of tabs 551 will be used in the tubular casing layer. The tab 551 includes a set of teeth 559 on one side and a smooth sliding opposite side 565. The tab 551 also has an elongated member 563 that allows the tab 551 to be bent so that the tab 551 section is displaced out of the plane of the attached leaf and into the plane of an adjacent leaf layer. FIG. 21 illustrates a slot 563 formed in the adjacent layer to the tab layer. The slot 563 includes a smooth sliding surface 565 and a section 569 that has a set of teeth and a ramped section 571. A flex slot 575 is positioned in parallel to the main slot 563 which allows the smooth side 565 to move as the tab 551 slides through the slot 563. FIG. 22 shows the tab 551 within the slot 563. The teeth 559 are configured to allow the tab 551 to only slide in one direction. Because the tab 551 is attached to a separate leaf than the slot 563, the tab 551 may tend to pull away from the slot 563. This separation can be prevented with retaining walls 581 which are on both sides of the slot 563 and engage the sides of the tab 551. In order for the tab 551 to properly enter the teeth 559 section of the slot 563, ramps 583 are formed in the leading edge of the retaining walls 581. The ramps 583 are angled surfaces that help to guide the tab 551 from the wider section of the slot 563 into the teeth 559 area. Because there is no friction, the tab 551 does not resist movement within the wider section of the slot 563, but will resist movement within the teeth 559 area of the slot 563 due to friction.

In an embodiment, the slot 563 may be positioned on the layer such that the tab 551 does not engage the slot 563 until it is in the minimum expanded position. As the casing expands further, the teeth 557, 559 only allow the layers to move in the expansion direction. The slot 563 may be configured to only allow a limited expansion. When the tab 551 gets to the end of the slot 563 it will not be allowed to expand any further. A plurality of tabs 551 and slots 563 may be used with adjacent layers of the casing as shown in FIG. 19.

Figure 23:
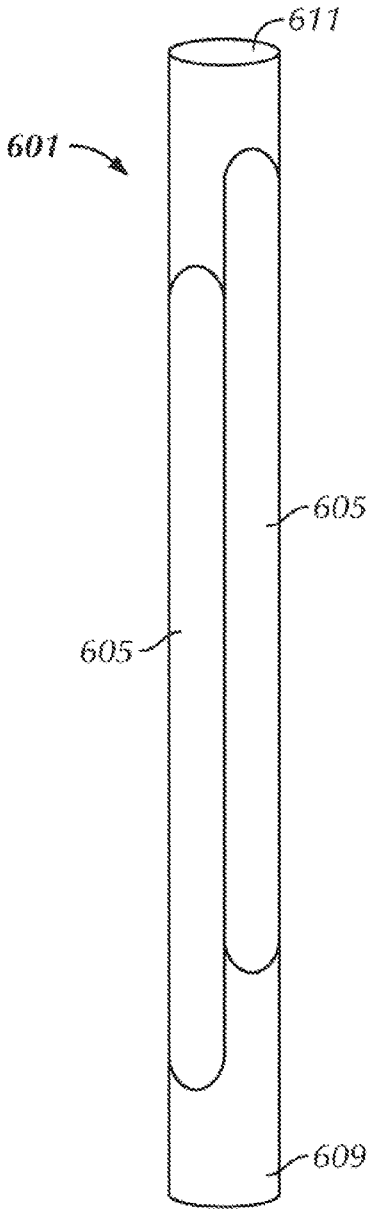
FIG. 23 is a side view of an expansion mechanism in the compressed state.
Figure 24:
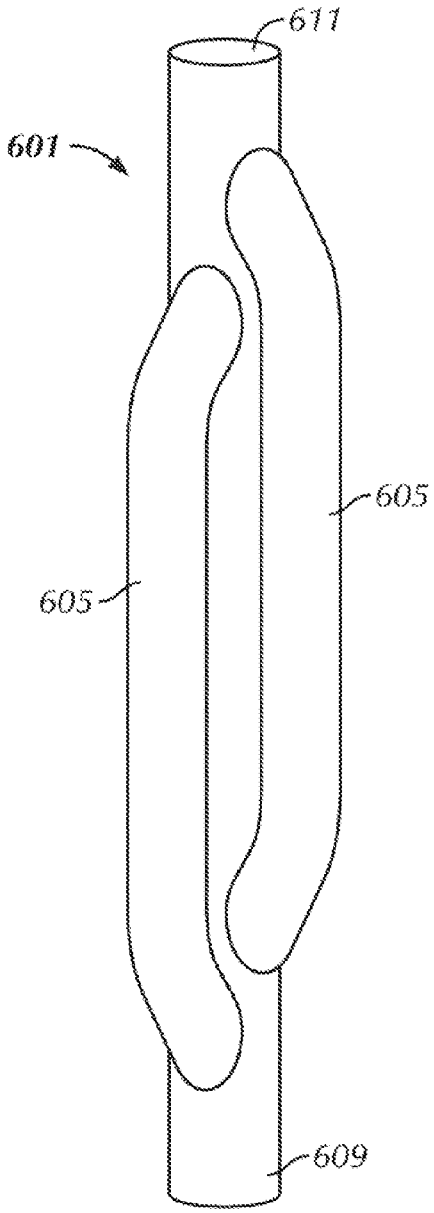
FIG. 24 is a side view of an expansion mechanism in the expanded state.

As discussed above, internal pressure may be required to expand the inventive tubular and actuate the ratchet mechanism used to hold the tubular in the expanded state. FIG. 23 illustrates an embodiment of an expansion mechanism 601 in the compressed state and FIG. 24 illustrates the expandable expansion mechanism 601 in the expanded state. The expansion mechanism 601 includes a pipe that is coupled to a fluid pressure source and a plurality of flexible tubes 605 mounted in parallel. The fluid used to expand the mechanism 601 can he a gas or liquid. The top 611 of the expansion mechanism 601 may be coupled to a pressurized fluid source with a pipe or hose that does not expand when pressurized. The bottom 609 of the expansion mechanism 601 may be plugged to keep the pressurized fluid from escaping.

To initiate expansion of the casing, the expansion mechanism 601 is first inserted into the inner diameter of the unexpanded casing. The expansion mechanism 601 is then pressurized which causes the flexible tubes 605 to expand and contact the inner diameter of the casing. When the pressure applied to the inner surface area exceeds the restriction forces, the casing expands. In an embodiment, the casing is held in the compressed state with engineered welds that have a known material strength. By applying an internal pressure that exceeds the strength of the weld, the expansion mechanism 601 breaks the weld and causes the outer diameter of the casing to expand. As the expansion mechanism 601 continues to expand, the casing may contact the walls of the borehole which can be compressed and can prevent further expansion. In the expanded position, the ratchet mechanisms illustrated in FIGS. 16-22 are actuated and prevent the casing from compressing. Once the casing is properly positioned and fully expanded, the expansion mechanism 601 can be depressurized so that the plurality of flexible tubes 605 collapse and the expansion mechanism 601 can be removed. With the expansion mechanism 601 removed, additional casing pieces can be inserted into the bore hole and the described process can be repeated.

The expansion device can be various other mechanisms in other embodiments. In one embodiment, the expansion device can be a single expandable bladder. This embodiment is similar to the multiple inflatable tubes illustrated in FIGS. 23 and 24, but only includes a single bladder. The bladder can be a solid elongated piece or it may have an annular cross section that surrounds a rod. The bladder can be inflated with a fluid.

In an embodiment, a solid expansion device may be used. The solid expansion device may have a tapered section and an outer diameter that is similar in size to the inner diameter of the expanded casing. When the expansion device is pressed into the compressed casing the tapered section engages the inner diameter of the casing and causes the casing to expand. The expansion device will continue to slide through the casing until the entire casing is expanded to the outer diameter.

In another embodiment, the casing is expanded by applying fluid pressure directly to the internal volume of the casing. In this embodiment, the ends of the casing are sealed and one end is coupled to the fluid pressure source. The applied internal pressure source causes the casing to expand. As the casing expands in diameter, the end seals will also expand. Once the casing has expanded into the desired location, the end seals are removed to complete the installation.

The following examples are non-limiting novel applications that utilize the present invention. In one embodiment, the casing is a hybrid casing that converts from solid tube to a porouis tube. In this embodiment, the casing spring members are perforated or slotted, but temporarily plugged with materials to effect casing seal capabilities during installation. Once installed and when the screen functionality is required, the plugging materials are removed by specific chemical or other mechanical activity.

In an embodiment, the casing acts as an expandable sleeve which is affixed to drill collars or other bottom hole assembly. The arrangement has the advantages of extremely thick walls, including high weight per foot for drilling, and assembly stiffness, but does not introduce all drilling stresses directly to the expandable tubulars.

Alternatively, the casing is an expandable drill collar which has the advantages of extremely thick walls, including high weight per foot for drilling, and high tubular stiffness. These factors are useful and are applied to the advantages of expandable tubulars. The application concept utilizes and extends all advantages of conventional heavy-duty drilling assemblies, drilling with casing, and expandable tubulars into a robust expanded set.

In another embodiment, the tubular provides monodiameter drilling capabilities. In this embodiment, the tubular performs drilling with an integral expandable or expandable sleeve. The inventive monodiameter assembly overlap area, which attaches a new assembly to an existing one in the well, is simplified by its engagement geometry being formed integral to the ends of the assembly as simple, short length, complementary-shaped bevels. The drilling and forming of the overlap area is real-time in its delivery. Alternatively, the conventional double-belled type sections are made integral to the natural expanded form of the tubular or can be obtained by subsequent mechanical operations, as is performed conventionally.

In an alternative embodiment, the inventive tubular includes non-overlap monodiameter drilling capabilities. The non-overlap monodiameter drilling is the same as typical monodiameter construction described above, but evolves the assembly seat area to a minimized length, better described as an abutment joint.

In an embodiment, the inventive tubular includes a discrete set drilling patch. The feature provides drilling capabilities with a minimization of overall well size. Conventional drilling needs for construction of joining assemblies to form long, continuous pressure vessels, which mostly protect marginal-problem sections or non-problem sections, are superseded by discrete placement primarily in serious problem zones. The technology's unique ability allowing control over longitudinal length during expansion allows for later insertion of expandable tubulars between individual tube pieces or assemblies previously set. The same is true for installation between milled sections of existing casings or screens.

In another embodiment, the inventive tubular can be used to drill the borehole and then installed in the borehole as a single operation. This dual functionality establishes true 'one-trip well' capability, where certain sections of wells are drilled and constructed. These one-trip wells use one-time tripping of drilling or casing assemblies by integrating them with drilling processes, mechanical expansion tooling or integrating sealants and other systems into the various products or drilling assemblies. In this embodiment, the invention provides for the concept of 'no-trip' by providing drilling capability, expansion potential inherent, integration of sealing and other features.

The inventive expandable tubular can also be equipped with various signal features. Intelligent Well Technology integration—is a unique capability of the invention which allows integration of delicate circuitry, fiber optics, sensors, wireless hardware, and various other components into expandables due to the non-destructive nature of the expansion and the use of multiple, relatively flat members to which electronic and other systems can be economically laminated and supplied in redundant format.

In an embodiment, the inventive system can be used as porous patches, used to act as well bore matting to collect lost-circulation materials or cement or other materials as they would otherwise flow outward into low-pressure formations. With an elastically biased borehole lining, solids contained in these fluids are partly caught and build filter cake due to small orifice or tapered aperture geometry. In many drilling operations, merely slowing down fluid losses to acceptable rates is considered a significant capability. Previous industry success in the area has been limited because of use of slotted liners, which have excessive span between apertures. When the porosity is too great, building effective seals becomes infeasible. In the case of self-expansion, thin-walled porous tubulars can also be efficiently deployed against marginal fluid loss zones. The concept can be similarly applied to stabilize sloughing geology or to stabilize a kickoff point, such as when initiating directional drilling or forming windows for the purposes of directional drilling.

With reference to FIG. 19, the leaves 531 can include porous surfaces that include a plurality of slots 621 and/or holes 623. In an embodiment, these slots 621 and holes 623 may be sealed temporarily with a sealing agent 625. The sealing agents 625 may be required for the casings to facilitate installation. With the sealing agents 625, the casing functions as a pressure vessel and can be expanded and used like a normal sealed tubular. Once the non-porous casing is inserted into the borehole, the sealing agent 625 can be removed so that leaf surfaces 531 become porous and fluids can pass through the slots 621 and holes 623. The sealing agents 625 can include bursting agents that are actuated to remove the sealing agents 625 to clear the slots 621 and/or holes 623. The bursting agents are actuated when exposed to increased hydraulic pressure, explosive pressure or other forces. In other embodiments, the sealing agents 625 can be a dissolving agent that dissolves when exposed to a specific type of fluid such as water, solvents, oil or gas. With the sealing agents 625 removed, the solid surface porous surface.

The porous tubular sections have special purposes. In an embodiment, a tubular is placed in a cavernous space that requires peripheral sealing and stability. Once installed, the sealing agents 625 are removed from the slots 621 and/or holes 623. With the slots 621 and/or holes 623 cleared, sealant can be pumped into the casing and the sealant can flow laterally through the casing leaves between the borehole and the casing. Various sealants can be used including adhesives, epoxies, cement, and other materials that can transition from a liquid into a strong solid sealant. The cement can pass through the porous surface and fill the space between the casing and the bore hole walls. The cement then hardens which stabilizes and seals the casing within the borehole.

A low temperature metal bonding method has many advantages. There are various low temperature bonding methods including soldering and brazing. These low temperature bonding methods also have advantages over adhesive bonds. Solder has a higher shear strength bond bond-shear values than any adhesive. While the surface conditions for a perfect solder connection should be clean, they do not necessarily need to be pristine. The soldering process is reversible and can be removed simply by heating the solder material to its melting point and separating the components. Because the tunable, low temperature is below the melting temperature of the components, the mechanical properties of the components are not altered or diminished. In contrast to most adhesives, the solder has excellent elasticity which improves the bond strength since the bond will move under stress rather than break. Solder flows everywhere with varied rheology. Solder is also deformable, if necessary.

In various embodiments, the inventive tubular structure is held together by a reversible mechanism that can bond and release the curved layer components. The bonding material can include: metal such as solder, glue, plastic, elastomer or similar type bonding compounds. The bonding component may transition between a liquid and a solid. For example, it may be activated to bond by temperature, chemical, light exposure or other activation means.

In an embodiment, the inventive tubular assembly may include alternating layers of spring-sleeves and hard plastic-magnesium (Mg) or other laminations. This incorporation of plastics may improve the expansion and contraction by providing a lubricated sliding surface. During the compression and expansion of the tubular structure, the layers slide against each other. If the layer materials have a soft surface, they may scratch the adjacent layer. The scratching forms rough surfaces that prevents the smooth expansion and contraction. By inserting the plastic layers between the metal layers, the softer plastic provides a smooth sliding material that functions as a lubricant for the metal layers. The plastic may also provide an adhesive material to bond the metal layers in their final expanded positions.

In addition to plastic and magnesium, a weld material may also be incorporated into the assembly to joint the adjacent layers of the magnesium layers. During a combustion reaction, a chemical conversion typically takes place that produces heat and pressure. In an embodiment, such an ignition in the center area of the tubular assembly can cause the tubular assembly to expand in diameter from the internal pressure, the weld points to fuse due to the internal heat and the plastic to soften and flow into the spaces between the metal layers sealing the tubular assembly from leaks during use. In an embodiment, one or more of the described actions of expansion, welding and plastic flow can be achieved with a single ignition that fires the securing welds and Mg layers, thus also softening flowing material, e.g., plastic that may be subjected to high hydrostatic-pressure.

The magnesium used as exothermic bond material may be deposited in the desired locations such as grooves formed in the layers through a coating process. These grooves may then be closed through mechanical compression. In addition to magnesium in the grooves it is also possible to place an energy producing material in the grooves such as rocket fuel, flammable gas, plastic explosive and other explosive materials. The ignition of these materials can be a means for expanding the tubular structure by opening the device—forcing local grooves open; partially terminate grooves to trap desired energy. The hot, flowable material goes where it is needed or where forced, filling voids. The material then cools and hardens after a definable amount of time. The flowable material is held in place longitudinally in the same manner that cement slurry stays in position in wells. Taper geometry helps channel the material into the desired locations. For example, the soft, flowing material may harden to seal both the ratchet and end or joint seals. In other embodiments, the flowable material may be used as an augmentative scheme with surface fill, pore-filling or to make the device more rigid. The hardened material may be used to stabilize the tubular device within the borehole. The material can be applied to the outer-most layer, not affected by grooves flows into major gap. The flowable material flows into voids and is held in the desired spaces by hydrostatic pressure and cohesion. The flowable material may also be used to improve the compression strength of the tubular and not necessarily be used for bonding.

In an alternative embodiment, the bonding of the layers is mechanical, through ratchets and limiters. Because auxiliary materials are not emphasized, contamination issues are minimized. Some additional and coincidental bonds may occur as an auxiliary bonding system, such as razor-galling.

This embodiment may be further modified by laminating highly ductile metals, such as lead, between the ratchet protrusions. Mechanical force causes the materials to flow as described above, except by mechanical force. The dry seal becomes both seal and partial device integrity element, or effective bond. The material is forced to the spring edges into recesses, forming solid metal seals. Bonds are effected by galling, friction, limit-strain hardening/surficial changes.

Mathematical formulas can be used to predict the mechanics of the split pipe designs in regards to the compression and subsequent expansion of individual layers. The strength of the assemblies also involves relatively straightforward calculations. The cross section of a split pipe layer can be treated as a curved beam. Two-dimensional analysis is used for all calculations as the strength and bending properties assumed not to vary axially. A moment is applied to the beam to change its angle of rotation and, hence, its radius of curvature. The equations presented in this section were considered valid for beams in which the radius is more than ten times the wall thickness. This thin-walled assumption can be applied to all split pipe concepts contemplated.

A primary point of interest in the design and analysis of split pipe geometry is the reduction in diameter possible for a given piping configuration. The deflection of a curved beam can be analyzed by studying the strain energy of the system, which is the amount of potential energy stored in a body as a result of elastic deformation. The strain energy, U, is related to the applied moment, material properties, and beam geometry by $$U = \int \frac{M^2 R}{2EI} d\theta \qquad \text{Equation 1.1}$$

M is the applied moment, R is the initial radius of curvature of the beam, E is the elastic modulus of the beam material, and θ is the angle of the beam. The area moment of inertia, I, is related to the cross sectional area by $$I = \int y^2 dA_c \qquad \text{Equation 1.2}$$

With reference to FIG. 22, for a rectangular cross section with height t and width b the area moment of inertia is $$I = \frac{bt^3}{12} \qquad \text{Equation 1.3}$$

For the split pipe geometry, the wall thickness of an individual layer was used for t. A unit length was assigned to b as the deflection properties were assumed not to vary axially down the length of split pipe. The change in beam angle was defined by the following relationship $$\Delta\theta = \frac{\partial U}{\partial M} = \frac{MR}{EI} \int d\theta \qquad \text{Equation 1.4}$$

This equation serves as the basis for analysis of split pipe geometry. This relationship yields the following relationship between the initial and final diameters of a layer of expandable casing $$D_{expanded} = \frac{D_{compressed}}{1 + \frac{D_{compressed}\sigma_y}{Et}} \qquad \text{Equation 1.5}$$

The yield stress of the split pipe material is noted as $\sigma_y$. This equation shows that the radius of curvature is governed exclusively by the material properties and the geometry of the beam. In addition to being able to calculate the compression and expansion of the split pipe, it is also desired to evaluate the structural integrity of the design under various applied and environment-induced loads. The burst and collapse strength of the casing was identified as a critical parameter for well bore use. The wall strength can be analyzed by evaluating the hoop stress of a thin-walled cylinder with $$P = \frac{2\sigma_y t}{D} \qquad \text{Equation 1.6}$$

As casing is being run into the well bore, several thousand feet of pipe may be suspended, forcing the casing to hold significant axial loads. The maximum non-yielding axial load that a layer of split pipe with cross-sectional area $A_c$, can support is $$F_A = \sigma_y A_c \qquad \text{Equation 1.7}$$

During deployment of the split pipe, no complete bonds between layers are set. Thus, each layer has to individually support its own weight in addition to loads transferred to the casing from surface operations. The primary mode of failure for the bond in a split pipe configuration is shear loading imposed by the hoop forces of each metal layer. The shear stress on the bond can be approximated as $$\tau \approx \frac{2P}{f(N-1)\theta} \quad \text{Equation 1.8}$$

P is the applied burst or collapse pressure, f is the fraction of area that is actually bonded, θ is the angle over half of the split pipe, and N is the number of split pipe layers that are inducing the shear load. This relationship is an approximation and does not account for end effects or reduced areas due to circumferential gaps in material.

A set of analysis guidelines was developed to evaluate the various split pipe designs and put constraints on the implications from the equations above. The structural analysis of the concepts was limited to the actual split pipe members. In oil field applications where casings are flush with the bore wall or a cement layer, the bust strength of the casing would be increased. However, such an advantage is not assumed in any of the analyses presented in this report. Likewise, the use of internal bore pressure to aid in casing expansion has not been taken into account.

Tubulars are often placed in environment with elevated temperature and exposed to corrosive substances such as hydrogen sulfide. Such extreme environmental conditions have been considered in the selection of materials and other design requirements. If such environmental conditions exist, the calculations of mechanical properties performed must account for material strength degradation due to corrosion and temperature.

For the purposes of material strength calculations, carbon steel used to fabricate the casings may have an elastic modulus of 30,000 ksi and a material density of 0.283 lb/in$^3$. Different grades of carbon steel and other materials will have different mechanical properties that must be accounted for in designing the inventive casings.

In addition to the mathematical formulas that are used determine the strength of the casings, the design can also be evaluated using finite element analysis (FEA). FEA can be performed on any split pipe configuration with varying number of walled layers and thicknesses for each of the walls. The primary design constraint is the ability of the compressed casing to fit within the inner diameter of an expanded casing with certain clearances. The compression of the outermost layer governs the compressed diameters of the other layers. The maximum change in diameter of the layers is then calculated to determine if the layers are able to push on the outer adjoining layer after expansion of the casing. Once a set of layers is determined to comply with the dimensional design requirements, a strength analysis is performed to determine if the casings meet the physicals strength requirements. FEA is used as a check of the analytical strength calculations.

To accomplish the mechanical design objective of a casing having a compressed outer diameter smaller than the expanded inner diameter, the outer diameter of the casing must be compressed. The required compression is evaluated by bending individual layers to produce a change in the casing diameter. The equations describing the bending are shown above. As discussed, a moment M is applied to the free ends of a layer in the FEA simulations. A representative FEA stress plot is shown in a two-dimensional cross section. Unless noted otherwise, all presented FEA stress results are Von-Mises equivalent stresses. The FEA results should correspond closely with the calculations specified above. The maximum stress occurs in the inner areas of the casing, which is the fundamental implication of the equations above. A key design assumption of the calculations is that the compression of a layer does not result in plastic deformation of the casing. The actual casing designs incorporate safety factors.

In the preferred embodiment, the inventive tubular structure must result in a device that is able to (i) exhibit elastic response throughout its range of deformation; (ii) must be able to robustly and smoothly compress and expand with controllable friction effects; (iii) must be automatically self-locating between its leaves (or layers); (iv) must admit to the inclusion of securing mechanisms for both limiting the range of expansion under internal pressure as well as locking to prevent re-compression under external pressure; (v) must permit the inclusion of mechanisms for sealing against both unbalanced internal and external pressure; and, (vi) finally, must satisfy critical expansion ratio, burst, collapse, sealing, tensile strength, buckling, and torsion compliance requirements.

Analytical solutions for thick-walled cylindrical vessels under internal and external loading were used to establish nominal dimensions for the inventive tubular structure when it is subjected to design burst and collapse pressures of 6,000 psi. The solutions assumed that the tubular has a cylindrical cross-section. In addition to the design pressures of 6000 psi for both burst and collapse, material yield stress was assumed at 110,000 psi when carrying out the computations indicated below.

The following formula addresses uniform internal radial pressure, q lb/in$^2$, under zero or externally balanced longitudinal pressure, was used to estimate the required nominal thickness required for the Microhole Tubing section to satisfy the 6,000 psi burst requirement.

$$\text{Max}\sigma_2 = q\left(\frac{a^2+b^2}{a^2-b^2}\right) \quad \text{Equation 2.1}$$

Assuming

Max $\sigma_2$=110,000 psi q=6,000 psi (where the pressure q is assumed acting on the internal radius b) we solve equation 2.1 for b to obtain $$b = \sqrt{\left(\frac{\text{Max}\sigma_2 - q}{\text{Max}\sigma_2 + q}\right)}\,a \quad \text{Equation 2.2}$$

$$= \sqrt{\frac{26}{29}}\,a$$

Implementing equation 2.3. the estimated required thickness $t_{burst}$ to protect against burst is given by $$t_{burst} = a - b \quad \text{Equation 2.3}$$

$$= (1-\sqrt{26/29})a$$

$$= 0.10627'' \text{ if } a = 2.000''$$

$$= 0.11291'' \text{ if } a = 2.125''$$

consistent with the desired 4.25 inch diameter tubing.

The following formula addresses uniform external radial pressure, q lb/in$^2$, under zero or externally balanced longitudinal pressure, was used to estimate the required nominal thickness required for the Microhole Tubing section to satisfy the 6,000 psi collapse requirement.

$$\text{Max}\sigma_2 = \frac{-2qa^2}{a^2 - b^2} \quad \text{Equation 2.4}$$

Assuming

Max $\sigma_2$=−110,000 psi q=6,000 psi (where the pressure q is assumed acting on the external radius b) we solve equation 2.4 for b to obtain $$b = \sqrt{\left(\frac{\text{Max}\sigma_2 + 2q}{\text{Max}\sigma_2}\right)} a = \sqrt{\frac{49}{55}} a \quad \text{Equation 2.5}$$

Implementing equation 2.5, the estimated required thickness $t_{collapse}$ to protect against burst is given by $$t_{collapse} = a - b = (1 - \sqrt{49/55})a = 0.11224'' \text{ if } a = 2.000'' = 0.11926'' \text{ if } a = 2.125'' \quad \text{Equation 2.6}$$

The results provided in the equations above indicate that the maximum thickness calculated was the thickness for the collapse case at a=2.125"; i.e. $t_{collapse}$=0.11926". Rounding this value up to provide a margin of safety appropriate to the development of a multi-layer tubular system. In an embodiment, the design thickness value, $t_{design}$=0.175"

The actual structural thickness of the spiral casing section $t_{effective}$ is given by $$t_{structural} = t_{design} + t_{outer} + t_{inner} \quad \text{Equation 2.7}$$

$t_{outer}$ = assumed thickness of the outer sealing/retaining jacket = 0.050"

$t_{inner}$ = assumed thickness of the inner sealing/retaining jacket = 0.050"

Implementing Equation 2.7, the effective section thickness $t_{eff}$ becomes $$t_{effective} = t_{structural} + t_{drift} \quad \text{Equation 2.8}$$

$t_{drift}$ = assumed drift thickness = 0.125"

Thus, the effective section thickness for design and component sizing purposes is given by $t_{effective}$=0.400". Since $t_{effective}$ has been set at 0.400" the deployed radius is 2.00" and the inner compressed effective radius the component being run in the hole must clear is (2.000"−0.400"), or 1.60". Thus, the spiral casing section must be able to be elastically compressed, during the manufacturing process, from a nominally stress free, as-manufactured outer diameter of 4.25" to a compressed "run-in-hole diameter" of 3.20". Ultimately, providing for adequate safety margins, this condition imposes the need for implementing a total of twelve 0.029 inch thick leaves in the design of an spiral core of the monobore casing device.

In the preferred embodiment, the tubular consists of identical and matching curved spiral leaves, which are arranged at fixed angular intervals around the tubular centerline. Different wall thicknesses can be obtained by either increasing the angular spans of the spiral leaves, or by increasing the number of leaves. This property means that spiral leaves with angular spans less than or greater than 180 degrees, can nevertheless be designed and arranged to produce collapsible tubulars with any diameter and wall thickness. Moreover, any leaf thickness can be used so that the requirement for greater diameter compression can always be enabled by simply using thinner spiral leaves or by increasing leaf material yield properties.

The individual leaves of the structure may have a thickness of 0.029 inches, and the design has been configured to both satisfy the required drift clearance and the required collapse and burst pressures. As such, this twelve-leaf configuration is capable of satisfying the previously established requirement that it be able to be elastically compressed from an as-manufactured outer diameter of 4.25" to a compressed "run-in-hole diameter" of 3.20". The maximum strain in the compressed state is 0.0023 comfortably within the material yield strain of 0.004.

The spiral forms allow nesting of leaves of constant thickness. Since the leaves have radii of curvature increasing continuously from the outside of the tubular to the inside, and during compression the radii variation will increase as the diameter decreases the wall thickness increases, then the bending strain will be largest at the inner diameter and will decrease towards the outer diameter. For example, at the maximum compression, the strain at the outermost point of the leaves is only 0.00230, considerably less than the maximum allowable 0.004. This arrangement will therefore not allow the largest possible diameter decrease, which would only occur if all of the leaves are strained to the same maximum amounts.

A design concept optimized to allow for absolute maximum tubular diameter reduction is based on the geometry of spirals, which can continually decrease in thickness from the outside to the inside diameters and still nest together to provide an assembled 'iris' arrangement. Design programs provide spiral layouts for any choice of the numbers of equivalently spaced leaves, the leaf thicknesses, and the leaf angular spans.

Another aspect of the inventive tubular structure is the locking of the tubes in both the pre-installation compressed state and in-ground expanded or deployed state. For the compressed state, the amount of locking is to allow the tubulars to be held in the compressed states and to withstand the stresses of shipping and lowering into the ground. For the expanded state, the locking mechanisms must withstand very high internal and external pressures without collapsing or bursting.

Friction between the spiral layers plays a major role in enabling these locking modes. Because the separated leaves of the novel spiral design concept all interlock from the outer diameter to the inner diameter, any internal or external pressure applied to the assembly can produce an exponential friction build-up through the leaf interfaces. This mechanically advantageous behavior occurs even when the surfaces of a spiral are very smooth and just the application of slight compression between layers results in a 'locked' tubular assembly.

To further enhance the mechanical friction between the layers, an external pattern of 'fish scale' type surface features may be formed on the tubular leaves, which would interlock mechanically with adjacent layers when the tubular structure is under pressure. It is recognized that when a high enough coefficient of friction is induced between the layers, then only modestly robust locking mechanisms on the inner and outer diameters are needed to provide the required radial strength to meet the design strength requirements.

In another embodiment, the hardened steel surfaces are plasma sprayed with a layer of ceramic or hard mineral particles to produce extremely high friction conditions. In an embodiment, hard, fine sand is sprayed onto sectional surfaces of tubes. Two hard particle coated surfaces in contact will lock completely in every planar direction. In the high-friction areas, the surfaces would be coated with long-chain alcohol waxes to facilitate sliding during compression and subsequent in-ground expansion. The alcohol would then be removed thermally at tunable temperatures, starting about 100 degrees C. Once the wax is melted away, the surfaces are brought into contact creating the self locking surfaces. Alternatively, axial bands of sprayed ceramic or mineral powder are interspersed with waxed bands without the sprayed powder. The high friction bands would then come into contact during in-ground expansion to both arrest farther expansion beyond the required deployed diameter, and to prevent subsequent diameter reduction.

The complete tubular system includes a structural core assembly of numerous spiral leaves sandwiched between external and internal composite rubber jackets. This system is designed to take advantage of both the excellent sealing characteristics of elastomer as well as its highly nonlinear stress-strain response under loading.

With respect to its constitutive behavior, elastomer is a nearly incompressible material that can undergo large deformations and strains without apparent change in volume. In tension, the elastomer first softens then stiffens significantly. In compression, the elastomer stiffens dramatically almost immediately. The nonlinear constitutive response of elastomer is well suited for implementation in the design of both the inner and outer jackets of the inventive tubular. Because the elastomer stiffens in response under large elastic straining, in both tension and compression, it enhances the ability of the inventive tubular to lock the jacket and spiral core against external burst and collapse pressures.

Beyond the sealing capacity they offer, the primary structural functions of the internal and external Jackets in the inventive tubular system are insuring that the device remains integral during loading. The internal and external jackets also assist in the generation of sufficient compressive normal force to insure engagement of inter-leaf friction mechanisms during torsion and tensile loading. It should also be noted that during the entire range of operation of the tubular system, from its compressed to its expanded state, the inner and outer jackets keep the layers of the system compressed together. This compressed pre-stress state allows the ratchet mechanism to be engaged and helps to insure that the anti-collapse mechanism will function. Without a compression mechanism, the layers may become separated and the ratchet mechanisms may disengage and fail to keep the casing in the expanded state.

In a manufacturing context, the external jacket can be slipped over the compressed and secured spiral core assembly, with the structural response of the device being tuned to provide sufficient initial radial stiffness in order to keep the spiral core assembly compressed prior to deployment. During expansion under applied internal pressure, the load-deformation response of the external jacket is tuned such that the jacket stiffens significantly at a specified diameter. If the elastomer properties alone are not capable of securing the device in its expanded state, the outer jacket design may have a composite elastomer/metal or fibrous configuration.

During the assembly of the inventive Tubular system, the internal elastomer jacket is uniformly compressed radially to a small enough radius to allow its insertion into the compressed and secured jacket/spiral core. The internal jacket is released after insertion and is allowed to expand against, and apply pressure to, the inside of the compressed spiral core. Again, this action would serve to pre-stress the compressed tubular device. The internal jacket design provides a wedging action, directed against the interior surfaces of the leaves comprising the iris spiral core, which prevents re-compression of the device after expansion to its full deployment condition.

In an embodiment, nonlinear finite element analysis is used to determine the forces required to compress a ten-leaf spiral core of the interleave/leaf spring device from its as-manufactured outer diameter to its compressed run-in-hole diameter. A robust, stable, nonlinear analysis solution scheme was developed for carrying out the two-dimensional plane strain nonlinear finite element structural analysis of a ten-leaf iris-type interleave/leaf spring casing configuration in both compression and expansion phases. A solution scheme was also developed to estimate the forces required to compress the spiral core of the interleave/leaf spring device from its as-manufactured outer diameter to its compressed run-in-hole diameter as well as various other force requirements. The system solves the magnitude of the restraint forces that need to be generated by the external jacket in order to maintain the complete interleave/leaf spring device including both spiral core and interior jacket in their compressed configuration. The internal pressures required to re-expand, during deployment, the compressed complete interleave/leaf spring device from its compressed run-in-hole outer diameter to its desired deployed outer diameter can also be determined and tuned. The radial forces required to be supplied by the internal jacket in order to permit the system to remain integral while supporting design collapse pressures are also determined but must not be used as structural forces for system design calculations. The radial forces required to be supplied by the external jacket in order to permit the system to remain integral while supporting design burst collapse pressures are solved through the solution scheme Obtaining both the correct force values, as well as an estimate of the deformation field of the complete interleave/leaf spring device as these force systems are applied and functioning, is critical to the proper design of the external and internal jackets enclosing the spiral core. The solution scheme addressed in modeling implements a large displacement/large strain, elastic-plastic, contact with friction solution process for modeling both compressive and expansive load states of the tubular device. This scheme focuses on the analysis of a ten-leaf configuration.

In one embodiment, the compression of the iris like spiral core device down to its specified compressed outer diameter is accomplished by an imposed radial deformation field applied to the inside of a cylindrical, linear elastic, load-ring surrounding the device. The expansion of the ten-leaved device is then induced by ramping the imposed radial deformation field on the inside of the load-ring to zero. That is the contact device being used to effect structural interaction between the cylindrical load-ring and the finite element model of the ten-leaved device.

In an embodiment, the finite element mesh for the assembled ten-leaved device/load-ring system has a geometrically planar profile with each of the ten leaves of the spirals sweeping through a circumferential angle of 180 degrees and 2.125 inch outer radius. The ten-leaved device/load-ring system can be constructed using the ANSYS Plane182 element using bi-linear isotropic hardening plasticity, large deflection and large strain deformation, full integration of element matrices, pure plane strain conditions (i.e. zero strain in the z-direction) and pure displacement element formulation options.

There are two different types of contact implemented in this embodiment. First, is the interleave contact occurring between the layers of the device as they slide over one another during compression and expansion. Second is the contact that occurs between the outer surface of the ten-leaf device and the inner layer of the surrounding and confining load-ring casing.

In a loading compression scheme, the interleaved ten layer Self-Expandable tubular structure is first compressed, and then released for expansion in two distinct stages of loading. In Stage 1 the ten-leaved device is compressed from its unstressed nominal initial outer diameter of 4.25 inch to its reduced final outer diameter of 3.25 inch by an imposed radial displacement field applied to the inner surface (i.e. inner radius) of the load-ring enclosing the spiral core. The load-ring is a device for imposing a compressive radial displacement field on the outside of the enclosed spiral core. Reaction forces, which are obtained via post-processing solution results, are then used to estimate radial pressures acting on the spiral core elements during compression of the system. The implementation of an imposed displacement scheme to compress the casing, via the load-ring mechanism, acts as a solution stabilization effect as far as suppressing buckling and other critical point instability phenomena during the compression/contraction process.

The load-ring elastic modulus should be very small relative to the elastic modulus of the ASTM 4140 steel assumed to be used for the ten leaves, to prevent absorption of significant levels of strain energy during the load-deformation path. The load scheme encompasses the expansion of the ten-leaved device induced by ramping the imposed outer radial deformation on the outside of the load-ring to zero.

In an embodiment, the leaf surfaces are coated with metal particles through a metal deposition process. In this process, the coating metal is heated by laser plasma, electric arc plasma or an oxy acetylene fuel gas thermal spray. The hot metal coating material is applied to the leaf surfaces requiring coating. In an alternative embodiment, a very fine, hard mineral is applied to the leaf and coated the sand with a high temperature wax that melts at a temperature range of from 400° F. to 500° F. This process results in a durable fine sand coating.

Once the coating is applied to the leaves, they are suitable for assembly into the final form of the spiral based steel core. The leaves are assembled into the stress free iris-configuration by either welding or otherwise suitably bonding the leaf sections together at all predetermined connection points. In other embodiments, the leaves can be elastomerically bonded to each other.

Figure 25:
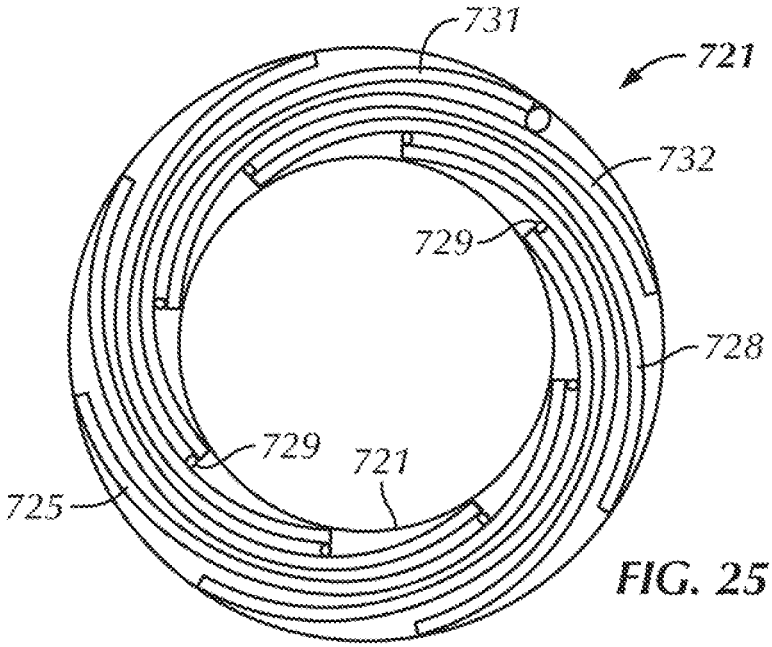
FIG. 25 is a cross section view of an eight leaf spiral casing.

With reference to FIG. 25, in an embodiment, the tubular structure 701 includes an inner elastomer jacket 721 and an outer elastomer jacket 723 that provide sealing of the structure. The final geometric, structural and material design specifications of the inner elastomer jacket 721 and outer elastomer jacket 723 can be derived from nonlinear finite element analysis results. Various compounds can be mixed to produce the desired sleeve characteristics. After the jackets 721, 723 are formed, they are assembled onto the leaf assembly 725 which includes a plurality of connection points 729 between adjacent leaves close to the inner diameter of the tubular structure 701. Various compounds can be mixed to produce the desired sleeve characteristics.

In an embodiment, the inner jacket 721 is a pre-loaded structural component that wedges the leaf assembly 725 into the expanded state and prevents recompression. The mechanism incorporates features onto the outer diameter of the inner jacket 721 that would not prevent expansion of the device as it is being deployed but would, due to structural interaction or engagement of its surface features with the inner edges of the iris-leaf assembly 725, wedge or jam the casing device if it attempts to re-compress after expansion.

The casing leaf assembly 725 is carefully compressed to the desired diameter and held in the compressed state using a system of multiple band clamps. Following compression of the device, the casing assembly 725 is then subjected to a multi-stage process. The leaves 731, 733 that are not permanently bonded in the forming phase would be temporarily bonded by a restraining mechanism 741. Possible restraining mechanism 741 include solder, braze, epoxy, weld, and other bonding methods to cause the casing assembly 725 to temporarily remain in its compressed state. The restraining mechanism 741 can be a band that runs around the circumference of the casing. This may be ineffective if the band increases the device diameter when minimal outer diameter is desired.

In another embodiment, the restraining mechanisms 741 may include tabs that are formed in the layers that engage other layers to hold the casing in the compressed state. The tabs may be trapezoidal shape and may be laser cut from the layer. The casing may be compressed and the tabs may be welded to other layers to hold the casing in the compressed state. To release the compression mechanism, the weld or the tab is broken.

The elastomeric jacket 723 can be placed over the assembly 725 prior to compression or after compression. In an embodiment, the composite-elastomeric outer jacket 723 has a highly nonlinear load-deformation response and provides a radial restraint to keep the compressed casing in its normal compressed configuration. By taking advantage of the extreme stiffening response of the composite-elastomers in the large strain regime, the jacket 723 provides resistance to expansion beyond the desired nominal deployed expanded radius. The jacket 723 also provides an outer seal on the deployed tubing device. The radially compressed inner composite elastic jacket 721 is inserted to fit into the middle of the compressed Iris-casing assembly 725. As indicated above, the inner jacket 721 would have been designed with the purposes of keeping the assembled jacket/core system 701 integral during loading, providing an internal pressure (fluid) seal and preventing recompression after expansion.

After expansion, recompression can be prevented by various methods. In an embodiment, a mechanism preventing recompression is the expanded thin inner composite elastomer jacket 721. Another mechanism preventing re-compression and further expansion centers is a ceramic powder or fine sand which was applied to the surface of the leaves that are in contact with the adjacent leaves. The powder or sand coating is then covered by a long chain alcohol based material or wax. A ceramic powder or sand applied to the leaves provides a significant friction surface to prevent recompression or over-expansion of the expanded loaded device. The long chain alcohol or wax covering the ceramic powder or sand minimizes friction during the manufacturing and initial deployment processes. Once the casing assembly 725 has been expanded, heat is applied to melt, boil or other wise remove long chain alcohol or wax, and thereby activate the friction mechanism generated from the interleaf contact.

Figure 26:
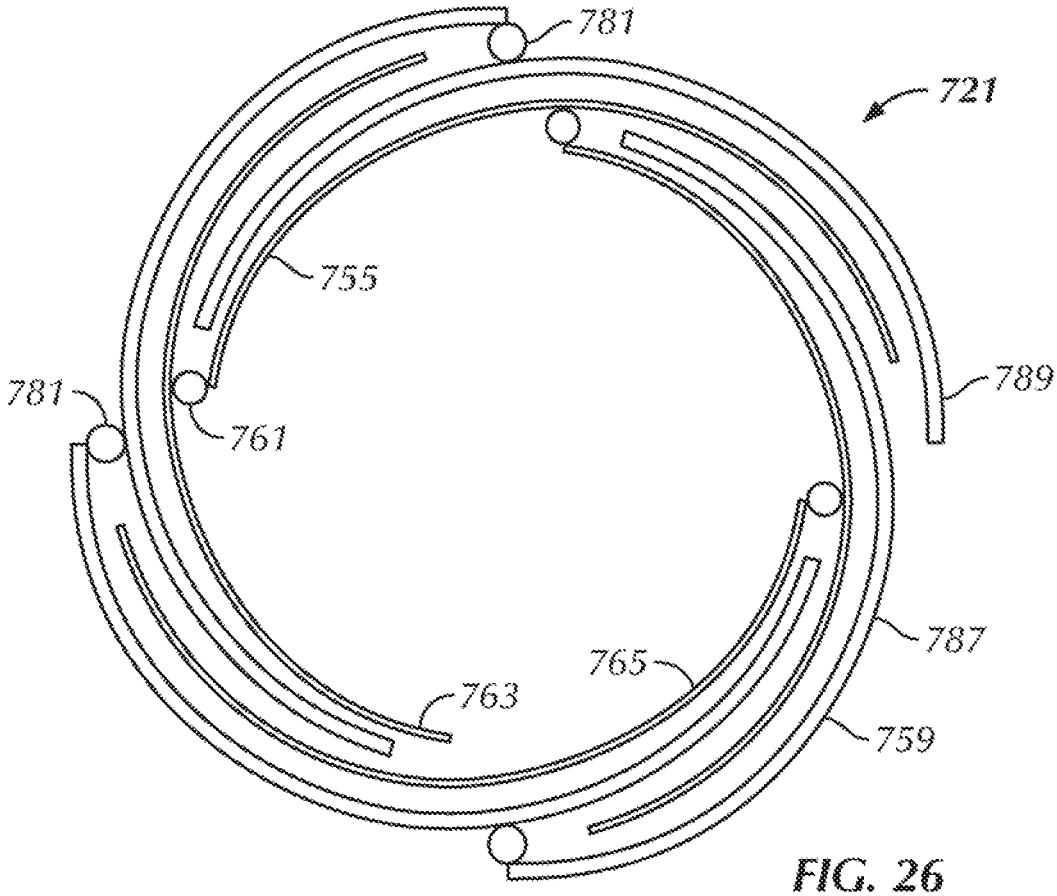
FIG. 26 is a cross section of a casing having messed inner and outer leaf assemblies.

In other embodiments, the spiral structure disclosed with reference to FIG. 25, can be configured In multiple concentric layers. With reference to FIG. 26, a casing 751 is illustrated that has an inner spiral leaf assembly 755 that is mounted in a meshed manner within an outer spiral leaf assembly 759. In this embodiment, the inner spiral assembly 755 and the outer spiral assembly 759 function similarly to the concentric tubular layers illustrated En FIGS. 1, 2 and 3. The inner spiral assembly 755 includes a plurality of connection points 761 between adjacent leaves close to the inner diameter of the casing 751. A slip plane exists between two of the leaves 763, 765 on the upper left side of the inner spiral assembly 755. A weak temporary bond or other compression mechanism may be applied between the slip plane leaves 763, 765 to hold the inner spiral assembly 755 in a smaller delivery diameter. The compression bond is broken to allow the casing 751 to expand during installation.

The outer spiral leaf assembly 759 is similar to the inner spiral assembly 755 but has a larger diameter and connections points 781 close to the outer diameter of the casing 751. The connection points 781 join the adjacent leaves and are used to form the annular spiral assembly. The slip plane of the outer spiral assembly 759 is between two layers 787, 789 on the lower right side of the casing 751. A breakable connection or other compression device may be applied between the slip plane layers 787, 789 that holds the outer spiral assembly 759 in the smaller diameter. The temporary bond is broken to allow outer spiral assembly 759 and the casing 751 to expand. Although the temporary welds can be used as compression mechanisms that temporarily hold the spiral assemblies in the compressed state, any other mechanism can be used, including a breakable band, ratchet mechanisms, tabs, or any other coupling mechanisms. The connection points 761 and 781 may be long solid welds that prevent fluid flow between the leaves and help to seal the casing 751. The slip planes of the inner assembly 755 and the outer assembly 759 are preferably placed at opposite side of the casing. This makes a leak path from the inner diameter to the outer diameter very long. Any fluid that enters the slip plane in the inner assembly 755 must flow in a convoluted path around the casing to the slip plane on the opposite side of the outer assembly 759.

Figure 27:
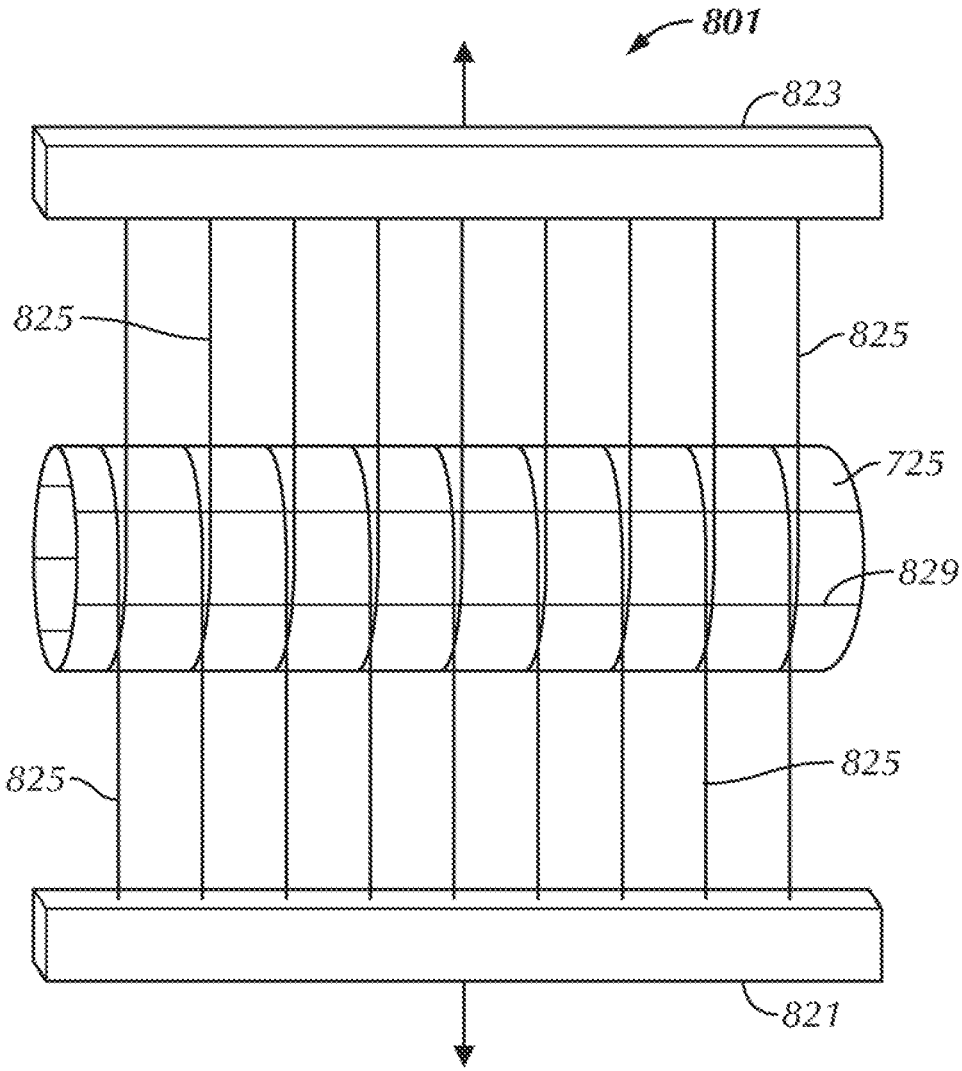
FIG. 27 is a compression mechanism used with the inventive casing.

With reference to FIG. 27, an embodiment of a compression device 801 is illustrated. The compression device 801 includes a lower beam 821 and an upper beam 823 and a plurality of tension members 825. The tension members 825 are wrapped around the casing leaf assembly 725 and the ends of the tension members 825 are coupled to the lower beam 821 and the upper beam 823. By pulling the lower beam 821 and the upper beam 823 apart, the tension members 825 are pulled and the casing 725 is compressed. Although the compression device 801 is shown in a vertical orientation, it can also be oriented horizontally. In the vertical orientation, a support device should be used to prevent the casing 725 from sliding down and away from the center of the tension members 825.

As discussed above with reference to FIG. 25, the casing 831 may have a sliding plane 829 between two of the leaves. The efficiency of the casing compression may be maximized by placing the sliding plane close so the area where the tension members 825 are tangent to the outer diameter. This will minimize the sliding of the tension members 825 across the casing 831.

The equation used to achieve this spiral matching used in a spiral is:

$$R=R_0(1-k\theta) \qquad \text{Equation 3.1}$$

where $R_o$=outer radius, R=radius at angular position θ and k is a positive constant.

This has the attribute of constant thickness so that the leaves can be made from constant gage thickness metal strip stock. Moreover, prototypes can be made by cutting sheet metal stock to the required widths and then manufacturing short lengths in press forming operations.

If the thickness of the layers is constant value t, then for n leaves equi-spaced the spiral is radially inwards by amount t in 360/n degrees of revolution. Equivalently the pitch of the layout spiral should be nt per revolution. Changed to appropriate radian measure, constant k in Eq.(A1) should be set to $$k=nt/(2\pi) \qquad \text{Equation 3.2}$$

The inventive spiral leaf structure can be improved by altering the thickness of the leaves. If the leaves have constant thickness, their inner portions will be subjected to higher strain values than the outer portions by virtue of the fact that the radius of curvature of the leaves decreases from the outside to the inside. Thus, the inner sections of the leaves will reach yield while the outer portions retain the ability for further elastic straining. In order to increase the total radial compression amount it is therefore necessary to decrease the thickness of the leaves progressively from outside to inside. This can be achieved by forming the spirals from tapered strip, which simply decreases in thickness linearly from one edge to the other. However, this would have the disadvantage of producing spiral forms which no longer mate and seal perfectly. The alternative is to design the leaves along spiral forms. As the spiral layers converge closer together towards the center, they curve more sharply inward towards the center.

The equation defining the spiral casing is $R=R_0e^{-k\theta}$ where k is a positive constant for an inward curving spiral, and θ is the polar angle (angular position around the spiral). The leaf thickness at any point can be obtained by taking the difference of the radii values at angular positions on each side of the required thickness. For a spiral the value of k is 0.06453. This can readily be obtained from the equation for the required thickness at position zero. Namely, substituting $R_0$=6, and taking the difference in radii at angles 0 and 2π to be 2 inches gives $2(\text{inches})=6(1-e^{-k(2\pi)})$ which provides the required k value. The final leaf thickness can then be obtained in this case from $6(e^{-4\pi k}-e^{-6\pi k})=0.889$ inches.

For comparison, an eight leaf spiral layout with leaves having the same thickness of 0.5 inches at the outside, and each curving through 180 degrees. In this case each spiral must move inwards by 0.5 inches over a 45 degree arc from its beginning in order to accommodate the adjacent leaf. The equation to be solved for k in this case is $0.5=6(1-e^{-(\pi/4)k})$ which gives k equal to 0.1108. Note that this single number and the outer radius defines the entire layout. The inner thickness of the leaves in this case is given by $6(e^{-k\pi}-e^{-k(\pi+\pi/4)})=0.353$ inches.

It can be seen in this case, that because of the taper of the leaves the overall wall thickness has reduced significantly from the pure spiral layout. To achieve the same wall thickness we can increase either the angular span of the leaves, or increase the number of leaves. If the user wishes to increase the wall thickness while keeping the angular span fixed at 180 degrees, the number of leaves can simply be increased. For example, the number of leaves can be increased from eight to eleven. When the number of leaves is altered, it is desirable to change the spacing of the leaves so that the leaves are evenly distributed around the tubular and the number of leaves for any section of the tubular is substantially uniform.

As discussed above, the inventive casing leaf or leaves may have a micro-textured surfaces, that prevent sliding and causes the tubular to be locked in an expanded state after it has been deployed. In an embodiment, this texture is an abrasive pattern of protrusions and indentations formed in the metal surface using electron beams to reshape the metal surfaces of the leaves. Protrusions that rise from the surface of the material are formed in one surface while corresponding holes are formed in the adjacent material surface. Once assembled, the protrusions will engage the holes and secure the adjacent layers to each other.

Figure 28:
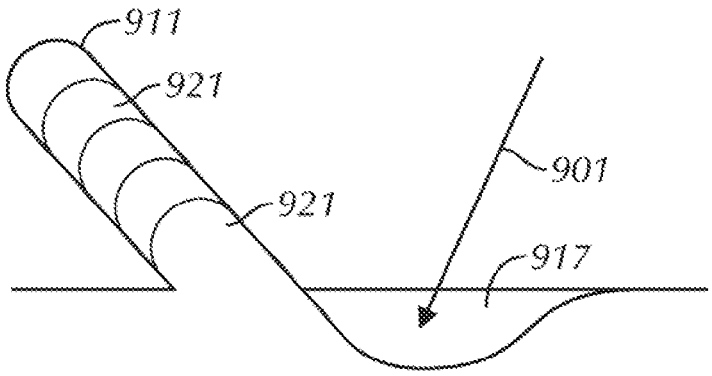
FIG. 28 is a side view of a surface protrusion fabricated with an electron beam.

With reference to FIG. 28, protrusions 911 are formed by an electron beam 901 that is controlled by a computer controller. As the electron beam is moved across the surface of a material it creates a pool 917of molten material. The energy causes the material to vaporize and it creates a pocket of pressurized vapor above the pool 917. The combined effect of the variance in surface tension in the pool 917 and the intensity of the vapor above the pool 917 causes the material to be displaced in the direction opposite to the electron beam. With each pass of the electron beam 917 more material is displaced to a common point forming a series of layers 921. After several passes of the electron beam 901, a protrusion begins to grow and rises out of the surface of the metal leaf. This process can be repeated with many protrusions 911 being formed at the same time so that the process results in patterns of many surface protrusions 911 distributed across the leaf. As illustrated, the angle of the protrusion 911 can also be controlled.

Figure 29:
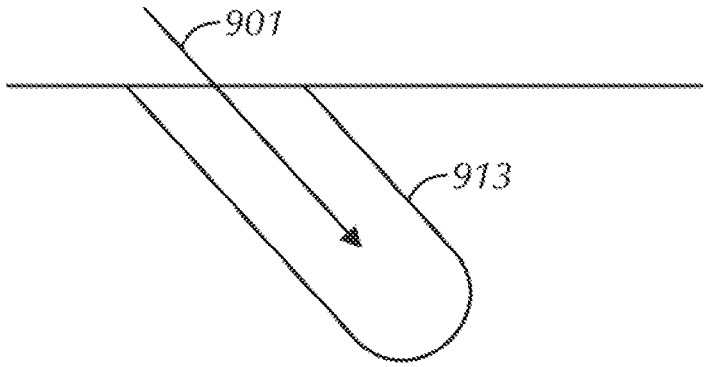
FIG. 29 is a side view of a surface hole fabricated with an electron beam.

With reference to FIG. 29, holes 913 can be formed using the same electron beam process. An electron beam 901 is directed towards the leaf and a creates a pool of molten material which is then removed. The beam 901 is returned to the hole 913 and additional material is removed. This process is repeated until the desired hole angle and depth are formed. Like the protrusions 911, the holes are formed by computer controlled electron beam that can fabricate many holes 913 simultaneously in any desired pattern. In addition to holes 913, wider slots may be formed using the same process.

Figure 30:
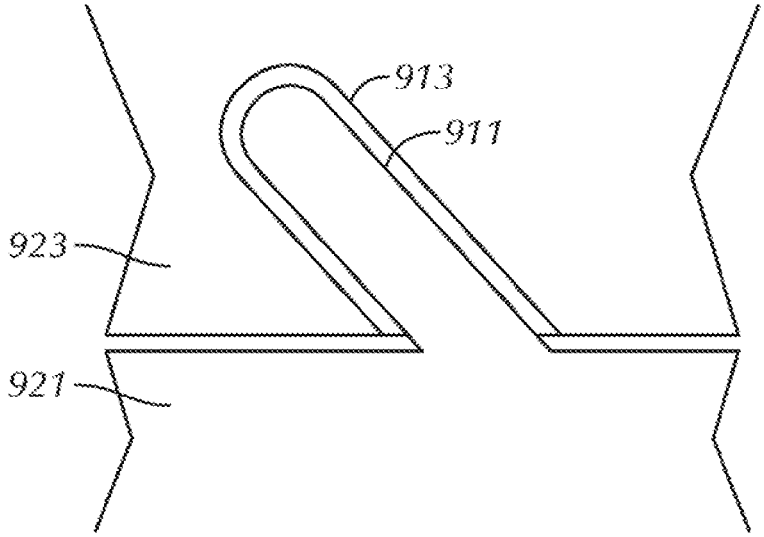
FIG. 30 is a cross section view of the surface protrusion coupled to the surface hole.

With reference to FIG. 30, the described protrusions 911 formed in a first surface 921 and holes 913 formed in an adjacent second surface 923 can be used in combination to form a locking expansion mechanism. Because the protrusions 911 and hole 913 are angled, the first surface 921 can move to the right and/or the second surface 923 can move towards the left. This movement causes the protrusion 911 to slide out of the hole 913. The protrusion 911 can then engage another hole that is farther towards the right in the second surface 923. In contrast, the first surface 291 cannot move towards the left relative to the second surface 923 as this motion would tend to drive the protrusion 911 further into the hole 9 13. Because the hole 913 does not release the protrusion 911, the first surface 291 can only move towards the right relative to the second surface 923.

As discussed, the inventive casing is compressed and inserted into an installation. Once properly positioned, the casing is expanded to a larger diameter and may engage the inner diameter of a borehole. In an embodiment, the expansion locking device can be the small surface protrusions 911 and holes 913 that are formed in adjacent surface of casing leaves. The protrusions 911 and holes 913 so that they are angled in the direction of the curvature of the leaves so that the allowed movement causes the casing diameter to expand and the restricted movement prevents the casing from contracting.

Figure 31:
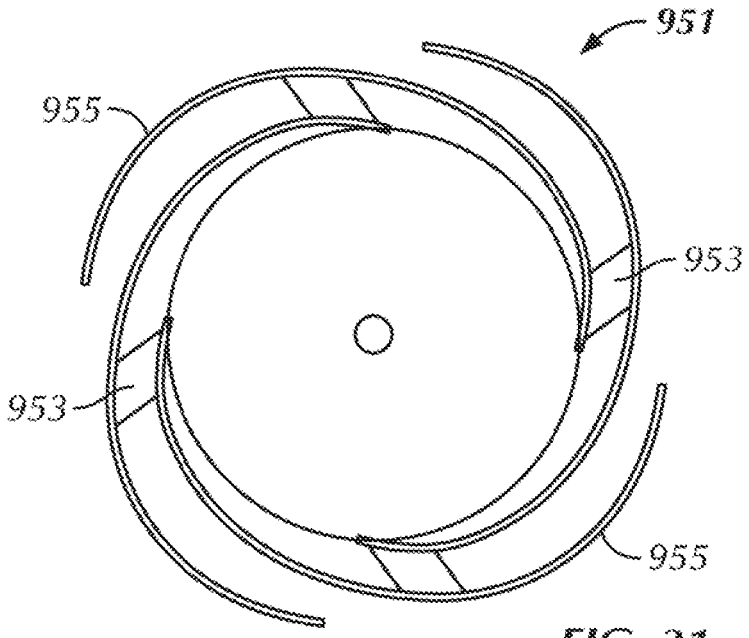
FIG. 31 is a cross section view of a compressed casing having elastomeric strips.
Figure 32:
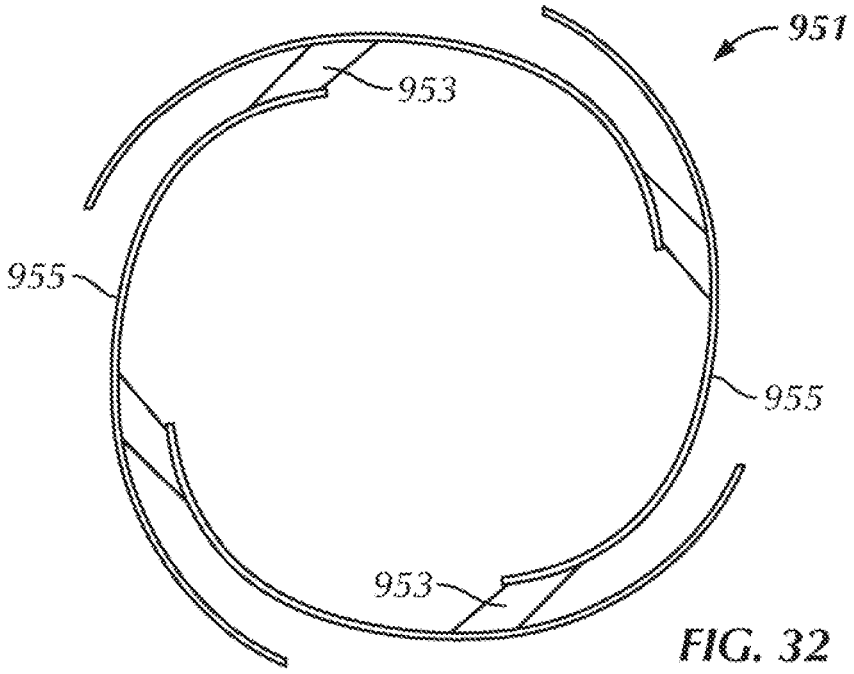
FIG. 32 is a cross section view of an expanded casing having elastomeric strips.

Although the inventive casing has been described as having welded attachment points that connect the leaves to form the casing, other coupling mechanisms can be used. With reference to FIGS. 31 and 32, cross sections of an embodiment of the casing 951 that uses elastomeric strips 953 between the leaves 955 are shown. The elastomeric strips 953 provide a seal between the leaves 955 and also are flexible so that the adjacent leaves 955 can move relative to each other. This flexibility allows the easing 951 to be compressed and expanded. The sliding movement of the leaves 955 results in a shear force that is applied to the elastomeric strips 953. FIG. 31 shows the casing 951 in the compressed state with the elastometic strips 953 angled inward from the outer surfaces. Because the elastometic strips 953 will tend to resist any deformation, external mechanisms may be required to hold the casing 951 in the expanded or compressed states. As discussed above, the casing 951 can be held in the compressed state with compression mechanisms such as temporary weld, bands, tabs and other retention devices. FIG. 32 shows the casing 951 in the expanded state with the elastomeric strips 953 angled outward from the outer surfaces. Because the casing 951 may resist this expansion, the leaves 955 can be held in the expanded with various expansion devices such as: ratchet mechanisms, micro surface textures, abrasives, jackets, or other expansion devices. FIGS. 31 and 32 are shown with the elastomer strips 953 in a larger that actual scale for illustrative purposes. The figures also show the leaves 955 as being uniform in thickness. In the preferred embodiment, the leaves 955 will taper from the outer diameter towards the inner diameter with the edge of the leaves 955 at the outer diameter of the casing 951 thicker than the edges at the inner diameter.

It will be understood that although the present invention has been described with reference to particular embodiments, additions, deletions and changes could be made to these embodiments, without departing from the scope of the present invention. Although a system has been described that includes various split tube piping components, it is well understood that these components and the described piping configuration can be modified and rearranged in various other configurations.

What is claimed is:

1. A tubular assembly for use in geologic structures, comprising:

a plurality of curved layers that each have a concave inner surface and a convex outer surface that are configured to overlap each other to form the tubular assembly having a circumference with an axis extending therethrough, a plurality of attachment points that secure some of the concave inner surfaces of the curved layers to the convex outer surfaces of adjacent curved layers to prevent the curved layers from moving circumferentially about the axis with respect to each other at the attachment points; and a restraining mechanism that temporarily holds the plurality of curved layers in a first diameter;

wherein the plurality of curved layers are made of a high strength material allowing the curved layers to store expansive energy therein and deflect so the tubular assembly expands from the first diameter to a second diameter that is larger than the first diameter when the restraining mechanism is released.

2. The tubular assembly of claim 1 wherein the tubular assembly expands to the second diameter when the restraining mechanism is released.

3. The expandable tubular assembly of claim 2 further comprising:

an expansion mechanism that prevents the diameter of the tubular assembly from being compressed smaller than the second diameter.

4. The expandable tubular assembly of claim 1 further comprising:

an expansion device that applies an expansive force to the inner concave inner surfaces of some of the curved layers and causes the plurality of curved layers to expand to a third diameter that is greater than the second diameter.

5. The expandable tubular assembly of claim 4 further comprising:

an expansion mechanism that prevents the diameter of the tubular assembly from being compressed smaller than the third diameter.

6. The expandable tubular assembly of claim 4 wherein the expansion force causes deformation of the plurality of curved layers such that the plurality of curved layers remains substantially in the third diameter when the expansion mechanism is removed.

7. The expandable tubular assembly of claim 1 wherein a first edge of the curved layers is thicker than a second edge.

8. The expandable tubular assembly of claim 1, further comprising:

a solid elastomer that is coupled between the concave inner surface and the convex outer surface of adjacent layers that allows the concave inner surface to slide a limited distance against the convex outer surface.

9. The expandable tubular assembly of claim 1, wherein the plurality of curved layers each have an inner edge that is exposed to an inner diameter of the tubular assembly and an outer edge that is exposed to an outer diameter of the tubular assembly.

10. The expandable tubular assembly of claim 1, wherein a first curved layer extends substantially around the tubular assembly compressed into the first diameter.

11. The expandable tubular assembly of claim 10, wherein the first curved layer overlaps itself.

12. The expandable tubular assembly of claim 10, wherein some of the curved layers are porous and function as sand screens.

13. The expandable tubular assembly of claim 10, wherein some of the curved layers include a plurality of pores and a bursting agent or a dissolving agent which is used to open the pores.

14. A tubular assembly for use in geologic structures, comprising:

a plurality of curved layers that each have a concave inner surface and a convex outer surface that are configured to overlap each other to form the tubular assembly having a circumference with an axis extending therethrough, wherein a portion of the concave inner surface forms a portion of an inner diameter of the tubular assembly and a portion of the convex outer surface forms a portion of the outer diameter of the tubular assembly;

a plurality of attachment points that secure some of the concave inner surfaces of the curved layers to the convex outer surfaces of adjacent curved layers to prevent the curved layers from moving circumferentially about the axis with respect to each other at the attachment points; and a restraining mechanism that temporarily holds the plurality of curved layers of the tubular assembly in a first diameter;

wherein the plurality of curved layers are made of a high strength material allowing the curved layers to store expansive energy therein and deflect so the tubular assembly expands from the first diameter to a second diameter that is larger than the first diameter when the restraining mechanism is released.

15. The tubular assembly of claim 14 wherein the tubular assembly expands to the second diameter when the restraining mechanism is released.

16. The expandable tubular assembly of claim 14 further comprising:

an expansion mechanism that prevents the diameter of the tubular assembly from being compressed smaller than the second diameter.

17. The expandable tubular assembly of claim 14 further comprising:

an expansion device that applies an expansive force to the inner concave inner surfaces of some of the curved layers and causes the plurality of curved layers to expand to the third diameter that is greater than the second diameter.

18. The expandable tubular assembly of claim 17 further comprising:

an expansion mechanism that prevents the diameter of the tubular assembly from being compressed smaller than the third diameter.

19. The expandable tubular assembly of claim 17 wherein the expansion force causes deformation of the plurality of curved layers such that the plurality of curved layers remains substantially in the third diameter when the expansion mechanism is removed.

20. The expandable tubular assembly of claim 14 wherein a first edge of the curved layers is thicker than a second edge.

21. The expandable tubular assembly of claim 14, further comprising:

a solid elastomer that is coupled between the concave inner surface and the convex outer surface of adjacent layers that allows the concave inner surface to slide a limited distance against the convex outer surface.

22. The expandable tubular assembly of claim 14, wherein a first curved layer extends substantially around the tubular assembly compressed into the first diameter.

23. The expandable tubular assembly of claim 22, wherein some of the curved layers are porous and function as sand screens.

24. The expandable tubular assembly of claim 14, wherein some of the curved layers include a plurality of pores and a bursting agent or a dissolving agent which is used to open the pores.

25. A tubular assembly for use in geologic structures, comprising:

a plurality of curved layers that each have a concave inner surface and a convex outer surface that are configured to overlap each other to form the tubular assembly having a circumference with an axis extending therethrough, wherein a portion of the concave inner surface forms a portion of an inner diameter of the tubular assembly and a portion of the convex outer surface forms a portion of the outer diameter of the tubular assembly;

a plurality of attachment points that secure some of the concave inner surfaces of the curved layers to the convex outer surfaces of adjacent curved layers to prevent the curved layers from moving circumferentially about the axis with respect to each other at the attachment points; and a sliding surface between the convex outer surface of a first curved layer and the concave surface of a second curved layer that is adjacent to the first curved layer;

wherein the plurality of curved layers form a spiral pattern and the plurality of curved layers are made of an elastic material allowing the curved layers to store expansive energy therein and deflect so the diameter of the tubular assembly expands from the first diameter to a second diameter that is larger than the first diameter.

26. The tubular assembly for use in geologic structures of claim 25, wherein some of the plurality of attachment points are located near the inner diameter of the tubular assembly.

27. The tubular assembly for use in geologic structures of claim 25, wherein some of the plurality of attachment points are located near the outer diameter of the tubular assembly.

28. The tubular assembly for use in geologic structures of claim 25, wherein a first group of the plurality of attachment points are located near the inner diameter of the tubular assembly and some of the plurality of attachment points are located near the outer diameter of the tubular assembly.

29. The tubular assembly for use in geologic structures of claim 25, wherein the plurality of curved layers have a first thickness at the inner diameter and a second thickness at the outer diameter wherein the second thickness is greater than the first thickness.

30. The tubular assembly for use in geologic structures of claim 25 further comprising:

an inner tube that is mounted within the inner diameter of the tubular assembly.

31. The tubular assembly for use in geologic structures of claim 25 further comprising:

an outer tube that is mounted around the outer diameter of the tubular assembly.

* * * * *